US007092653B2

(12) United States Patent
Yoshizuka et al.

(10) Patent No.: US 7,092,653 B2
(45) Date of Patent: Aug. 15, 2006

(54) IMAGE FORMING APPARATUS AND IMAGE FORMING SYSTEM

(75) Inventors: Ken Yoshizuka, Nagano-ken (JP); Akira Maruyama, Nagano-ken (JP); Osamu Ishibashi, Nagano-ken (JP); Masahiro Owa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 111 days.

(21) Appl. No.: 10/862,065

(22) Filed: Jun. 4, 2004

(65) Prior Publication Data

US 2005/0013625 A1 Jan. 20, 2005

(30) Foreign Application Priority Data

Jun. 4, 2003 (JP) ..... 2003-160057
Jun. 4, 2003 (JP) ..... 2003-160062
Jul. 14, 2003 (JP) ..... 2003-196710
Jul. 14, 2003 (JP) ..... 2003-196711

(51) Int. Cl.
*G03G 15/00* (2006.01)

(52) U.S. Cl. ..... 399/81; 399/12; 399/13

(58) Field of Classification Search ..... 399/13, 399/81, 227, 12, 85
See application file for complete search history.

(56) References Cited

U.S. PATENT DOCUMENTS 4,937,626 A * 6/1990 Kohtani et al. ..... 399/12
4,961,088 A * 10/1990 Gilliland et al. ..... 399/12 X
6,029,018 A * 2/2000 Rogers et al. ..... 399/12
6,324,352 B1 * 11/2001 Suzuki ..... 399/13
6,501,915 B1 * 12/2002 Yamashita ..... 399/227 X
6,549,732 B1 * 4/2003 Yoshizaki et al. ..... 399/12
2005/0041995 A1 * 2/2005 Owa et al. ..... 399/223

FOREIGN PATENT DOCUMENTS

| | | |
|---|---|---|
| JP | 61-061182 | 3/1986 |
| JP | 63-128976 | 6/1988 |
| JP | 64-007056 | 1/1989 |
| JP | 01-291266 | 11/1989 |
| JP | 04-116571 | 4/1992 |
| JP | 10-044387 | 2/1998 |
| JP | 2001-083750 | 3/2001 |
| JP | 2002-333756 | 11/2002 |
| JP | 2003-043773 | 2/2003 |

* cited by examiner

*Primary Examiner*—Sandra L. Brase
(74) *Attorney, Agent, or Firm*—Hogan & Hartson LLP

(57) ABSTRACT

An image forming apparatus comprises: attach/detach sections to/from each of which a developer container for containing developer can be attached/detached; an image bearing body for bearing a latent image; and a displaying section for displaying information thereon. When developer containers are attached to the attach/detach sections, the apparatus is usable as a color image forming apparatus for forming a color image by developing the latent image bore on the image bearing body with the developer in each developer container. When a developer container is attached to only one attach/detach section, the apparatus is usable as a single-color image forming apparatus for forming a single-color image by developing the latent image bore on the image bearing body with the developer in the developer container. Information displayed on the displaying section when the apparatus is used as the color image forming apparatus is different from information displayed on the displaying section when it is used as the single-color image forming apparatus.

31 Claims, 28 Drawing Sheets

| monochrome printer |
| --- |
| total number of sheets printed |
| remaining amount of black toner |
| photoconductor life |
| apparatus-type name |
| ⋮ |

FIG. 9A

| color printer |
| --- |
| total number of sheets printed |
| number of sheets printed in color |
| number of sheets printed in monochrome |
| remaining amount of cyan toner |
| remaining amount of magenta toner |
| remaining amount of yellow toner |
| remaining amount of black toner |
| photoconductor life |
| apparatus-type name |
| ⋮ |

FIG. 9B

| case | attachment information value | | | | setting operation of apparatus-type information |
|---|---|---|---|---|---|
| | black | magenta | cyan | yellow | |
| A | 0 | 0 | 0 | 0 | do not set |
| B | 0 | 0 | 0 | 1 | |
| C | 0 | 0 | 1 | 0 | |
| D | 0 | 0 | 1 | 1 | |
| E | 0 | 1 | 0 | 0 | |
| F | 0 | 1 | 0 | 1 | |
| G | 0 | 1 | 1 | 0 | |
| H | 0 | 1 | 1 | 1 | |
| I | 1 | 0 | 0 | 0 | set "1" (monochrome printer) |
| J | 1 | 0 | 0 | 1 | set "0" (color printer) |
| K | 1 | 0 | 1 | 0 | |
| L | 1 | 0 | 1 | 1 | |
| M | 1 | 1 | 0 | 0 | |
| N | 1 | 1 | 0 | 1 | |
| P | 1 | 1 | 1 | 0 | |
| Q | 1 | 1 | 1 | 1 | |

FIG. 14

LP-9000A

STATUS SHEET printer information

| | |
|---|---|
| remaining amount of C toner | E■■■□F |
| remaining amount of M toner | E■■■□F |
| remaining amount of Y toner | E■■□□F |
| remaining amount of K toner | E■■□□F |
| photoconductor life | E■■■□F |
| total number of sheets printed | 3176 sheets |
| number of sheets printed in color | 2071 sheets |
| ⋮ | ⋮ |

paper supply device

| | |
|---|---|
| MP cassette size | A3 |
| cassette 1 paper size | A4 |
| cassette 2 paper size | B4 |
| ⋮ | ⋮ |

print format

| | |
|---|---|
| page size | automatic |
| paper direction | vertical |
| ⋮ | ⋮ |

printer settings

| | |
|---|---|
| display language | English |
| power-save time | 30 min. |
| ⋮ | ⋮ |

FIG. 16

LP-9000B

STATUS SHEET printer information

| | |
|---|---|
| remaining amount of K toner | E■■■□F |
| photoconductor life | E■■■□F |
| total number of sheets printed | 1922 sheets |
| ⋮ | ⋮ |

paper supply device

| | |
|---|---|
| MP cassette size | A3 |
| cassette 1 paper size | A4 |
| cassette 2 paper size | B4 |
| ⋮ | ⋮ |

print format

| | |
|---|---|
| page size | automatic |
| paper direction | vertical |
| ⋮ | ⋮ |

printer settings

| | |
|---|---|
| display language | English |
| power-save time | 30 min. |
| ⋮ | ⋮ |

FIG. 18

| case | attachment information value | | | | temporary setting operation of apparatus-type information |
|---|---|---|---|---|---|
| | black | magenta | cyan | yellow | |
| A | 0 | 0 | 0 | 0 | do not perform temporary setting |
| B | 0 | 0 | 0 | 1 | |
| C | 0 | 0 | 1 | 0 | |
| D | 0 | 0 | 1 | 1 | |
| E | 0 | 1 | 0 | 0 | |
| F | 0 | 1 | 0 | 1 | |
| G | 0 | 1 | 1 | 0 | |
| H | 0 | 1 | 1 | 1 | |
| I | 1 | 0 | 0 | 0 | temporarily set "1" (monochrome printer) |
| J | 1 | 0 | 0 | 1 | temporarily set "0" (color printer) |
| K | 1 | 0 | 1 | 0 | |
| L | 1 | 0 | 1 | 1 | |
| M | 1 | 1 | 0 | 0 | |
| N | 1 | 1 | 0 | 1 | |
| P | 1 | 1 | 1 | 0 | |
| Q | 1 | 1 | 1 | 1 | |

FIG. 20

| case | attachment information value | | | | setting operation of apparatus-type information |
|---|---|---|---|---|---|
| | black | magenta | cyan | yellow | |
| A | 0 | 0 | 0 | 0 | do not set |
| B | 0 | 0 | 0 | 1 | |
| C | 0 | 0 | 1 | 0 | |
| D | 0 | 0 | 1 | 1 | |
| E | 0 | 1 | 0 | 0 | |
| F | 0 | 1 | 0 | 1 | |
| G | 0 | 1 | 1 | 0 | |
| H | 0 | 1 | 1 | 1 | |
| I | 1 | 0 | 0 | 0 | set "1" (monochrome printer) |
| J | 1 | 0 | 0 | 1 | set "0" (color printer) |
| K | 1 | 0 | 1 | 0 | |
| L | 1 | 0 | 1 | 1 | |
| M | 1 | 1 | 0 | 0 | |
| N | 1 | 1 | 0 | 1 | |
| P | 1 | 1 | 1 | 0 | |
| Q | 1 | 1 | 1 | 1 | |

FIG. 27

IMAGE FORMING APPARATUS AND IMAGE FORMING SYSTEM

CROSS-REFERENCE TO RELATED APPLICATIONS

The present application claims priority upon Japanese Patent Application No. 2003-160057 filed Jun. 4, 2003, Japanese Patent Application No. 2003-160062 filed Jun. 4, 2003, Japanese Patent Application No. 2003-196710 filed Jul. 14, 2003, and Japanese Patent Application No. 2003-196711 filed Jul. 14, 2003, the contents of which are herein incorporated by reference.

BACKGROUND OF THE INVENTION

1. Field of the Invention

The present invention relates to image forming apparatuses and image forming systems.

2. Description of the Related Art

There are known image forming apparatuses that comprise, for example, a plurality of attach/detach sections to and from each of which a developing unit (which serves as an example of a developer container for containing developer) can be attached and detached, and an image bearing body for bearing a latent image. These image forming apparatuses form images by developing the latent image bore on the image bearing body with the developer contained in the developing unit(s) attached to the attach/detach section(s). When image signals are transmitted from an external device such as a computer, the image forming apparatus moves the developing units to thereby locate one of the developing units at a developing position opposing the image bearing body. A developer image is formed by developing the latent image formed on the image bearing body, and the image is temporarily transferred onto an intermediate transferring body. The image forming apparatus sequentially changes the developing units and repeats the developing and transferring in a similar manner to superimpose a plurality of developer images and thereby form a color image. The developer image formed on the intermediate transferring body is then transferred onto a medium to form an image thereon. (See, for example, Japanese Patent Application Laid-open Publication No. 2002-333756 and Japanese Patent Application Laid-open Publication No. 2003-43773.)

In some situations, a user may wish to use a color image forming apparatus as a monochrome image forming apparatus by attaching, for example, only a black developing unit, which contains black developer, to the image forming apparatus. In order to fulfill such a desire, it is advantageous to use an image forming apparatus of the type described below, for example.

This type of image forming apparatus comprises a plurality of attach/detach sections to and from each of which a developing unit for containing developer can be attached and detached, and an image bearing body for bearing a latent image (and also a displaying section for displaying information thereon, if necessary). When a developing unit is attached to each of the plurality of attach/detach sections, the image forming apparatus can be used as a color image forming apparatus for forming a color image by developing the latent image bore on the image bearing body with the developer contained in each of the developing units. On the other hand, when a developing unit is attached to only one of the plurality of attach/detach sections, the image forming apparatus can be used as a single-color image forming apparatus for forming a single-color image by developing the latent image bore on the image bearing body with the developer contained in that developing unit.

(1) In this type of image forming apparatus, information is displayed on the displaying section. For example, the image forming apparatus displays, on the displaying section, information about the number of sheets on which images have been formed, for example.

However, not all of the information that is displayed on the displaying section when the image forming apparatus is used as a color image forming apparatus are necessary when the image forming apparatus is used as a monochrome image forming apparatus. For example, it would be preferable to display information, such as the number of sheets of media on which color images have been formed, when the image forming apparatus is used as a color image forming apparatus, but such information as the number of sheets of media on which color images have been formed is not always necessary when the image forming apparatus is used as a monochrome image forming apparatus. In view of such circumstances, there has been a need to display information that suits either the color image forming apparatus or the monochrome image forming apparatus respectively for when the image forming apparatus is used as a color image forming apparatus and for when it is used as a monochrome image forming apparatus.

(2) Further, when the image forming apparatus of the type described above is switched between the single-color mode and the color mode, apparatus information (such as "printer information") for when printing is carried out according to either the single-color state or the color state is output as a status sheet.

However, not all of the printer information about the color printer that is output when the printer is switched from the single-color mode to the color mode are necessary for the printer information about the single-color printer that is output when the printer is switched from the color mode to the single-color mode. Output of unnecessary information makes it difficult for a user to get hold of necessary information accurately.

(3) Further, there are situations in which a user, serviceperson, etc. (which is also referred to collectively as "user etc." below) wishes to switch the image forming apparatus between the single-color mode and the color mode. (This switching between the single-color mode and the color mode is also referred to as "apparatus switching" below.) In such a case, the user etc. carries out apparatus switching by either attaching a developing unit to an attach/detach section or detaching a developing unit from an attach/detach section.

However, there are cases in which the user etc. attaches a developing unit to an attach/detach section or detaches a developing unit from an attach/detach section, even though apparatus switching of the image forming apparatus is not intended. For example, the user may exchange developing units, or the user may confirm the developing units to specify causes of a malfunction of the image forming apparatus. If apparatus switching of the image forming apparatus is executed, contrary to the user's intentions, due to attachment/detachment of a developing unit in the above-described cases, then it will become inconvenient for the user etc.

(4) Meanwhile, devices, such as the image forming apparatuses of the type described above, that are capable of communicating with computers generally have device IDs. A device ID is used by the computer to recognize the device when the device is electrically connected to the computer. By receiving the device ID from the device, the computer carries out settings relating to the device, such as allocation of hardware resources, and also carries out operations such as prompting a user to install a device driver for that device (which is also referred to simply as a "driver" below) or loading the driver.

It is preferable for a driver for an image forming apparatus of the above-mentioned type to be provided with functions that suit a single-color image forming apparatus for when the image forming apparatus is being used as the single-color image forming apparatus, as well as functions that suit a color image forming apparatus for when the image forming apparatus is being used as the color image forming apparatus. This would be convenient for a user.

Therefore, it is preferable that computers run a driver having the appropriate functions that suit either the single-color image forming apparatus or the color image forming apparatus when it receives a device ID from an image forming apparatus.

SUMMARY OF THE INVENTION

The present invention has been made in view of the above and other problems.

An object of the present invention is to achieve an image forming apparatus and an image forming system which are capable of displaying, on a displaying section, information that suits either the color image forming apparatus or the monochrome image forming apparatus respectively for when the image forming apparatus is used as a color image forming apparatus and for when it is used as a monochrome image forming apparatus.

Another object of the present invention is to achieve an image forming apparatus and an image forming system which allow a user to get hold of apparatus information accurately.

Another object of the present invention is to achieve an image forming apparatus and an image forming system which are convenient for users etc.

(1) A first aspect of the present invention is an image forming apparatus comprising:

a plurality of attach/detach sections to and from each of which a developer container for containing developer can be attached and detached;

an image bearing body for bearing a latent image; and a displaying section for displaying information thereon, wherein:

when a developer container is attached to each of the plurality of attach/detach sections, the image forming apparatus is usable as a color image forming apparatus for forming a color image by developing the latent image bore on the image bearing body with the developer contained in each developer container;

when a developer container is attached to only one of the plurality of attach/detach sections, the image forming apparatus is usable as a single-color image forming apparatus for forming a single-color image by developing the latent image bore on the image bearing body with the developer contained in the developer container; and information that is displayed on the displaying section when the image forming apparatus is used as the color image forming apparatus is different from information that is displayed on the displaying section when the image forming apparatus is used as the single-color image forming apparatus.

(2) A second aspect of the present invention is an image forming apparatus comprising:

a plurality of attach/detach sections to and from each of which a developer container for containing developer can be attached and detached; and an image bearing body for bearing a latent image, wherein:

when a developer container is attached to each of the plurality of attach/detach sections, the image forming apparatus is usable as a color image forming apparatus for forming a color image by developing the latent image bore on the image bearing body with the developer contained in each developer container;

when a developer container is attached to only one of the plurality of attach/detach sections, the image forming apparatus is usable as a single-color image forming apparatus for forming a single-color image by developing the latent image bore on the image bearing body with the developer contained in the developer container; and apparatus information that is output on a medium when the color image is formed is different from apparatus information that is output on a medium when the single-color image is formed.

(3) A third aspect of the present invention is an image forming apparatus comprising:

a plurality of attach/detach sections to and from each of which a developer container for containing developer can be attached and detached; and an image bearing body for bearing a latent image, wherein:

when a developer container is attached to each of the plurality of attach/detach sections, the image forming apparatus is usable as a color image forming apparatus for forming a color image by developing the latent image bore on the image bearing body with the developer contained in each developer container;

when a developer container is attached to only one of the plurality of attach/detach sections, the image forming apparatus is usable as a single-color image forming apparatus for forming a single-color image by developing the latent image bore on the image bearing body with the developer contained in the developer container; and the image forming apparatus has information that indicates whether the image forming apparatus is being used as the color image forming apparatus or as the single-color image forming apparatus.

(4) A fourth aspect of the present invention is an image forming apparatus comprising:

a plurality of attach/detach sections to and from each of which a developer container for containing developer can be attached and detached; and an image bearing body for bearing a latent image, wherein:

when a developer container is attached to each of the plurality of attach/detach sections, the image forming apparatus is usable as a color image forming apparatus for forming a color image by developing the latent image bore on the image bearing body with the developer contained in each developer container;

when a developer container is attached to only one of the plurality of attach/detach sections, the image forming apparatus is usable as a single-color image forming apparatus for forming a single-color image by developing the latent image bore on the image bearing body with the developer contained in the developer container;

the image forming apparatus has device IDs that are sent to a computer when the image forming apparatus communicates with the computer and that are used by the computer to recognize devices capable of communicating with the computer; and the device ID of the image forming apparatus for when the image forming apparatus is being used as the color image forming apparatus is different from the device ID of the image forming apparatus for when the image forming apparatus is being used as the single-color image forming apparatus.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 9A shows a table that indicates information displayable on a displaying section for when the printer 10 is used as a monochrome printer, and FIG. 9B shows a table that indicates information displayable on the display section for when the printer 10 is used as a color printer;

FIG. 14 shows a relationship between values of attachment information and operations of setting apparatus-type information;

FIG. 16 shows an example of a status sheet that is output when the printer is switched from a monochrome printer to a color printer;

FIG. 18 shows an example of a status sheet that is output when the printer is switched from a color printer to a monochrome printer;

FIG. 20 shows a relationship between values of attachment/no-attachment information and operations of temporarily setting apparatus-type information;

FIG. 27 shows a relationship between values of attachment information and operations of setting apparatus-type information.

DETAILED DESCRIPTION OF THE INVENTION

Figure 1:
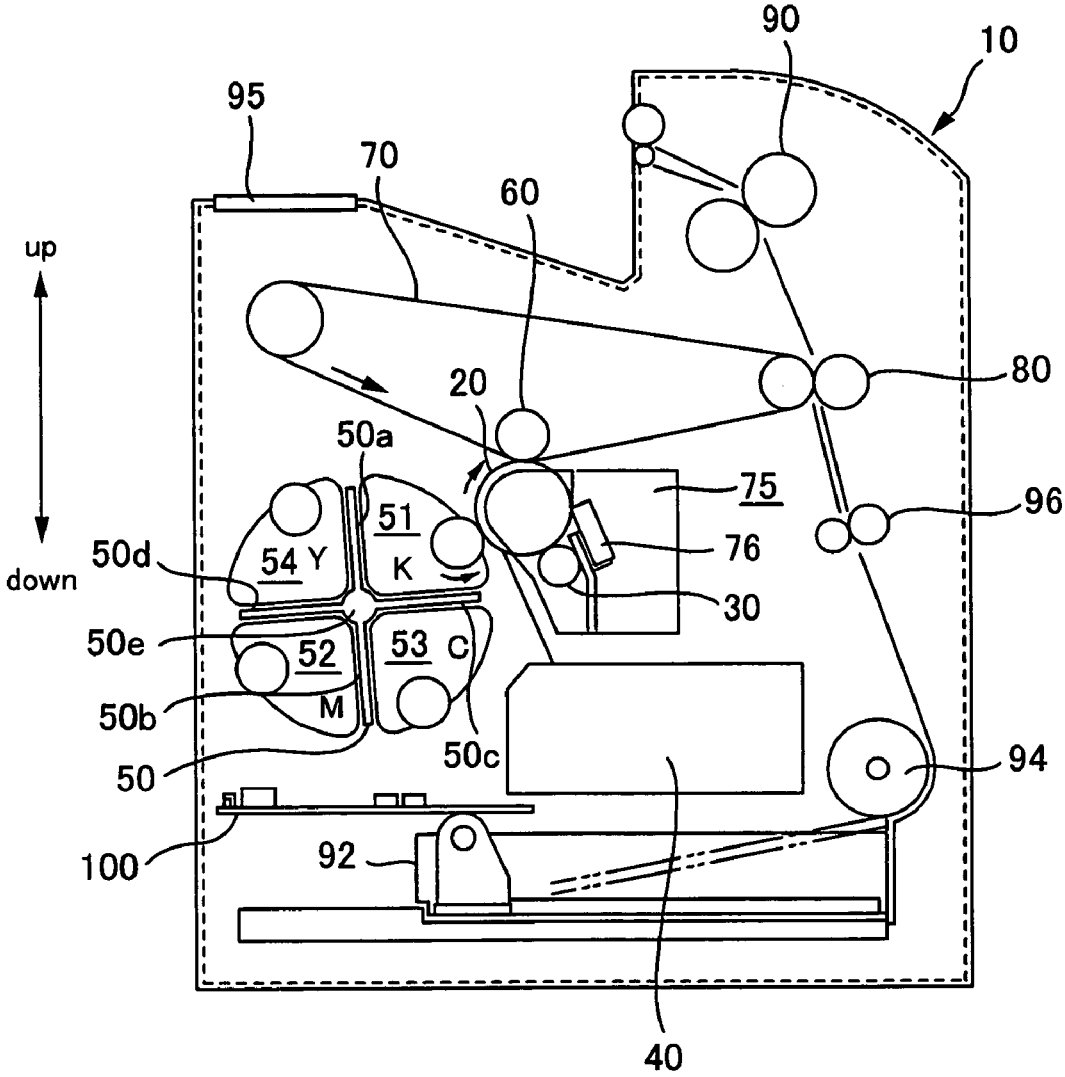
FIG. 1 is a diagram showing main structural components that structure a printer 10 according to a first embodiment when the printer 10 is used as a color printer.

At least the following matters will be made clear by the explanation in the present specification and the description of the accompanying drawings.

(1) A first aspect of the present invention is an image forming apparatus comprising: a plurality of attach/detach sections to and from each of which a developer container for containing developer can be attached and detached; an image bearing body for bearing a latent image; and a displaying section for displaying information thereon, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; and information that is displayed on the displaying section when the image forming apparatus is used as the color image forming apparatus is different from information that is displayed on the displaying section when the image forming apparatus is used as the single-color image forming apparatus.

According to such an image forming apparatus, the information that is displayed on the displaying section when the image forming apparatus is used as the color image forming apparatus is different from the information that is displayed on the displaying section when the image forming apparatus is used as the single-color image forming apparatus. Therefore, it becomes possible to display, on the displaying section, information that suits either the color image forming apparatus or the single-color image forming apparatus respectively for when the image forming apparatus is being used as a color image forming apparatus and for when the image forming apparatus is being used as a single-color image forming apparatus.

Further, in the image forming apparatus, the image forming apparatus may have information indicative of whether the image forming apparatus is being used as the color image forming apparatus or whether the image forming apparatus is being used as the single-color image forming apparatus.

Since the image forming apparatus has information indicative of whether the image forming apparatus is being used as the color image forming apparatus or whether the image forming apparatus is being used as the single-color image forming apparatus, it becomes possible to display, on the displaying section, information that suits either the color image forming apparatus or the single-color image forming apparatus respectively for when the image forming apparatus is being used as a color image forming apparatus and for when the image forming apparatus is being used as a single-color image forming apparatus.

Further, in the image forming apparatus, the single-color image forming apparatus may be a monochrome image forming apparatus that forms monochrome images, when a developer container is attached to only one of the plurality of attach/detach sections, by developing the latent image bore on the image bearing body with the developer contained in the developer container.

According to such an image forming apparatus, the information that is displayed on the displaying section when the image forming apparatus is used as the color image forming apparatus is different from the information that is displayed on the displaying section when the image forming apparatus is used as the monochrome image forming apparatus. Therefore, it becomes possible to display, on the displaying section, information that suits either the color image forming apparatus or the monochrome image forming apparatus respectively for when the image forming apparatus is being used as a color image forming apparatus and for when the image forming apparatus is being used as a monochrome image forming apparatus.

Further, in the image forming apparatus, the information that is displayed on the displaying section when the image forming apparatus is used as the color image forming apparatus may be information in which information specific to the color image forming apparatus has been added to the information that is displayed on the displaying section when the image forming apparatus is used as the single-color image forming apparatus.

According to such an image forming apparatus, when the image forming apparatus is used as the color image forming apparatus, it is possible to display, as is, the information that is displayed on the displaying section when the image forming apparatus is used as the single-color image forming apparatus, and it is also possible to display the information specific to the color image forming apparatus.

Further, in the image forming apparatus, the information specific to the color image forming apparatus may include information about a number of sheets of media on which the color images have been formed.

According to such an image forming apparatus, the information about the number of sheets of media on which color images have been formed by the image forming apparatus is displayed on the displaying section when the image forming apparatus is used as a color image forming apparatus, but is not displayed on the displaying section when it is used as a single-color image forming apparatus. Therefore, it becomes possible to display, on the displaying section, the information about the number of sheets of media on which color images have been formed only when necessary.

Further, in the image forming apparatus, the information specific to the color image forming apparatus may include information about a remaining amount of developer in the developer container that contains color developer.

According to such an image forming apparatus, the information about the remaining amount of developer in the developer container that contains color developer is displayed on the displaying section when the image forming apparatus is used as a color image forming apparatus, but is not displayed on the displaying section when it is used as a single-color image forming apparatus. Therefore, it becomes possible to display, on the displaying section, the information about the remaining amount of developer in the developer container that contains color developer only when necessary.

Further, in the image forming apparatus, an apparatus-type name that is displayed on the displaying section when the image forming apparatus is used as the color image forming apparatus may be different from an apparatus-type name that is displayed on the displaying section when the image forming apparatus is used as the single-color image forming apparatus.

According to such an image forming apparatus, the apparatus-type name that is displayed on the displaying section when the image forming apparatus is used as the color image forming apparatus will differ from the apparatus-type name that is displayed on the displaying section when the image forming apparatus is used as the single-color image forming apparatus. Therefore, a user can easily recognize whether the image forming apparatus is being used as a color image forming apparatus or as a single-color image forming apparatus.

Further, in the image forming apparatus, the image forming apparatus may further comprise an operating section for selecting the information that is to be displayed on the displaying section; and information that can be displayed on the displaying section by operating the operating section when the image forming apparatus is used as the color image forming apparatus may be different from information that can be displayed on the displaying section by operating the operating section when the image forming apparatus is used as the single-color image forming apparatus.

In this way, it becomes possible to display, on the displaying section, information that suits either the color image forming apparatus or the single-color image forming apparatus respectively for when the image forming apparatus is being used as a color image forming apparatus and for when the image forming apparatus is being used as a single-color image forming apparatus, not only when all of the information is to be displayed on the displaying section at once, but also when only a portion of the information that has been selected by operating the operating section is to be displayed on the displaying section.

Further, in the image forming apparatus, the displaying section may be provided on a body of the image forming apparatus.

According to such an image forming apparatus, it becomes possible to display, on the displaying section that is provided on the body of the image forming apparatus, information that suits either the color image forming apparatus or the single-color image forming apparatus respectively for when the image forming apparatus is being used as a color image forming apparatus and for when the image forming apparatus is being used as a single-color image forming apparatus.

It is also possible to provide an image forming apparatus comprising: a plurality of attach/detach sections to and from each of which a developer container for containing developer can be attached and detached; an image bearing body for bearing a latent image; and a displaying section that is provided on a body of the image forming apparatus and that is for displaying information thereon, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a monochrome image forming apparatus for forming a monochrome image by developing the latent image bore on the image bearing body with the developer contained in the developer container; the image forming apparatus has information indicative of whether the image forming apparatus is being used as the color image forming apparatus or whether the image forming apparatus is being used as the monochrome image forming apparatus; the information that is displayed on the displaying section when the image forming apparatus is used as the color image forming apparatus is information in which information specific to the color image forming apparatus has been added to the information that is displayed on the displaying section when the image forming apparatus is used as the monochrome image forming apparatus; the information specific to the color image forming apparatus includes information about a number of sheets of media on which the color images have been formed; the information specific to the color image forming apparatus includes information about a remaining amount of developer in the developer container that contains color developer; the image forming apparatus further comprises an operating section for selecting the information that is to be displayed on the displaying section; and information that can be displayed on the displaying section by operating the operating section when the image forming apparatus is used as the color image forming apparatus is different from information that can be displayed on the displaying section by operating the operating section when the image forming apparatus is used as the monochrome image forming apparatus.

Objects of the present invention are achieved most effectively because all of the effects described above can be obtained according to the above-mentioned structure.

It is also possible to provide an image forming system comprising: a computer; and an image forming apparatus that is connectable to the computer and that includes a plurality of attach/detach sections to and from each of which a developer container for containing developer can be attached and detached; an image bearing body for bearing a latent image; and a displaying section for displaying information thereon, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; and information that is displayed on the displaying section when the image forming apparatus is used as the color image forming apparatus is different from information that is displayed on the displaying section when the image forming apparatus is used as the single-color image forming apparatus.

As an overall system, the image forming system that is achieved in this way becomes superior to conventional systems.

(2) A second aspect of the present invention is an image forming apparatus comprising: a plurality of attach/detach sections to and from each of which a developer container for containing developer can be attached and detached; and an image bearing body for bearing a latent image, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; and apparatus information that is output on a medium when the color image is formed is different from apparatus information that is output on a medium when the single-color image is formed.

According to such an image forming apparatus, since the apparatus information that is output on a medium when color images are formed is different from the apparatus information that is output on a medium when single-color images are formed, it becomes possible to output, on the medium, appropriate apparatus information that suits either the color image or the single-color image.

Further, in the image forming apparatus, in a state where the developer container is attached to only one of the plurality of attach/detach sections, a monochrome image may be formed by developing the latent image bore on the image bearing body with the developer contained in the developer container.

According to such an image forming apparatus, since the apparatus information that is output on a medium when color images are formed is different from the apparatus information that is output on a medium when monochrome images are formed, it becomes possible to output, on the medium, appropriate apparatus information that suits either the color image or the monochrome image.

Further, in the image forming apparatus, the apparatus information that is output on the medium when the color image is formed may be information in which information specific to the color image forming apparatus has been added to the apparatus information that is output on the medium when the single-color image is formed.

According to such an image forming apparatus, when color images are to be formed, it is possible to output, as is, the apparatus information that is output on the medium when single-color images are formed, and it is also possible to output the information specific to the color image forming apparatus.

Further, the information specific to the color image forming apparatus may include information about a number of sheets of media on which color images have been formed.

According to such an image forming apparatus, the information about the number of sheets of media on which color images have been formed will be output on the medium when color images are formed, but will not be output on the medium when single-color images are formed. Therefore, it becomes possible to output, on the medium, the information about the number of sheets of media on which color images have been formed only when necessary.

Further, in the image forming apparatus, the information specific to the color image forming apparatus may include information about a remaining amount of developer in the developer container that contains color developer.

According to such an image forming apparatus, the information about the remaining amount of developer in the developer container that contains color developer will be output on the medium when color images are formed, but will not be output on the medium when single-color images are formed. Therefore, it becomes possible to output, on the medium, the information about the remaining amount of developer in the developer container that contains color developer only when necessary.

Further, in the image forming apparatus, an apparatus-type name that is output on the medium when color images are formed may be different from an apparatus-type name that is output on the medium when single-color images are formed.

According to such an image forming apparatus, the apparatus-type name that is output on the medium when color images are formed will differ from the apparatus-type name that is output on the medium when single-color images are formed. Therefore, a user can easily recognize whether the image forming apparatus is forming color images or forming single-color images.

Further, the image forming apparatus may further comprise an operating section that is operated by a user; and when the user carries out a predetermined operation with respect to the operating section, the image forming apparatus may output, on the medium, the apparatus information about the image forming apparatus corresponding to either the color image or the single-color image.

According to such an image forming apparatus, it becomes possible to output, on the medium, appropriate apparatus information that suits either color-image formation or single-color-image formation when there is a request from the user.

Further, the operating section may be provided on a body of the image forming apparatus.

According to such an image forming apparatus, it becomes possible to output, on the medium, appropriate apparatus information that suits either color-image formation or single-color-image formation when the user makes a request by operating the operating section provided on the body of the image forming apparatus.

It is also possible to provide an image forming apparatus comprising: a plurality of attach/detach sections to and from each of which a developer container for containing developer can be attached and detached; and an image bearing body for bearing a latent image, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; apparatus information that is output on a medium when the color image is formed is different from apparatus information that is output on a medium when the single-color image is formed; in a state where the developer container is attached to only one of the plurality of attach/detach sections, a monochrome image is formed by developing the latent image bore on the image bearing body with the developer contained in the developer container; the apparatus information that is output on the medium when the color image is formed is information in which information specific to the color image forming apparatus has been added to the apparatus information that is output on the medium when the single-color image is formed; the information specific to the color image forming apparatus includes information about a number of sheets of media on which the color images have been formed; the information specific to the color image forming apparatus includes information about a remaining amount of developer in the developer container that contains color developer; an apparatus-type name that is output on the medium when the color image is formed is different from an apparatus-type name that is output on the medium when the single-color image is formed; the image forming apparatus further comprises an operating section that is operated by a user; and when the user carries out a predetermined operation with respect to the operating section, the image forming apparatus outputs, on the medium, the apparatus information about the image forming apparatus corresponding to either the color image or the single-color image.

Objects of the present invention are achieved most effectively because all of the effects described above can be obtained according to the above-mentioned structure.

It is also possible to provide an image forming system comprising: a computer; and an image forming apparatus that is connectable to the computer and that includes a plurality of attach/detach sections to and from each of which a developer container for containing developer can be attached and detached; and an image bearing body for bearing a latent image, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; and apparatus information that is output on a medium when the color image is formed is different from apparatus information that is output on a medium when the single-color image is formed.

As an overall system, the image forming system that is achieved in this way becomes superior to conventional systems.

(3) A third aspect of the present invention is an image forming apparatus comprising: a plurality of attach/detach sections to and from each of which a developer container for containing developer can be attached and detached; and an image bearing body for bearing a latent image, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; and the image forming apparatus has information that indicates whether the image forming apparatus is being used as the color image forming apparatus or as the single-color image forming apparatus.

It is possible to achieve an image forming apparatus that is convenient for users etc. by letting the image forming apparatus have information that indicates whether the image forming apparatus is being used as the color image forming apparatus or as the single-color image forming apparatus.

Further, attachment and detachment of the developer container to and from each of the plurality of attach/detach sections may be made possible only when power is being supplied to the image forming apparatus.

In such a situation, a problem in that apparatus switching of the image forming apparatus is executed, contrary to the user's intention, is more likely to arise, and therefore, the importance of the present invention increases and the objects of the present invention are achieved more advantageously.

Further, the information may be set when power is supplied to the image forming apparatus and may be made such that it is not updated until power supply to the image forming apparatus is stopped.

In this way, while power is being supplied to the image forming apparatus, it is possible to certainly avoid the problem in that apparatus switching of the image forming apparatus is executed contrary to the user's intention.

Further, the single-color image forming apparatus may be a monochrome image forming apparatus that forms monochrome images, when a black developer container containing black developer is attached to only one of the plurality of attach/detach sections, by developing the latent image bore on the image bearing body with the black developer contained in the black developer container.

It is possible to achieve an image forming apparatus that is convenient for users etc. by letting the image forming apparatus have information that indicates whether the image forming apparatus is being used as the color image forming apparatus or as the monochrome image forming apparatus.

Further, if the black developer container is attached only to the one of the plurality of attach/detach sections when power is supplied to the image forming apparatus, then the information may be set as information that indicates that the image forming apparatus is being used as the monochrome image forming apparatus; and if the black developer container and at least one developer container other than the black developer container are attached to the plurality of attach/detach sections when power is supplied to the image forming apparatus, then the information may be set as information that indicates that the image forming apparatus is being used as the color image forming apparatus.

It is possible to achieve an image forming apparatus that is convenient for users etc. by setting the information as information that indicates that the image forming apparatus is being used as the monochrome image forming apparatus if the black developer container is attached only to the one of the plurality of attach/detach sections when power is supplied to the image forming apparatus; and by setting the information as information that indicates that the image forming apparatus is being used as the color image forming apparatus if the black developer container and at least one developer container other than the black developer container are attached to the plurality of attach/detach sections when power is supplied to the image forming apparatus.

Further, the image forming apparatus may further comprise a controller that controls the image forming apparatus; the controller may include a volatile memory; and the information may be set to the volatile memory.

In this way, cost reduction is achieved.

Further, the controller may include a non-volatile memory; and the information may temporarily be set to the non-volatile memory, and the information that has been temporarily set to the non-volatile memory may be read into the volatile memory when power is supplied to the image forming apparatus and be set to the volatile memory.

In this way, it is possible to reduce the loads on the image forming apparatus during initial operation when power is supplied thereto.

Further, the information may temporarily be set to the non-volatile memory when attachment or detachment of the developer container to or from one of the plurality of attach/detach sections is finished.

In this way, it is possible to achieve efficient temporary settings of the apparatus-type information.

Further, if the black developer container is attached only to the one of the plurality of attach/detach sections, then the information may temporarily be set as information that indicates that the image forming apparatus is being used as the monochrome image forming apparatus; if the black developer container and at least one developer container other than the black developer container are attached to the plurality of attach/detach sections, then the information may temporarily be set as information that indicates that the image forming apparatus is being used as the color image forming apparatus; and if the black developer container is not attached, then temporary setting of the information does not have to be carried out.

In this way, it is possible to achieve an image forming apparatus that is convenient for users etc.

Further, each developer container may be made to be attachable to only one of the plurality of attach/detach sections that corresponds to that developer container; the image forming apparatus may have attachment/no-attachment information about each developer container for each of the attach/detach sections; and temporary setting of the information may be carried out based on the attachment/no-attachment information.

In this way, it becomes possible to easily determine whether a developer container is attached or not.

It is also possible to provide an image forming apparatus comprising: a plurality of attach/detach sections to and from each of which a developer container for containing developer can be attached and detached; and an image bearing body for bearing a latent image, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; the image forming apparatus has information that indicates whether the image forming apparatus is being used as the color image forming apparatus or as the single-color image forming apparatus; attachment and detachment of the developer container to and from each of the plurality of attach/detach sections is possible only when power is being supplied to the image forming apparatus; the information is set when power is supplied to the image forming apparatus and is not updated until power supply to the image forming apparatus is stopped; the single-color image forming apparatus is a monochrome image forming apparatus that forms monochrome images, when a black developer container containing black developer is attached to only one of the plurality of attach/detach sections, by developing the latent image bore on the image bearing body with the black developer contained in the black developer container; if the black developer container is attached only to the one of the plurality of attach/detach sections when power is supplied to the image forming apparatus, then the information is set as information that indicates that the image forming apparatus is being used as the monochrome image forming apparatus; if the black developer container and at least one developer container other than the black developer container are attached to the plurality of attach/detach sections when power is supplied to the image forming apparatus, then the information is set as information that indicates that the image forming apparatus is being used as the color image forming apparatus; the image forming apparatus further comprises a controller that controls the image forming apparatus; the controller includes a volatile memory; the information is set to the volatile memory; the controller includes a non-volatile memory; the information is temporarily set to the non-volatile memory, and the information that has been temporarily set to the non-volatile memory is read into the volatile memory when power is supplied to the image forming apparatus and is set to the volatile memory; the information is temporarily set to the non-volatile memory when attachment or detachment of the developer container to or from one of the plurality of attach/detach sections is finished; if the black developer container is attached only to the one of the plurality of attach/detach sections, then the information is temporarily set as information that indicates that the image forming apparatus is being used as the monochrome image forming apparatus; if the black developer container and at least one developer container other than the black developer container are attached to the plurality of attach/detach sections, then the information is temporarily set as information that indicates that the image forming apparatus is being used as the color image forming apparatus; if the black developer container is not attached, then temporary setting of the information is not carried out; each developer container is attachable to only one of the plurality of attach/detach sections that corresponds to that developer container; the image forming apparatus has attachment/no-attachment information about each developer container for each of the attach/detach sections; and temporary setting of the information is carried out based on the attachment/no-attachment information.

Objects of the present invention are achieved most effectively because all of the effects described above can be obtained according to the above-mentioned structure.

It is also possible to provide an image forming system comprising: a computer; and an image forming apparatus that is connectable to the computer and that includes a plurality of attach/detach sections to and from each of which a developer container for containing developer can be attached and detached; and an image bearing body for bearing a latent image, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; and the image forming apparatus has information that indicates whether the image forming apparatus is being used as the color image forming apparatus or as the single-color image forming apparatus.

As an overall system, the image forming system that is achieved in this way becomes superior to conventional systems.

(4) A fourth aspect of the present invention is an image forming apparatus comprising: a plurality of attach/detach sections to and from each of which a developer container for containing developer can be attached and detached; and an image bearing body for bearing a latent image, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; the image forming apparatus has device IDs that are sent to a computer when the image forming apparatus communicates with the computer and that are used by the computer to recognize devices capable of communicating with the computer; and the device ID of the image forming apparatus for when the image forming apparatus is being used as the color image forming apparatus is different from the device ID of the image forming apparatus for when the image forming apparatus is being used as the single-color image forming apparatus.

It is possible to achieve an image forming apparatus that is convenient for users by making the device ID of the image forming apparatus for when it is being used as the color image forming apparatus be different from the device ID of the image forming apparatus for when it is being used as the single-color image forming apparatus.

Further, the image forming apparatus may have information indicative of whether the image forming apparatus is being used as the color image forming apparatus or whether the image forming apparatus is being used as the single-color image forming apparatus.

In this way, it is possible to distinguish certainly whether the image forming apparatus is being used as a color image forming apparatus or as a single-color image forming apparatus.

Further, the single-color image forming apparatus may be a monochrome image forming apparatus that forms monochrome images, when a developer container is attached to only one of the plurality of attach/detach sections, by developing the latent image bore on the image bearing body with the developer contained in the developer container.

It is possible to achieve an image forming apparatus that is convenient for users by making the device ID of the image forming apparatus for when it is being used as the color image forming apparatus be different from the device ID of the image forming apparatus for when it is being used as the monochrome image forming apparatus.

Further, the device ID may be updated at the time when the image forming apparatus is switched from the single-color image forming apparatus to the color image forming apparatus or from the color image forming apparatus to the single-color image forming apparatus.

In this way, it is possible for a computer to certainly receive a device ID indicative of a color image forming apparatus when the image forming apparatus is being used as a color image forming apparatus and receive a device ID indicative of a single-color image forming apparatus when the image forming apparatus is being used as a single-color image forming apparatus.

It is also possible to provide an image forming apparatus comprising: a plurality of attach/detach sections to and from each of which a developer container for containing developer can be attached and detached; and an image bearing body for bearing a latent image, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; the image forming apparatus has device IDs that are sent to a computer when the image forming apparatus communicates with the computer and that are used by the computer to recognize devices capable of communicating with the computer; the device ID of the image forming apparatus for when the image forming apparatus is being used as the color image forming apparatus is different from the device ID of the image forming apparatus for when the image forming apparatus is being used as the single-color image forming apparatus; the image forming apparatus has information indicative of whether the image forming apparatus is being used as the color image forming apparatus or whether the image forming apparatus is being used as the single-color image forming apparatus; the single-color image forming apparatus is a monochrome image forming apparatus that forms monochrome images, when a developer container is attached to only one of the plurality of attach/detach sections, by developing the latent image bore on the image bearing body with the developer contained in the developer container; and the device ID is updated at the time when the image forming apparatus is switched from the single-color image forming apparatus to the color image forming apparatus or from the color image forming apparatus to the single-color image forming apparatus.

Objects of the present invention are achieved most effectively because all of the effects described above can be obtained according to the above-mentioned structure.

Another aspect of the present invention is an image forming system comprising: an image forming apparatus that includes a plurality of attach/detach sections to and from each of which a developer container for containing developer can be attached and detached and an image bearing body for bearing a latent image; and a computer that is capable of communicating with the image forming apparatus, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; the image forming apparatus has device IDs that are sent to the computer when the image forming apparatus communicates with the computer and that are used by the computer to recognize devices capable of communicating with the computer; and the device ID of the image forming apparatus for when the image forming apparatus is being used as the color image forming apparatus is different from the device ID of the image forming apparatus for when the image forming apparatus is being used as the single-color image forming apparatus.

It is possible to achieve an image forming system that is convenient for users by making the device ID of the image forming apparatus for when it is being used as the color image forming apparatus be different from the device ID of the image forming apparatus for when it is being used as the single-color image forming apparatus.

Further, the image forming apparatus may have information indicative of whether the image forming apparatus is being used as the color image forming apparatus or whether the image forming apparatus is being used as the single-color image forming apparatus.

In this way, it is possible to distinguish certainly whether the image forming apparatus is being used as a color image forming apparatus or as a single-color image forming apparatus.

Further, the single-color image forming apparatus may be a monochrome image forming apparatus that forms monochrome images, when a developer container is attached to only one of the plurality of attach/detach sections, by developing the latent image bore on the image bearing body with the developer contained in the developer container.

It is possible to achieve an image forming system that is convenient for users by making the device ID of the image forming apparatus for when it is being used as the color image forming apparatus be different from the device ID of the image forming apparatus for when it is being used as the monochrome image forming apparatus.

Further, the device ID may be updated at the time when the image forming apparatus is switched from the single-color image forming apparatus to the color image forming apparatus or from the color image forming apparatus to the single-color image forming apparatus.

In this way, it is possible for a computer to certainly receive a device ID indicative of a color image forming apparatus when the image forming apparatus is being used as a color image forming apparatus and receive a device ID indicative of a single-color image forming apparatus when the image forming apparatus is being used as a single-color image forming apparatus.

Further, the computer may have a driver for the image forming apparatus. Furthermore, the computer may have at least either one of: a color driver that corresponds to the image forming apparatus when the apparatus is used as the color image forming apparatus; or a single-color driver that corresponds to the image forming apparatus when the apparatus is used as the single-color image forming apparatus.

It is also possible to provide an image forming system comprising: an image forming apparatus that includes a plurality of attach/detach sections to and from each of which a developer container for containing developer can be attached and detached and an image bearing body for bearing a latent image; and a computer that is capable of communicating with the image forming apparatus, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; the image forming apparatus has device IDs that are sent to the computer when the image forming apparatus communicates with the computer and that are used by the computer to recognize devices capable of communicating with the computer; the device ID of the image forming apparatus for when the image forming apparatus is being used as the color image forming apparatus is different from the device ID of the image forming apparatus for when the image forming apparatus is being used as the single-color image forming apparatus; the image forming apparatus has information indicative of whether the image forming apparatus is being used as the color image forming apparatus or whether the image forming apparatus is being used as the single-color image forming apparatus; the single-color image forming apparatus is a monochrome image forming apparatus that forms monochrome images, when a developer container is attached to only one of the plurality of attach/detach sections, by developing the latent image bore on the image bearing body with the developer contained in the developer container; the device ID is updated at the time when the image forming apparatus is switched from the single-color image forming apparatus to the color image forming apparatus or from the color image forming apparatus to the single-color image forming apparatus; the computer has a driver for the image forming apparatus; and the computer has at least either one of: a color driver that corresponds to the image forming apparatus when the apparatus is used as the color image forming apparatus; or a single-color driver that corresponds to the image forming apparatus when the apparatus is used as the single-color image forming apparatus.

Objects of the present invention are achieved most effectively because all of the effects described above can be obtained according to the above-mentioned structure.

FIRST EMBODIMENT

Overall Configuration Example of Image Forming Apparatus

Figure 2:
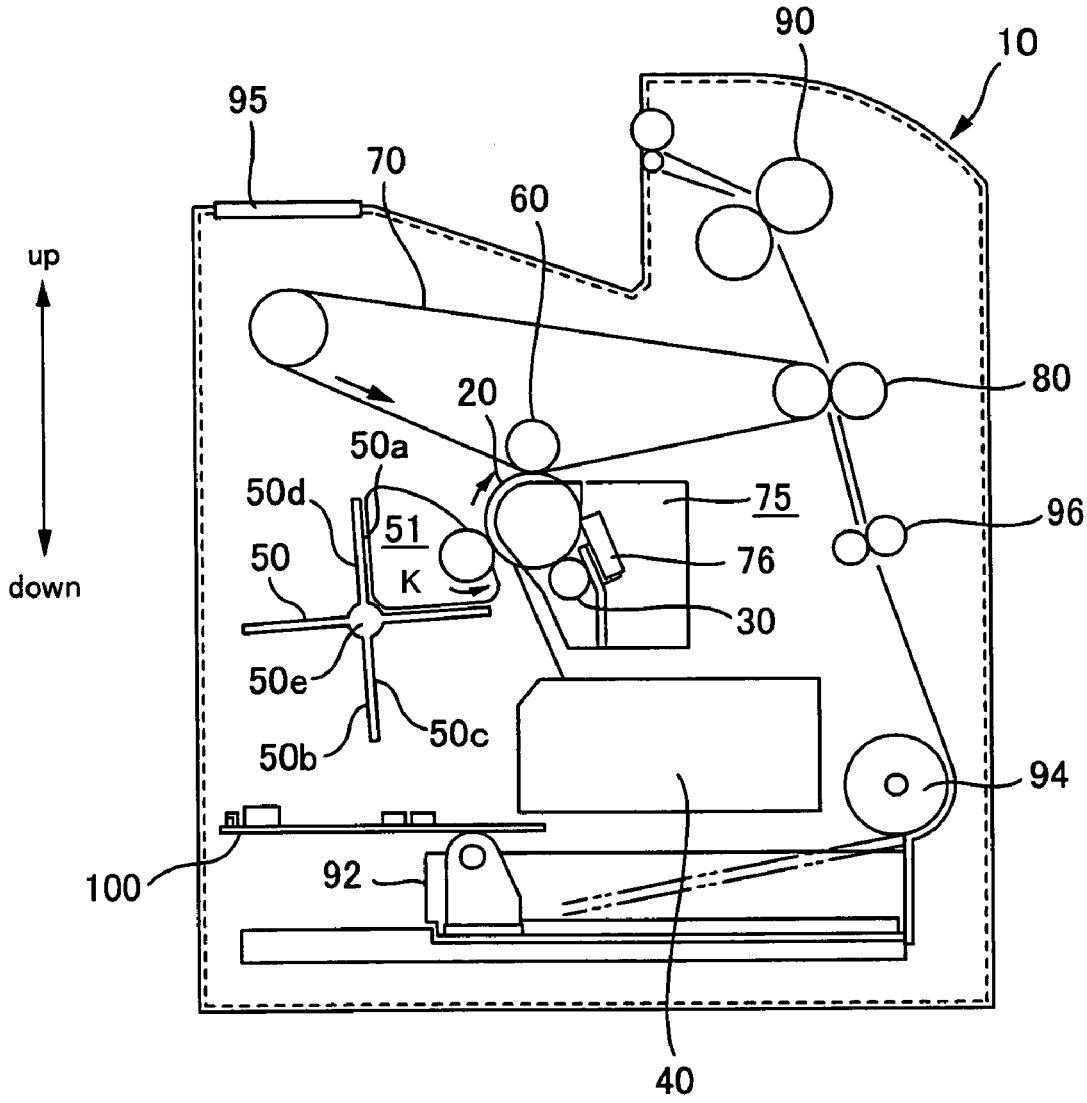
FIG. 2 is a diagram showing main structural components that structure the printer 10 when the printer 10 is used as a monochrome printer.

Next, using FIG. 1 and FIG. 2, an outline of an image-forming apparatus according to the first embodiment will be described, taking a laser-beam printer 10 (hereinafter referred to also as "printer") as an example. FIG. 1 and FIG. 2 are diagrams showing main structural components constructing the printer 10. FIG. 1 is a diagram showing the main structural components for when the printer 10 is used as a color printer, and FIG. 2 is a diagram showing the main structural components for when the printer 10 is used as a monochrome printer. The usage of the printer 10 as a color printer or a monochrome printer will be described in detail further below. Note that in FIG. 1 and FIG. 2, the vertical direction is shown by the arrow, and, for example, a paper supply tray 92 is arranged at a lower section of the printer 10, and a fusing unit 90 is arranged at an upper section of the printer 10.

As shown in FIG. 1 and FIG. 2, the printer 10 includes a charging unit 30, an exposing unit 40, a YMCK developing device 50, a first transferring unit 60, an intermediate transferring body 70, and a cleaning unit 75, all of which being arranged in the direction of rotation of a photoconductor 20 which serves as an example of an image bearing body and which is for bearing a latent image. The printer 10 further includes a second transferring unit 80, a fusing unit 90, a displaying unit 95 constructed of a liquid-crystal panel and serving as means for making notifications to the user etc., and a control unit 100 (which serves as a controller for controlling the image forming apparatus) for controlling these units etc. and managing the operations as a printer.

The photoconductor 20 has a cylindrical conductive base and a photoconductive layer formed on the outer peripheral surface of the conductive base, and it is rotatable about its central axis. In the present embodiment, the photoconductor 20 rotates clockwise, as shown by the arrow in FIG. 1 and FIG. 2.

The charging unit 30 is a device for charging the photoconductor 20. The exposing unit 40 is a device for forming a latent image on the charged photoconductor 20 by radiating laser thereon. The exposing unit 40 has, for example, a semiconductor laser, a polygon mirror, and an F-θ lens, and radiates a modulated laser beam onto the charged photoconductor 20 according to image information having been input from a not-shown computer such as a personal computer or a word processor.

The YMCK developing device 50 has a plurality of attach/detach sections 50*a*, 50*b*, 50*c*, and 50*d* to and from which developing units, which serve as an example of developer containers, can be attached an detached. The YMCK developing device 50 is a device for developing a latent image formed on the photoconductor 20 using toner T, which serves as an example of developer contained in each of the developing units attached to and held by the attach/detach sections.

When the developing units are attached to each of the attach/detach sections 50*a*, 50*b*, 50*c*, and 50*d*, the printer 10 according to the present embodiment can be used as a color printer for forming color images by developing the latent image bore on the photoconductor 20 using the toner T contained in each of the developing units. On the other hand, when a developing unit is attached to only one of the attach/detach sections 50*a*, 50*b*, 50*c*, or 50*d*, then the printer 10 can be used as a monochrome printer for forming monochrome images by developing the latent image bore on the photoconductor 20 using the toner T contained in that developing unit. In conventional printers, it is not possible to form monochrome images if all of developing units, which contain toner of different colors, are not attached to the YMCK developing device such that the printer is always ready to be able to form color images. On the contrary, the printer 10 according to the present embodiment operates as a monochrome printer that is able to form monochrome images on a medium using a black developing unit 51, even in a state where only the black developing unit 51 is attached.

When the printer 10 is used as a color printer, four developing units—a black developing unit 51, a magenta developing unit 52, a cyan developing unit 53, and a yellow developing unit 54—are attached to the attach/detach sections 50*a*, 50*b*, 50*c*, and 50*d* of the YMCK developing device 50, as shown in FIG. 1, and the latent image formed on the photoconductor 20 is developed with the toner T contained in each of the developing units.

The YMCK developing device 50 can move the positions of the four developing units 51, 52, 53, and 54 by rotating. More specifically, the four developing units 51, 52, 53, and 54 can be rotated about a rotating shaft 50*e* while maintaining their relative positions. Every time an image forming process for one page is finished, each of the developing units selectively opposes the photoconductor 20 to successively develop the latent image formed on the photoconductor 20 using the toner T contained in each of the developing units 51, 52, 53, and 54.

On the other hand, when the printer 10 is used as a monochrome printer, a developing unit is attached to only one of the attach/detach sections of the YMCK developing device 50, as shown in FIG. 2, and the latent image formed on the photoconductor 20 is developed by the toner T contained in that developing unit. More specifically, the black developing unit 51 is attached to an attach/detach section 50*a*, among the four attach/detach sections 50*a*, 50*b*, 50*c*, and 50*d*, and when an image is to be formed, the black developing unit 51 is moved by the rotation of the YMCK developing device 50 to a position in opposition to the photoconductor 20. The latent image formed on the photoconductor 20 is then developed with the black toner T contained in the black developing unit 51.

It should be noted that the developing units and the attach/detach sections according to the present embodiment are physically structured such that a developing unit can only be attached to one attach/detach section corresponding to that developing unit. More specifically, among the four attach/detach sections 50*a*, 50*b*, 50*c*, and 50*d*, the black developing unit 51 can only be attached to the attach/detach section 50*a*, the magenta developing unit 52 can only be attached to the attach/detach section 50*b*, the cyan developing unit 53 can only be attached to the attach/detach section 50*c*, and the yellow developing unit 54 can only be attached to the attach/detach section 50*d*.

Further, details on the YMCK developing device 50 and the developing units will be described further below.

The first transferring unit 60 is a device for transferring, onto the intermediate transferring body 70, a toner image formed on the photoconductor 20.

The intermediate transferring body 70 is a laminated endless belt that is made by providing an aluminum layer on the surface of a PET film by vapor deposition, and then further applying semiconducting coating on the outer layer thereof. The intermediate transferring body 70 is driven to rotate at substantially the same circumferential speed as the photoconductor 20.

The second transferring unit 80 is a device for transferring the toner image formed on the intermediate transferring body 70 onto a medium such as paper, film, and cloth.

The fusing unit 90 is a device for fusing the toner image, which has been transferred to the medium, onto the medium to make it into a permanent image.

The cleaning unit 75 is a device that is provided between the first transferring unit 60 and the charging unit 30, that has a rubber cleaning blade 76 made to abut against the surface of the photoconductor 20, and that is for removing the toner T remaining on the photoconductor 20 by scraping it off with the cleaning blade 76 after the toner image has been transferred onto the intermediate transferring body 70 by the first transferring unit 60.

Figure 3:
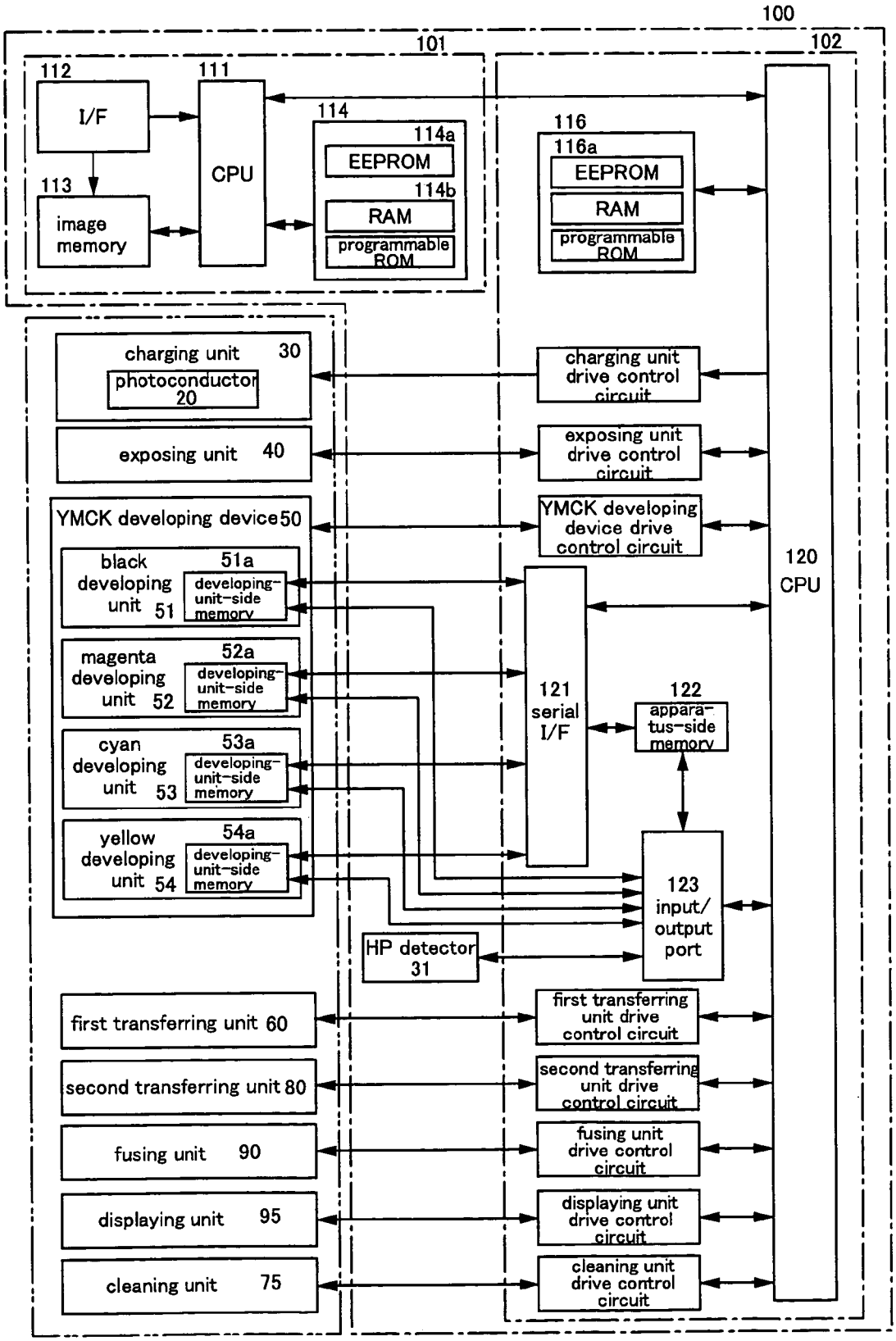
FIG. 3 is a block diagram showing a control unit 100 of the printer 10.

The control unit 100 includes a main controller 101 and a unit controller 102 as shown in FIG. 3. Image signals and control signals are input to the main controller 101, and according to instructions based on these image signals (which are also referred to as "image data PD") and control signals (which are also referred to as "control signals COM"), the unit controller 102 controls each of the above-mentioned units etc. to form an image.

Next, operations of the printer 10 structured as above are described separately for when color images are to be formed and for when monochrome images are to be formed. It should be noted that even when the printer 10 is used as a color printer, the printer 10 is able to form not only color images but also monochrome images. Therefore, the operations described below for when monochrome images are to be formed apply both to the case in which the printer 10 is used as the above-described color printer to form monochrome images, and the case in which the printer 10 is used as a monochrome printer to form monochrome images.

First, the operations of the printer 10 for when color images are to be formed are described below.

When an image signal and control signals are input from the not-shown computer to the main controller 101 of the printer 10 through an interface (I/F) 112, the photoconductor 20, a developing roller which is provided in each developing unit, and the intermediate transferring body 70 rotate under the control of the unit controller 102 based on the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information about the first color, for example, yellow Y, is formed in that area by the exposing unit 40. The YMCK developing device 50 is positioned such that the yellow developing unit 54, which contains yellow (Y) toner, is at the developing position opposing the photoconductor 20.

With the rotation of the photoconductor 20, the latent image formed on the photoconductor 20 reaches the developing position, and is developed with the yellow toner by the yellow developing unit 54. Thus, a yellow toner image is formed on the photoconductor 20.

With the rotation of the photoconductor 20, the yellow toner image formed on the photoconductor 20 reaches a first transferring position, and is transferred onto the intermediate transferring body.70 by the first transferring unit 60. At this time, a first transferring voltage, which is in an opposite polarity to the polarity to which the toner T is charged, is applied to the first transferring unit 60. It should be noted that, during this process, the photoconductor 20 and the intermediate transferring body 70 are placed in contact with each other, and the second transferring unit 80 is kept separated from the intermediate transferring body 70.

By subsequently performing the above-mentioned processes for the second, the third, and the fourth colors for each of the developing units, toner images in four colors corresponding to the respective image signals are transferred to the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a medium by the second transferring unit 80. It should be noted that the medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the medium is heated and pressurized by the fusing unit 90 and fused to the medium.

On the other hand, after the photoconductor 20 passes the first transferring position, the toner T adhering to the surface of the photoconductor 20 is scraped off by the cleaning blade 76 that is supported on the cleaning unit 75, and the photoconductor 20 is prepared for charging for forming the next latent image. The scraped-off toner T is collected into a remaining-toner collector that the cleaning unit 75 comprises.

Next, the operations of the printer 10 for when monochrome images are to be formed are described below.

When an image signal and control signals are input from the not-shown computer to the main controller 101 of the printer 10 through the interface (I/F) 112, the photoconductor 20, the developing roller which is provided in each developing unit, and the intermediate transferring body 70 rotate under the control of the unit controller 102 based on the instructions from the main controller 101. While being rotated, the photoconductor 20 is successively charged by the charging unit 30 at the charging position.

With the rotation of the photoconductor 20, the charged area of the photoconductor 20 reaches the exposing position. A latent image that corresponds to the image information is formed in that area by the exposing unit 40. The YMCK developing device 50 is positioned such that the black developing unit 51, which contains black toner, is at the developing position opposing the photoconductor 20.

With the rotation of the photoconductor 20, the latent image formed on the photoconductor 20 reaches the position where development is possible, and is developed by the black developing unit 51. Thus, a toner image is formed on the photoconductor 20.

With the rotation of the photoconductor 20, the toner image formed on the photoconductor 20 reaches the first transferring position, and is transferred onto the intermediate transferring body 70 by the first transferring unit 60. At this time, a first transferring voltage, which is in an opposite polarity to the polarity to which the toner is charged, is applied to the first transferring unit 60. It should be noted that, during this process, the second transferring unit 80 is kept separated from the intermediate transferring body 70.

With the rotation of the intermediate transferring body 70, the toner image formed on the intermediate transferring body 70 reaches the second transferring position, and is transferred onto a medium by the second transferring unit 80. It should be noted that the medium is carried from the paper supply tray 92 to the second transferring unit 80 via the paper-feed roller 94 and the resisting rollers 96. During transferring operations, a second transferring voltage is applied to the second transferring unit 80 and also the unit 80 is pressed against the intermediate transferring body 70.

The toner image transferred onto the medium is heated and pressurized by the fusing unit 90 and fused to the medium.

On the other hand, after the photoconductor 20 passes the first transferring position, the toner T adhering to the surface of the photoconductor 20 is scraped off by the cleaning blade 76 that is supported on the cleaning unit 75, and the photoconductor 20 is prepared for charging for forming the next latent image. The scraped-off toner T is collected into the remaining-toner collector that the cleaning unit 75 comprises.

Configuration Example of Developing Unit

Figure 4:
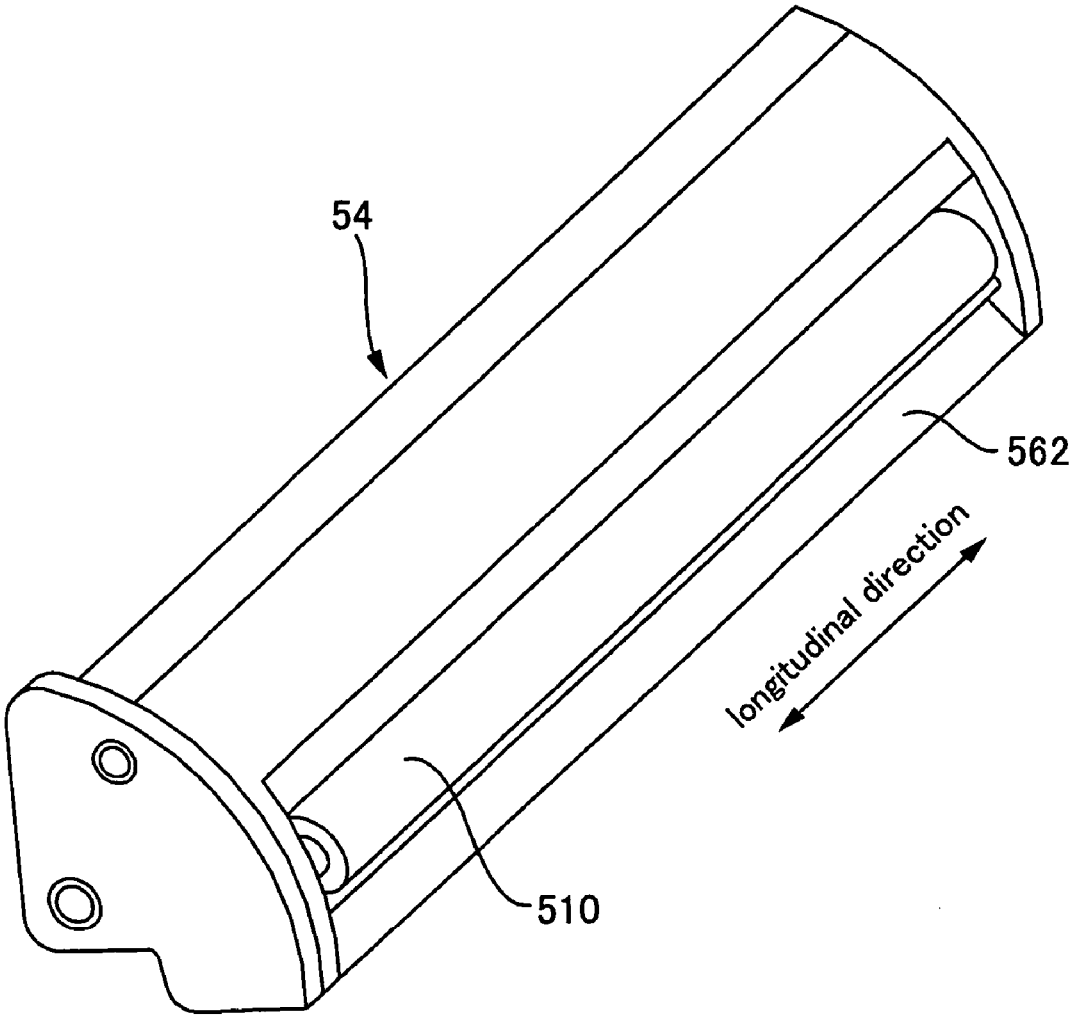
FIG. 4 is a conceptual diagram of a developing unit.
Figure 5:
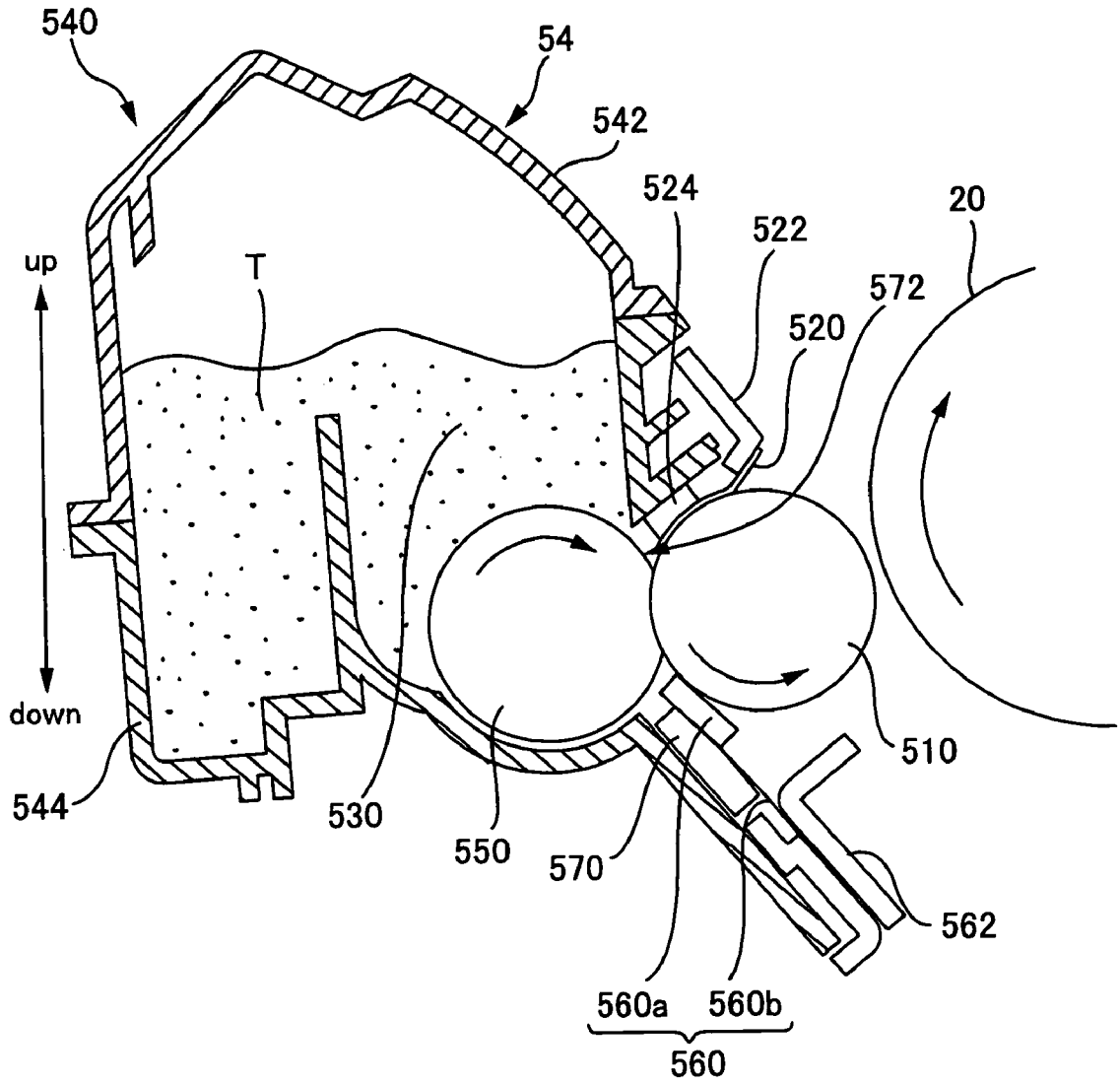
FIG. 5 is a section view showing main structural components of the developing unit.

Next, using FIG. 4 and FIG. 5, an example of a configuration of the developing units will be described. FIG. 4 is a conceptual diagram of a developing unit. FIG. 5 is a section view showing main structural components of the developing unit. Note that the section view shown in FIG. 5 is a cross section of the developing unit bisected by a plane perpendicular to the longitudinal direction shown in FIG. 4. Further, in FIG. 5, the arrow indicates the vertical direction as in FIG. 1, and, for example, the central axis of the developing roller 510 is located below the central axis of the photoconductor 20. Further, in FIG. 5, the yellow developing unit 54 is shown to be in a state in which it is positioned at the developing position opposing the photoconductor 20.

To the YMCK developing device 50, it is possible to attach: the black developing unit 51 containing black (K) toner; the magenta developing unit 52 containing magenta (M) toner; the cyan developing unit 53 containing cyan (C) toner; and the yellow developing unit 54 containing yellow (Y) toner. Since the configuration of each of the developing units is the same, explanation will be made only about the yellow developing unit 54 below.

The yellow developing unit 54 has, for example, the developing roller 510, a sealing member 520, a toner containing section 35, a housing 540, a toner supplying roller 550, and a restriction blade 560.

The developing roller 510 bears toner T and delivers it to the developing position opposing the photoconductor 20. The developing roller 510 is made of metal and manufactured from, for example, aluminum alloy such as aluminum alloy 5056 or aluminum alloy 6063, or iron alloy such as STKM, and the roller 510 is plated with, for example, nickel plating or chromium plating, as necessary.

Further, as shown in FIG. 4, the developing roller 510 is supported at both ends in its longitudinal direction and is rotatable about its central axis. As shown in FIG. 5, the developing roller 510 rotates in the opposite direction (counterclockwise in FIG. 5) to the rotating direction of the photoconductor 20 (clockwise in FIG. 5). The central axis of the roller 510 is located below the central axis of the photoconductor 20. Further, as shown in FIG. 5, in the state where the yellow developing unit 54 opposes the photoconductor 20, there is a gap between the developing roller 510 and the photoconductor 20. That is, the yellow developing unit 54 develops the latent image formed on the photoconductor 20 in a non-contacting state. Note that an alternating field is generated between the developing roller 510 and the photoconductor 20 upon development of the latent image formed on the photoconductor 20.

The sealing member 520 prevents the toner T in the yellow developing unit 54 from spilling out therefrom, and also collects the toner T, which is on the developing roller 510 that has passed the developing position, into the developing unit without scraping it off. The sealing member 520 is a seal made of, for example, polyethylene film. The sealing member 520 is supported by a seal-supporting metal plate 522, and is attached to the housing 540 via the seal-supporting metal plate 522. A seal-urging member 524 made of, for example, Moltoprene is provided on one side of the sealing member 520 opposite to the side of the developing roller 510. The sealing member 520 is pressed against the developing roller 510 by the elastic force of the seal-urging member 524. Note that the abutting position at which the sealing member 520 abuts against the developing roller 510 is situated above the central axis of the developing roller 510.

The housing 540 is manufactured by welding together a plurality of integrally-molded housing sections, that is, an upper housing section 542 and a lower housing section 544. As shown in FIG. 5, the housing 540 has an opening 572 opening toward the outside of the housing 540. The above-mentioned developing roller 510 is arranged from the outside of the housing 540 with its peripheral surface facing the opening 572 in such a state that a part of the roller 510 is exposed to the outside. The restriction blade 560, which is described in detail below, is also arranged from the outside of the housing 540 facing the opening 572.

Further, the housing 540 forms a toner containing section 530 that is capable of containing toner T. The toner containing section 530 may be provided with a stirring member for stirring the toner T. In the present embodiment, however, a stirring member is not provided in the toner containing section 530 because each of the developing units (i.e., the black developing unit 51, the magenta developing unit 52, the cyan developing unit 53, and the yellow developing unit 54) is rotated with the rotation of the YMCK developing device 50 and thereby the toner T in each developing unit is stirred.

The toner supplying roller 550 is provided in the toner containing section 530 described above and supplies the toner T contained in the toner containing section 530 to the developing roller 510. The toner supplying roller 550 is made of, for example, polyurethane foam, and is made to abut against the developing roller 510 in an elastically deformed state. The toner supplying roller 550 is arranged at a lower section of the toner containing section 530. The toner T contained in the toner containing section 530 is supplied to the developing roller 510 by the toner supplying roller 550 at the lower section of the toner containing section 530. The toner supplying roller 550 is rotatable about a central axis. The central axis of the toner supplying roller 550 is situated below the central axis of rotation of the developing roller 510. Further, the toner supplying roller 550 rotates in the opposite direction (clockwise in FIG. 5) to the rotating direction of the developing roller 510 (counter-clockwise in FIG. 5). Note that the toner supplying roller 550 has the function of supplying the toner T contained in the toner containing section 530 to the developing roller 510 as well as the function of stripping off, from the developing roller 510, the toner T remaining on the developing roller 510 after development.

The restriction blade 560 restricts the thickness of the layer of the toner T bore by the developing roller 510 and also gives charge to the toner T bore by the developing roller 510. This restriction blade 560 has a rubber section 560*a* and a rubber-supporting section 560*b*. The rubber section 560*a* is made of, for example, silicone rubber or urethane rubber. The rubber-supporting section 560*b* is a thin plate that is made of, for example, phosphor bronze or stainless steel, and that has a springy characteristic. The rubber section 560*a* is supported by the rubber-supporting section 560*b*. The rubber-supporting section 560*b* is attached to the housing 540 via a pair of blade-supporting metal plates 562 in a state that one end of the rubber-supporting section 560*b* is pinched between and supported by the blade-supporting metal plates 562. Further, a blade-backing member 570 made of, for example, Moltoprene is provided on one side of the restriction blade 560 opposite to the side of the developing roller 510.

The rubber section 560*a* is pressed against the developing roller 510 by the elastic force caused by the flexure of the rubber-supporting section 560*b*. Further, the blade-backing member 570 prevents the toner T from entering in between the rubber-supporting section 560*b* and the housing 540, stabilizes the elastic force caused by the flexure of the rubber-supporting section 560*b*, and also, applies force to the rubber section 560*a* from the back thereof towards the developing roller 510 to press the rubber section 560*a* against the developing roller 510. In this way, the blade-backing member 570 makes the rubber section 560*a* abut against the developing roller 510 evenly.

The end of the restricting blade 560 opposite to the end that is supported by the blade-supporting metal plates 562, i.e., the tip end, is not placed in contact with the developing roller 510; rather, a section at a predetermined distance from the tip end contacts, with some breadth, the developing roller 510. That is, the restriction blade 560 does not abut against the developing roller 510 at its edge, but abuts against the roller 510 near its central portion. Further, the restriction blade 560 is arranged such that its tip end faces towards the upper stream of the rotating direction of the developing roller 510, and thus, makes a so-called counter-abutment with respect to the roller 510. It should be noted that the abutting position at which the restriction blade 560 abuts against the developing roller 510 is below the central axis of the developing roller 510 and is also below the central axis of the toner supplying roller 550.

In the yellow developing unit 54 thus structured, the toner supplying roller 550 supplies the toner T contained in the toner containing section 530 to the developing roller 510. With the rotation of the developing roller 510, the toner T, which has been supplied to the developing roller 510, reaches the abutting position of the restriction blade 560; then, as the toner T passes the abutting position, the toner is electrically charged and its layer thickness is restricted. With further rotation of the developing roller 510, the toner T on the developing roller 510, whose layer thickness has been restricted, reaches the developing position opposing the photoconductor 20; then, under the alternating field, the toner T is used at the developing position for developing the latent image formed on the photoconductor 20. With further rotation of the developing roller 510, the toner T on the developing roller 510, which has passed the developing position, passes the sealing member 520 and is collected into the developing unit by the sealing member 520 without being scraped off. Then, the toner T that still remains on the developing roller 510 can be stripped off by the toner supplying roller 550.

Each developing unit 51, 52, 53, and 54 is also provided with a storage element (which is also referred to below as a "developing-unit-side memory") 51*a*, 52*a*, 53*a*, and 54*a* that is for storing various kinds of information about the developing unit, such as color information about the color of the toner contained in each developing unit and toner consumption amount, and that is, for example, a non-volatile storage memory such as a serial EEPROM.

Developing-unit-side connectors 51*b*, 52*b*, 53*b*, and 54*b*, which are provided on one end surface of the respective developing units, come into connection, as necessary, with an apparatus-side connector 34, which is provided on the apparatus side (i.e., the printer side), and in this way, the developing-unit-side memories 51*a*, 52*a*, 53*a*, and 54*a* are electrically connected to the unit controller 102 of the control unit 100 of the apparatus.

Overview of YMCK Developing Device

Next, an overview of the YMCK developing device 50 will be described using FIG. 6A through FIG. 6C. It should be noted that in the present section, an example is described in which four developing units 51, 52, 53, and 54 are attached to the respective attach/detach sections 50*a*, 50*b*, 50*c*, and 50*d*, for the sake of convenience. The description below, however, is also applicable to cases in which a developing unit is attached to only one of the four attach/detach sections 50*a*, 50*b*, 50*c*, and 50*d*.

The YMCK developing device 50 has a rotating shaft 50*e* positioned at the center. A support frame 55 for holding the developing units is fixed to the rotating shaft 50*e*. The rotating shaft 50*e* is provided extending between two frame side plates (not shown) which form a casing of the printer 10, and both ends of the shaft 50*e* are supported. It should be noted that the axial direction of the rotating shaft 50*e* intersects with the vertical direction.

The support frame 55 is provided with the four attach/detach sections 50*a*, 50*b*, 50*c*, and 50*d*, by which the above-described developing units 51, 52, 53, and 54 of the four colors are held in an attachable/detachable manner about the rotating shaft 50*e*, in the circumferential direction at an interval of 90°.

A pulse motor, which is not shown, is connected to the rotating shaft 50*e* via a clutch. By driving the pulse motor, it is possible to rotate the support frame 55 and position the four developing units 51, 52, 53, and 54 mentioned above at predetermined positions.

Figure 6A:
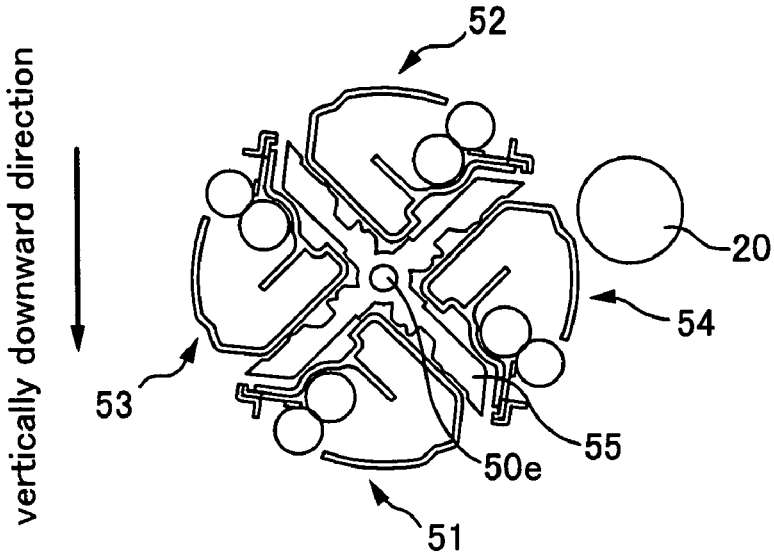
FIG. 6A shows a home position that is the standby position for when the printer is on standby for image formation to be carried out, that is also the halt position, and that serves as a reference position in the rotating direction of a YMCK developing device 50.
Figure 6B:
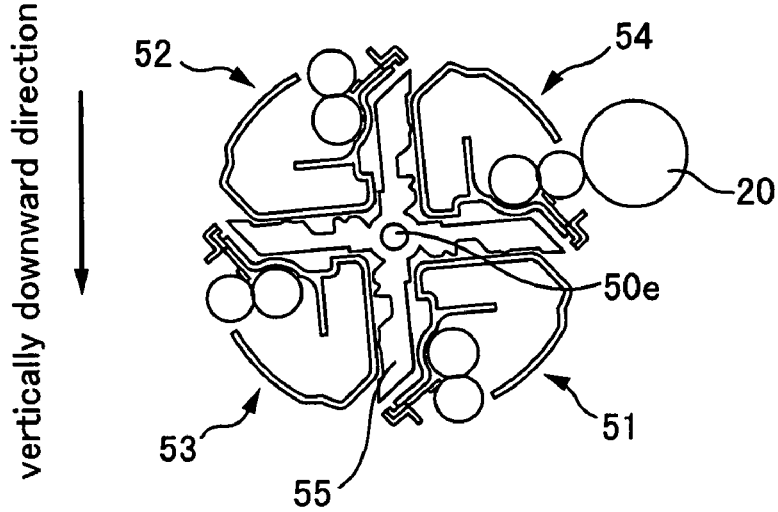
FIG. 6B shows a connector attach/detach position where a developing-unit-side connector 51b of a black developing unit 51, which is attached to the YMCK developing device 50, and an apparatus-side connector 34, which is provided on the apparatus side, come into opposition.
Figure 6C:
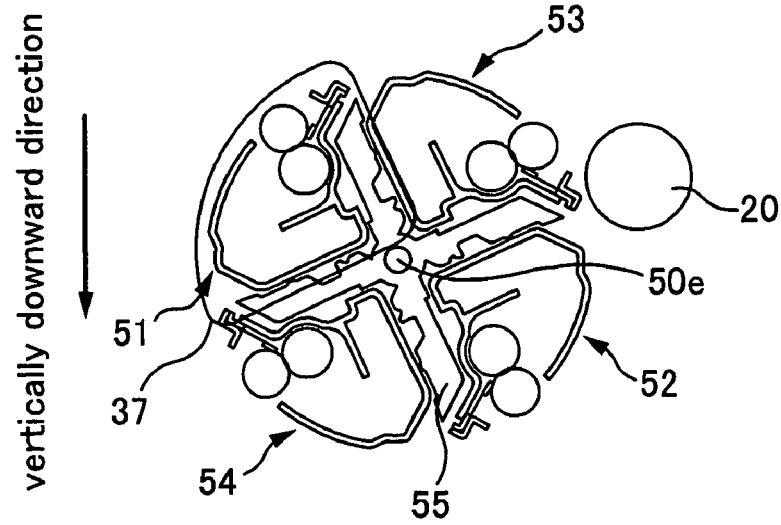
FIG. 6C shows the attach/detach position where the black developing unit 51 is attached and detached.

FIG. 6A through FIG. 6C are diagrams showing three stop positions of the rotating YMCK developing device 50. FIG. 6A shows the home position (referred to as "HP position" below) that is the standby position for when the printer is on standby for image formation to be carried out, that is also the halt position, and that serves as the reference position in the rotating direction of the YMCK developing device 50. FIG. 6B shows the connector attach/detach position where the developing-unit-side connector 51*b* of the black developing unit 51, which is attached to the YMCK developing device 50, and the apparatus-side connector 34, which is provided on the apparatus side, come into opposition. FIG. 6C shows the attach/detach position where the black developing unit 51 is attached and detached.

In FIG. 6B and FIG. 6C, the connector attach/detach position and the developing unit attach/detach position are explained with regard to the black developing unit 51, but these positions become the connector attach/detach position and the developing unit attach/detach position for each of the other developing units when the YMCK developing device 50 is rotated at 90° intervals.

First, the HP position shown in FIG. 6A will be described. An HP detector 31 (FIG. 3) for detecting the HP position is provided on the side of one end of the rotating shaft 50*e* of the YMCK developing device 50. The HP detector 31 is structured of a disk that is for generating signals and that is fixed to one end of the rotating shaft 50*e*, and an HP sensor that is made up of, for example, a photointerrupter having a light emitting section and a light receiving section. The peripheral section of the disk is arranged such that it is located between the light emitting section and the light receiving section of the HP sensor. When a slit formed in the disk moves to a detecting position of the HP sensor, the signal that is output from the HP sensor changes from "L" to "H". The device is constructed such that the HP position of the YMCK developing device 50 is detected based on this change in signal level and the number of pulses of the pulse motor, and by taking this HP position as a reference, each of the developing units can be positioned at the developing position etc.

FIG. 6B shows the connector attach/detach position of the black developing unit 51 which is achieved by rotating the pulse motor for a predetermined number of pulses from the above-mentioned HP position. At this connector attach/detach position, the developing-unit-side connector 51*b* of the black developing unit 51, which is attached to the YMCK developing device 50, and the apparatus-side connector 34, which is provided on the apparatus side, come into opposition, and it becomes possible to connect or separate these connecters.

Figure 7A:
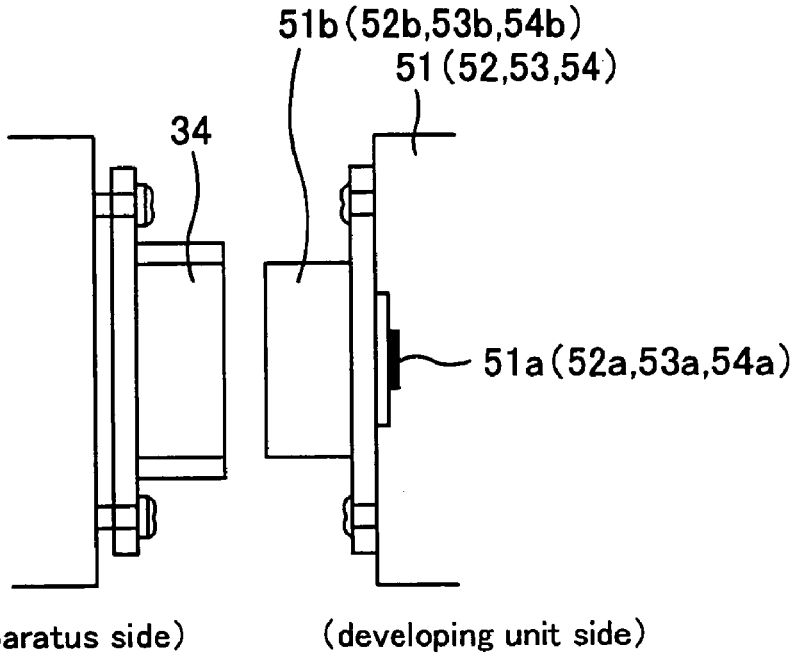
FIG. 7A is a diagram showing a separated position where the apparatus-side connector 34 and the developing-unit-side connector 51*b* of the black developing unit 51 are separated from each other.
Figure 7B:
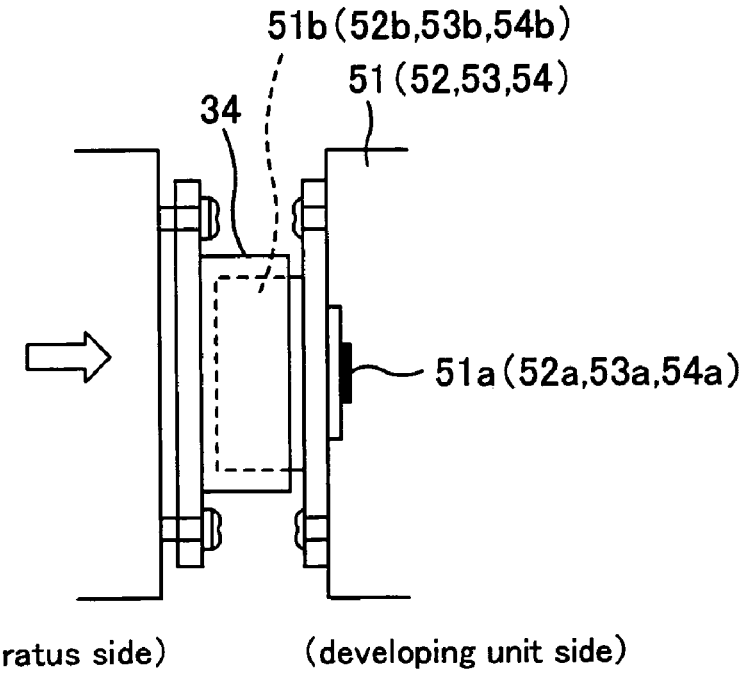
FIG. 7B is a diagram showing an abutting position where the apparatus-side connector 34 and the developing-unit-side connector 51*b* of the black developing unit 51 are in abutment against each other.

Further explanation is given using FIG. 7A and FIG. 7B. FIG. 7A is a diagram showing a separated position where the apparatus-side connector 34 and the developing-unit-side connector 51*b* of the black developing unit 51 are separated from each other. FIG. 7B is a diagram showing an abutting position where the apparatus-side connector 34 and the developing-unit-side connector 51*b* of the black developing unit 51 are in abutment against each other.

FIG. 7A shows a state in which the apparatus-side connector 34 and the developing-unit-side connector 51*b* of the black developing unit 51 are separated from each other. The apparatus-side connector 34 is structured such that it can move close to, and move away from, the black developing unit 51. When necessary, the apparatus-side connector 34 moves in the direction towards the black developing unit 51 (the direction of the arrow shown in FIG. 7B). In this way, the apparatus-side connector 34 abuts against the developing-unit-side connector 51*b* of the black developing unit 51 as shown in FIG. 7B. Thus, the developing-unit-side memory 51*a* attached to the black developing unit 51 is electrically connected to the unit controller 102 of the control unit 100, and communication between the developing-unit-side memory 51 and the apparatus is established.

On the contrary, the apparatus-side connector 34 moves, from the state shown in FIG. 7B in which the apparatus-side connector 34 and the developing-unit-side connector 51*b* of the black developing unit 51 abut against each other, in the direction moving away from the black developing unit 51 (the direction opposite to the direction of the arrow shown in FIG. 7B). In this way, the apparatus-side connector 34 is separated from the developing-unit-side connector 51*b* of the black developing unit 51, as shown in FIG. 7A.

It should be noted that the movement of the apparatus-side connector 34 is achieved by, for example, a not-shown mechanism structured of a pulse motor, a plurality of gears connected to the pulse motor, and an eccentric cam connected to the gears. More specifically, by rotating the pulse motor for a predetermined number of pulses, the above-mentioned mechanism moves the apparatus-side connector 34 from the predetermined separated position for a distance that corresponds to the above-mentioned number of pulses to position the apparatus-side connector 34 at the predetermined abutting position. On the contrary, by rotating the pulse motor backwards for a predetermined number of pulses, the above-mentioned mechanism moves the apparatus-side connector 34 from the predetermined abutting position for a distance that corresponds to the above-mentioned number of pulses to position the apparatus-side connector 34 at the predetermined separated position.

Further, the connector attach/detach position for the black developing unit 51 becomes the developing position for the yellow developing unit 54 where the developing roller 510 of the yellow developing unit 54 and the photoconductor 20 oppose each other. That is, the connector attach/detach position of the YMCK developing device 50 for the black developing unit 51 is the developing position of the YMCK developing device 50 for the yellow developing unit 54. Further, the position achieved when the pulse motor rotates the YMCK developing device 50 counterclockwise by 90° becomes the connector attach/detach position for the cyan developing unit 53 and the developing position for the black developing unit 51, and by rotating the YMCK developing device 50 at 90° intervals, the connector attach/detach position and the developing position for each of the developing units are successively achieved.

One of the two frame side plates that support the YMCK developing device 50 and that form the casing of the printer 10 is provided with an attach/detach dedicated opening 37 through which one developing unit can pass. The attach/detach dedicated opening 37 is formed at a position where only a relevant developing unit (here, the black developing unit 51) can be pulled out and be detached in the direction of the rotating shaft 50*e,* as shown in FIG. 6C, when the YMCK developing device 50 is rotated and then halted at a developing unit attach/detach position which is set for each developing unit. Further, the attach/detach dedicated opening 37 is formed slightly larger than the outer shape of a developing unit. At the developing unit attach/detach position, not only is it possible to detach the developing unit, but it is also possible to insert a new developing unit through this attach/detach dedicated opening 37 in the direction of the rotating shaft 50*e* and attach the developing unit to the support frame 55. While the YMCK developing device 50 is positioned at positions other than the developing unit attach/detach position, the attachment/detachment of that developing unit is restricted by the frame side plates.

It should be noted that a lock mechanism, which is not shown, is provided for certainly positioning and fixing the YMCK developing device 50 at the positions described above.

Overview of Control Unit

Next, with reference to FIG. 3, the configuration of the control unit 100 will be described. The control unit 100 includes a main controller 101 and a unit controller 102.

The main controller 101 includes a CPU 111, an interface 112 for establishing connection with a not-shown computer, an image memory 113, for storing image signals that have been input from the computer, and a main-controller-side memory 114 that is made up of, for example, an electrically rewritable EEPROM 114*a,* a RAM 114*b,* and a programmable ROM in which various programs for control are written.

The CPU 111 of the main controller 101 manages control of writing and reading of image data, which have been input via the interface, to and from the image memory 113, as well as manages overall control of the apparatus in synchronism with the CPU 120 of the unit controller 102 according to control signals that have been input from the computer.

Further, the EEPROM 114*a* stores apparatus-type information indicative of whether the printer 10 is to be used as a color printer or as a monochrome printer. The CPU 111 receives, from the unit controller 102 at predetermined timings, developing-unit attachment information which indicates where, among the four attach/detach sections, the developing units are currently attached. Based on the attachment information, the CPU 111 rewrites the apparatus-type information in the EEPROM 114*a,* if necessary. It should be noted that the apparatus-type information is 1-bit information that is written in the EEPROM 114*a;* value "0" indicates that the printer 10 is to be used as a color printer, and value "1" indicates that the printer 10 is to be used as a monochrome printer. When power is supplied to the printer 10, the main controller 101 detects this and loads the apparatus-type information from the EEPROM 114*a* to the RAM 114*b.* It should be noted that the apparatus-type information in the EEPROM 114*a* is stored even when power is not being supplied to the printer 10.

The EEPROM 114*a* also stores information about the remaining amount of toner in the developing units of each color, information about the number of sheets printed, and so forth. The information about the remaining amount of toner in the developing units of each color and the information about the number of sheets printed are updated in accordance with the usage of the printer 10.

The unit controller 102 includes, for example, a CPU 120, a unit-controller-side memory 116 that is made up of, for example, an electrically rewritable EEPROM 116*a,* a RAM, and a programmable ROM in which various programs for control are written, and various drive control circuits for driving and controlling the units in the apparatus body (i.e., the charging unit 30, the exposing unit 40, the first transferring unit 60, the cleaning unit 75, the second transferring unit 80, the fusing unit 90, and the displaying unit 95) and the YMCK developing device 50.

The CPU 120 of the unit controller 102 is electrically connected to each of the drive control circuits and controls the drive control circuits according to control signals from the CPU 111 of the main controller 101. More specifically, the CPU 120 controls each of the units and the YMCK developing device 50 according to signals received from the main controller 101 while detecting the state of each of the units and the YMCK developing device 50 by receiving signals from sensors provided in each unit.

The CPU 120 also controls each of the drive control circuits according to the apparatus-type information described above. More specifically, if the value of the apparatus-type information is "0", then the CPU 120 controls the units and the YMCK developing device 50 of the printer 10 to function as a color printer, and if the value of the apparatus-type information is "1", then the CPU 120 controls the units and the YMCK developing device 50 of the printer 10 to function as a monochrome printer.

The EEPROM 116*a* stores the developing-unit attachment information which indicates where, among the four attach/detach sections, the developing units are currently attached. After detachment and attachment of a developing unit, the CPU 120 determines whether the developing unit has been attached to the corresponding attach/detach section, and according to the determination results, it rewrites the attachment information in the EEPROM 116*a,* if necessary. It should be noted that the attachment information is written in the EEPROM 116*a* as 4-bit information, i.e., 1-bit information for each attach/detach section; value "0" indicates that no developing unit is attached, and value "1" indicates that a developing unit is attached.

Further, the CPU 120 of the unit controller 102 is connected, via a serial interface (I/F) 121, to a non-volatile storage element 122 (which is referred to below as "apparatus-side memory") which is, for example, a serial EEPROM. Data necessary for controlling the apparatus are stored in the apparatus-side memory 122. The CPU 120 is not only connected to the apparatus-side memory 122, but is also connected to the developing-unit-side memories 51*a*, 52*a*, 53*a*, and 54*a*, which are provided on the respective developing units 51, 52, 53, and 54, via the serial interface 121. Therefore, data can be exchanged between the apparatus-side memory 122 and the developing-unit-side memories 51*a*, 52*a*, 53*a*, and 54*a*, and also, it is possible to input chip-select signals CS to the developing-unit-side memories 51*a*, 52*a*, 53*a*, and 54*a* via the input/output port 123. The CPU 120 is also connected to the HP detector 31 via the input/output port 123.

Information Displayed on the Displaying Section

About the Configuration of the Displaying Section

Next, information displayed on the displaying unit 95, which is an example of the "displaying section", is described for when the printer 10 is used as a monochrome printer and for when the printer 10 is used as a color printer.

Figure 8:
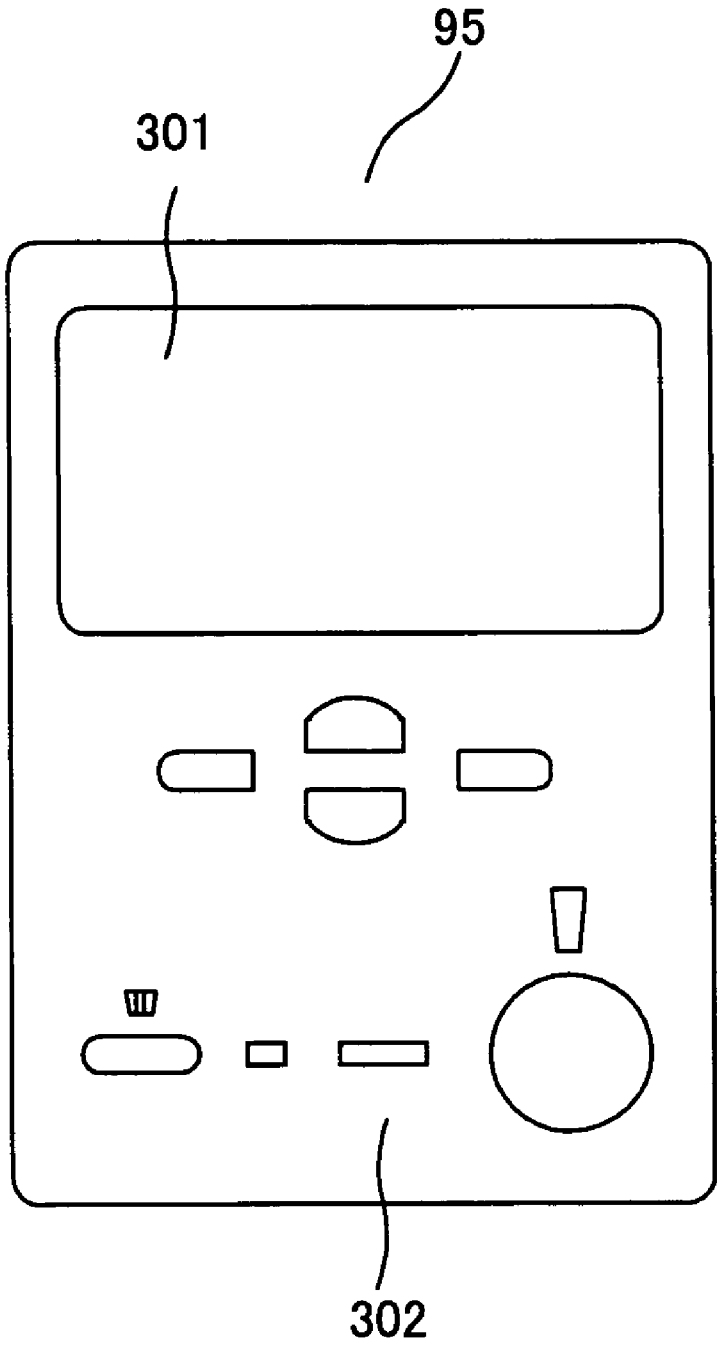
FIG. 8 is a diagram showing an example of a displaying unit 95.

First, a configuration of the displaying unit 95 is described with reference to the drawings. FIG. 8 is a diagram showing an example of the displaying unit 95. As shown in FIG. 8, the displaying unit 95 includes, for example, a display panel 301 and operation buttons 302, which are an example of an "operating section". The display panel 301 is for displaying information thereon. The operation buttons 302 are for selecting, and determining, the information displayed on the display panel.

Next, information displayed on the display panel 301 of the displaying unit 95 is described for when the printer 10 is used as a monochrome printer and for when the printer 10 is used as a color printer. FIG. 9A shows a table that indicates information displayed on the display panel 301 of the displaying unit 95 for when the printer 10 is used as a monochrome printer. FIG. 9B shows a table that indicates information displayed on the display panel 301 of the displaying unit 95 for when the printer 10 is used as a color printer. It should be noted that the information shown in the tables of FIG. 9A and FIG. 9B is only an example. Further, the information shown in the tables of FIG. 9A and FIG. 9B is stored in the memory 114 of the main controller of the control unit 100.

The table of FIG. 9A shows information such as "total number of sheets printed", "remaining amount of black toner", "photoconductor life", and "apparatus-type name". On the other hand, the table of FIG. 9B shows information such as "total number of sheets printed", "number of sheets printed in color", "number of sheets printed in monochrome", "remaining amount of cyan toner", "remaining amount of magenta toner", "remaining amount of yellow toner", "photoconductor life", and "apparatus-type name". As appreciated by comparing FIG. 9A and FIG. 9B, as regards the information that can be displayed on the display panel 301 of the displaying unit 95 for when the printer 10 is used as a color printer, it can be noted that information specific to a color printer has been added to the information that can be displayed on the display panel 301 of the displaying unit 95 for when the printer 10 is used as a monochrome printer. The "information specific to a color printer" is, for example, information about the remaining amount of color toner such as the "remaining amount of cyan toner", the "remaining amount of magenta toner", and the "remaining amount of yellow toner", and information about the number of sheets of media on which color images have been formed such as the "number of sheets printed in color".

Next, a flow from when a user operates the operation buttons 302 up to when the information shown in the tables of FIG. 9A and FIG. 9B is displayed on the display panel 301 of the displaying unit 95 is described, taking the "apparatus-type name" and the "number of sheets printed" as examples.

First, the flow for the "apparatus-type name" is described. In order to get hold of information about the "apparatus-type name", among the information shown in the tables of FIG. 9A and FIG. 9B, the user operates the operation buttons 302. When the control unit 100 recognizes that the user has operated the operation buttons 302 to get hold of the "apparatus-type name", it displays the information about the "apparatus-type name", which corresponds to either the color printer or the monochrome printer, on the display panel 301 according to whether the printer 10 is being used as a color printer or whether it is being used as a monochrome printer. At this time, the control unit 100 obtains the information about the "apparatus-type name", which corresponds to either the color printer or the monochrome printer, stored in the RAM 114*a* of the memory 114 in the main controller, and displays the obtained "apparatus-type name" information on the display panel 301 of the displaying unit 95.

Next, the flow for the "number of sheets printed" is described. In order to get hold of information about the "number of sheets printed", among the information shown in the tables of FIG. 9A and FIG. 9B, the user operates the operation buttons 302. When the control unit 100 recognizes that the user has operated the operation buttons 302 to get hold of the "number of sheets printed", it displays the information about the "number of sheets printed", which corresponds to either the color printer or the monochrome printer, on the display panel 301 according to whether the printer 10 is being used as a color printer or whether it is being used as a monochrome printer. At this time, the control unit 100 obtains the information about the "number of sheets printed", which corresponds to either the color printer or the monochrome printer, stored in the EEPROM 114*b* of the memory 114 in the main controller, and displays the obtained "number of sheets printed" information on the display panel 301 of the displaying unit 95.

As described above, the information that is displayed on the display panel 301 through operation of the operation buttons 302 by the user when the printer 10 is being used as a color printer is different from (i.e., is not the same as) the information that is displayed on the display panel 301 through operation of the operation buttons 302 by the user when the printer 10 is being used as a monochrome printer.

Next, description will be made on how the information described above is displayed on the display panel 301 of the displaying unit 95 through operation of the operation buttons 302 by the user. It should be noted that in the description below, only information that is displayed on the displaying unit 95 and that is different between the case where the printer 10 is used as a color printer and the case where the printer 10 is used as a monochrome printer will be explained, and explanation of information that is the same for both cases is omitted.

Figure 10A:
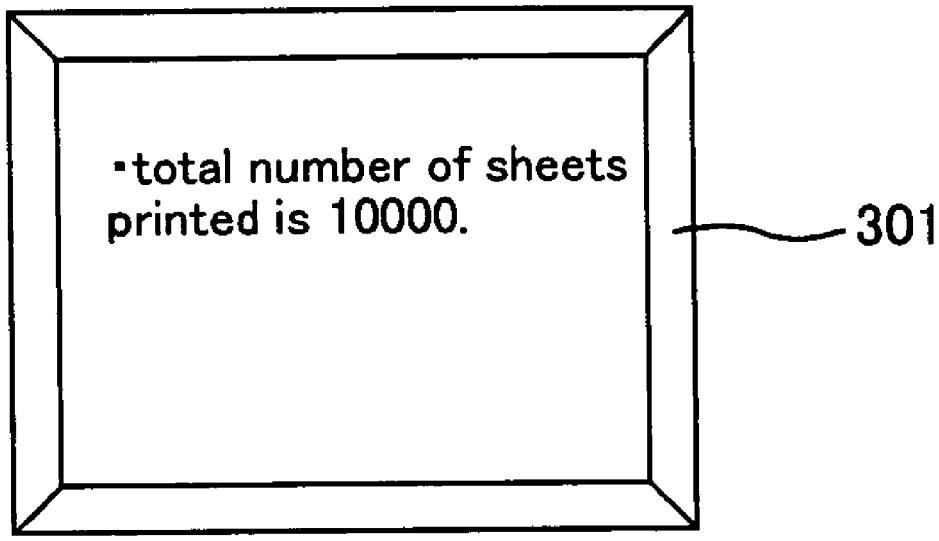
FIG. 10A is a diagram showing how information about the number of sheets printed is displayed on a display panel when the printer 10 is used as a monochrome printer.
Figure 10B:
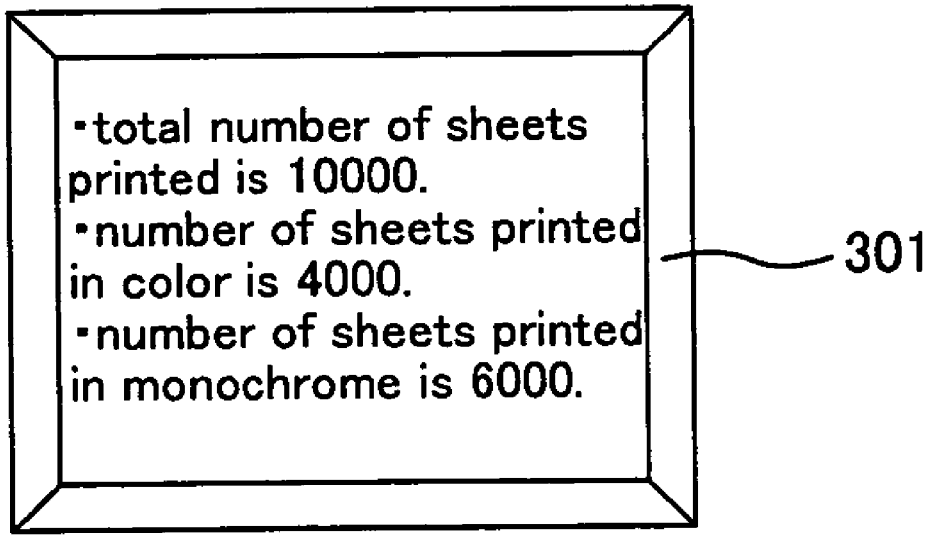
FIG. 10B is a diagram showing how information about the number of sheets printed is displayed on the display panel when the printer 10 is used as a color printer.

First, displaying of information about the number of sheets printed is described. FIG. 10A is a diagram showing how the information about the number of sheets printed is displayed on the display panel 301 when the printer 10 is used as a monochrome printer. FIG. 10B is a diagram showing how the information about the number of sheets printed is displayed on the display panel 301 when the printer 10 is used as a color printer.

As shown in FIG. 10A, when the printer 10 is used as a monochrome printer, information about the "total number of sheets printed" is displayed on the display panel 301. On the other hand, when the printer 10 is used as a color printer, information about the "total number of sheets printed", the "number of sheets printed in color", and the "number of sheets printed in monochrome", is displayed on the display panel 301, as shown in FIG. 10B. In this way, as regards the number of sheets printed, the information that is displayed on the display panel 301 of the displaying unit 95 is different (i.e., is not the same) for when the printer 10 is used as a monochrome printer and for when the printer 10 is used as a color printer. Further, as regards the information that is displayed on the display panel 301 when the printer 10 is used as a color printer, the "number of sheets printed in color" and the "number of sheets printed in monochrome", which are information specific to a color printer, have been added to the "total number of sheets printed" information that is displayed on the display panel 301 when the printer 10 is used as a monochrome printer.

In this way, information about the number of sheets of color images that have been printed is displayed on the display panel 301 when the printer 10 is used as a color printer, but is not displayed on the display panel 301 when the printer 10 is used as a monochrome printer. Therefore, it becomes possible to display, on the displaying section, the information about the number of sheets of color images that have been printed, only when necessary.

Figure 11A:
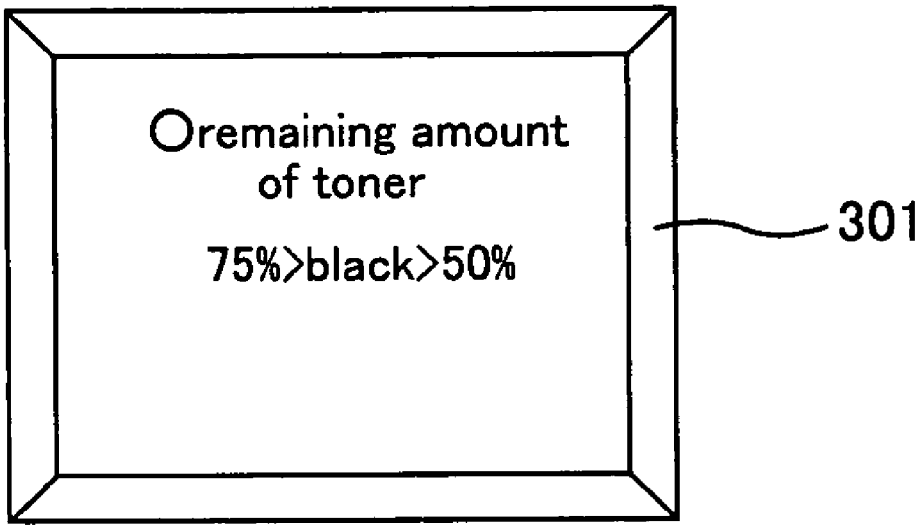
FIG. 11A is a diagram showing how information about the remaining amount of toner is displayed on the display panel when the printer 10 is used as a monochrome printer.
Figure 11B:
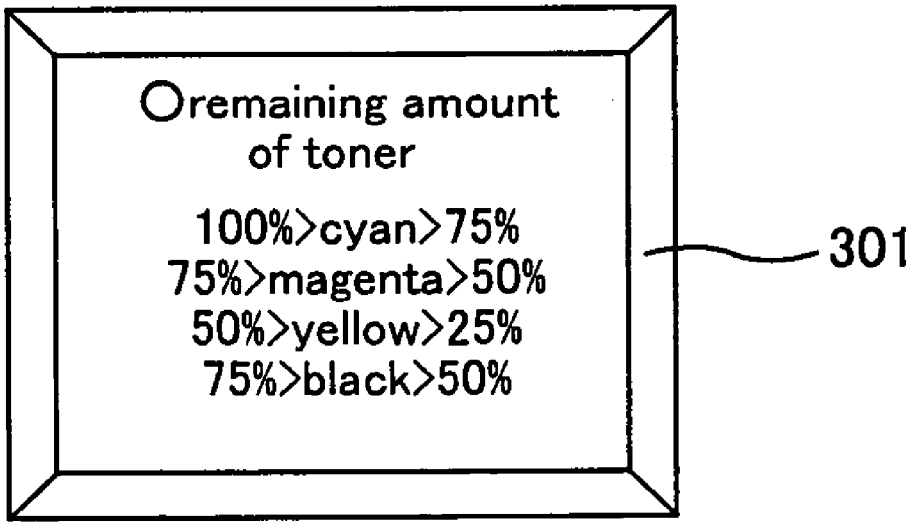
FIG. 11B is a diagram showing how information about the remaining amount of toner is displayed on the display panel when the printer 10 is used as a color printer.

Next, displaying of information about the remaining amount of toner is described. FIG. 11A is a diagram showing how the information about the remaining amount of toner is displayed on the display panel 301 when the printer 10 is used as a monochrome printer. FIG. 11B is a diagram showing how the information about the remaining amount of toner is displayed on the display panel 301 when the printer 10 is used as a color printer.

As shown in FIG. 11A, when the printer 10 is used as a monochrome printer, information about the "remaining amount of black toner" is displayed. On the other hand, when the printer 10 is used as a color printer, information about the "remaining amount of cyan toner", the "remaining amount of magenta toner", the "remaining amount of yellow toner", and the "remaining amount of black toner" is displayed, as shown in FIG. 11B. In this way, as regards the remaining amount of toner, the information that is displayed on the display panel 301 of the displaying unit 95 is different (i.e., is not the same) for when the printer 10 is used as a monochrome printer and for when the printer 10 is used as a color printer. Further, as regards the information that is displayed on the display panel 301 when the printer 10 is used as a color printer, the "remaining amount of cyan toner", the "remaining amount of magenta toner", and the "remaining amount of yellow toner", which are information specific to a color printer, have been added to the "remaining amount of black toner" information that is displayed on the display panel 301 when the printer 10 is used as a monochrome printer.

In this way, information about the remaining amount of color toner is displayed on the display panel 301 when the printer 10 is used as a color printer, but is not displayed on the display panel 301 when the printer 10 is used as a monochrome printer. Therefore, it becomes possible to display, on the displaying section, the information about the remaining amount of color toner, only when necessary.

Figure 12A:
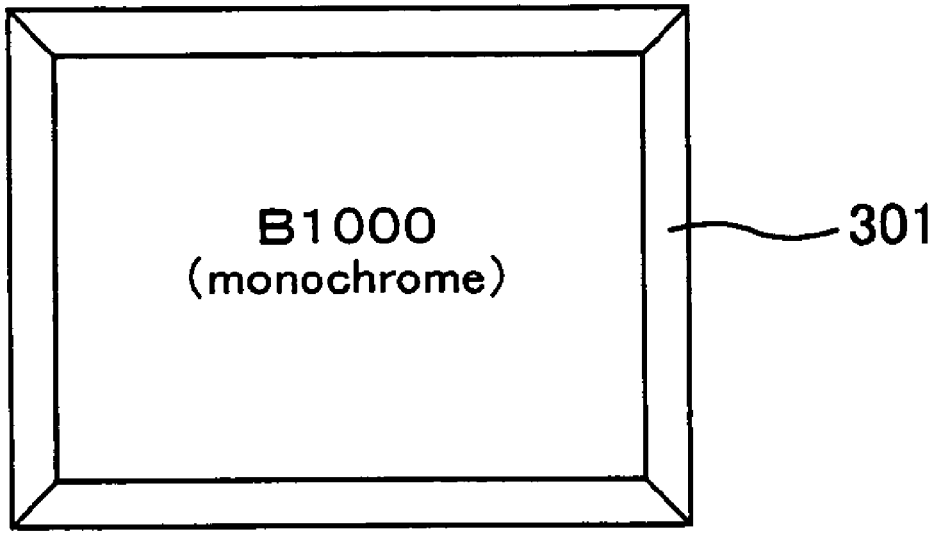
FIG. 12A is a diagram showing how information about the apparatus-type name is displayed on the display panel when the printer 10 is used as a monochrome printer.
Figure 12B:
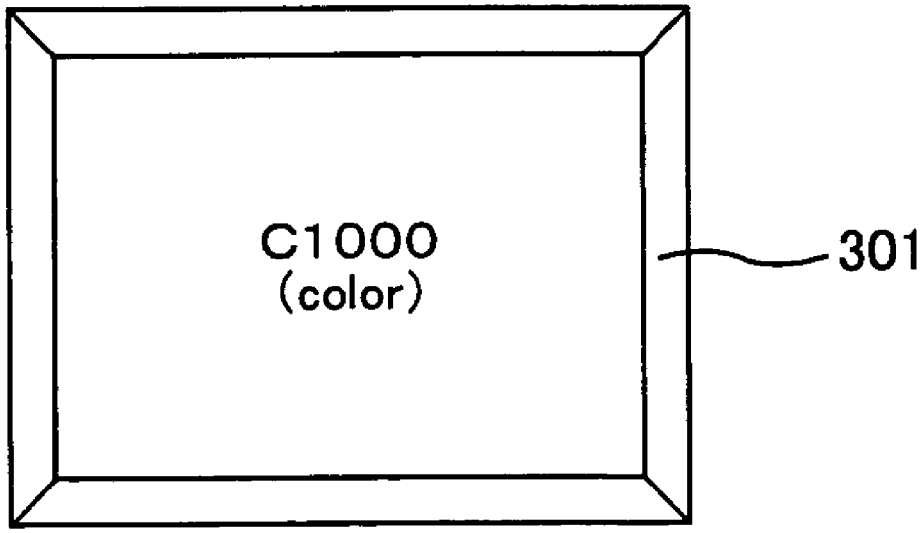
FIG. 12B is a diagram showing how information about the apparatus-type name is displayed on the display panel when the printer 10 is used as a color printer.

Next, displaying of information about the apparatus-type name of the printer 10 is described. FIG. 12A is a diagram showing how the information about the apparatus-type name is displayed on the display panel when the printer 10 is used as a monochrome printer. FIG. 12B is a diagram showing how the information about the apparatus-type name is displayed on the display panel when the printer 10 is used as a color printer. When the printer 10 is used as a monochrome printer, the apparatus-type name of the monochrome printer is displayed, like "B1000" shown in FIG. 12A. On the other hand, when the printer 10 is used as a color printer, the apparatus-type name of the color printer is displayed, like "C1000" shown in FIG. 12B. In this way, as regards the apparatus-type name of the printer 10, the information that is displayed on the display panel 301 of the displaying unit 95 is different (i.e., is not the same) for when the printer 10 is used as a monochrome printer and for when the printer 10 is used as a color printer.

In this way, the apparatus-type name that is displayed on the display panel 301 when the printer 10 is used as a color printer is different from (i.e., is not the same as) the apparatus-type name that is displayed on the display panel 301 when the printer 10 is used as a monochrome printer. Therefore, the user can easily acknowledge whether the printer 10 is being used as a color printer or as a monochrome printer.

It should be noted that, although the description above gives an example in which the information about the number of sheets printed, the information about the remaining amount of toner, and the information about the apparatus-type name of the printer 10 are displayed separately on the display panel 301, it is also possible to display the information about the number of sheets printed, the information about the remaining amount of toner, and the information about the apparatus-type name of the printer 10 all at once. Further, in the foregoing embodiment, the information displayed on the display panel is displayed as characters, but this is not a limitation. For example, the information that is displayed on the display panel 301 may be displayed as symbols or figures. Any displaying method can be adopted as long as the user can visually identify the information that is displayed on the display panel 301.

As described above, the information that is displayed on the displaying unit when the printer is used as a color printer is different from (i.e., is not the same as) the information that is displayed on the displaying unit when the printer is used as a monochrome printer. Therefore, it becomes possible to display, on the displaying unit, information that suits either the color printer or the monochrome printer respectively for when the printer is being used as a color printer and for when the printer is being used as a monochrome printer.

Other Considerations

In the foregoing, an image forming apparatus etc. according to the present invention was described according to the above-described embodiment thereof. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

About the Image Forming Apparatus

In the foregoing embodiment, an intermediate transferring type full-color laser beam printer was described as an example of the image forming apparatus, but the present invention is also applicable to various other types of image forming apparatuses, such as full-color laser beam printers that are not of the intermediate transferring type, monochrome laser beam printers, copying machines, and facsimiles.

Further, in the foregoing embodiment, an image forming apparatus provided with a rotary-type developing device was described as an example. This, however, is not a limitation, and the present invention is applicable to, for example, image forming apparatuses provided with tandem-type developing devices.

About the Image Bearing Body

Further, in the foregoing embodiment, the photoconductor, which served as an image bearing body, was described having a structure in which a photoconductive layer was provided on the outer peripheral surface of a cylindrical, conductive base, but this is not a limitation. The photoconductor can be a so-called photoconductive belt structured by providing a photoconductive layer on a surface of a belt-like conductive base, for example.

About the Single-color Image Forming Apparatus

Further, in the foregoing embodiment, the single-color printer was a monochrome printer that forms monochrome images, when a developing unit is attached to only one of the plurality of attach/detach sections, by developing the latent image bore on the photoconductor with the toner contained in the developing unit, but this is not a limitation. More specifically, in the foregoing embodiment, the developing unit attached to the one attach/detach section was a black developing unit, and monochrome images were formed by developing the latent image with the toner contained in the black developing unit, but this is not a limitation. The developing unit attached to the one attach/detach section may be a developing unit having toner of another color, and images in that color may be formed by developing the latent image with the toner contained in that developing unit.

About the Information Displayed on the Displaying Section

Further, in the foregoing embodiment, the information that is displayed on the displaying unit when the printer is used as the color printer was information wherein information specific to the color printer has been added to the information that is displayed on the displaying unit when the printer is used as the monochrome printer. This, however, is not a limitation. For example, the information that is displayed on the displaying unit when the printer is used as the color printer does not have to include information specific to a color printer.

Further, in the foregoing embodiment, the information specific to the color printer included information about a number of sheets of media on which color images have been formed and information about a remaining amount of developer in the developer container that contains color developer. This, however, is not a limitation. For example, the information specific to the color printer may include either one of the information about the number of sheets of media on which color images have been formed or the information about the remaining amount of developer in the developer container that contains color developer. Further, the information specific to the color printer does not have to include neither the information about the number of sheets of media on which color images have been formed nor the information about the remaining amount of developer in the developer container that contains color developer. Further, the information specific to the color printer may include information about exchanging of developer containers that contain color developer.

Further, in the foregoing embodiment, the printer-type name that is displayed on the displaying unit when the printer is used as the color printer was different from the printer-type name that is displayed on the displaying unit when the printer is used as the monochrome printer. This, however, is not a limitation. For example, the printer-type name that is displayed on the displaying unit when the printer is used as the color printer may be the same as the printer-type name that is displayed on the displaying unit when the printer is used as the monochrome printer. Further, the printer-type name does not have to be displayed on the displaying unit both when the printer is used as a color printer or when it is used as the monochrome printer.

Further, in the foregoing embodiment, the information that can be displayed on the displaying unit by operating the operating buttons when the printer is used as the color printer was different from the information that can be displayed on the displaying unit by operating the operating buttons when the printer is used as the monochrome printer. This, however, is not a limitation. For example, the information that can be displayed on the displaying unit by operating the operating section when the printer is used as the color printer may be the same as the information that can be displayed on the displaying unit by operating the operating section when the printer is used as the monochrome printer. Further, the information that is displayed on the displaying unit when power is supplied to the printer for when the printer is being used as a color printer may be made to be different from the information that is displayed on the displaying unit when power is supplied to the printer for when the printer is being used as a monochrome printer. With such a printer, the user can easily recognize whether the printer is being used as a color printer or as a monochrome printer when power is supplied to the printer.

SECOND EMBODIMENT

A second embodiment of the present invention is described below. It should be noted that the configuration of the image forming apparatus (the printer 10), including the developing units, the YMCK developing device 50, and the control unit 100, is substantially the same as that of the first embodiment. Therefore, detailed description thereof is omitted.

Procedure of Switching Modes of the Image Forming Apparatus

As described above, when the developing units are attached to each of the attach/detach sections 50*a*, 50*b*, 50*c*, and 50*d*, the printer 10 according to the present embodiment can be used as a color printer for forming color images by developing the latent image bore on the photoconductor 20 using the toner T contained in each of the developing units, whereas when a developing unit is attached to only one of the attach/detach sections 50*a*, 50*b*, 50*c*, or 50*d*, then the printer 10 can be used as a monochrome printer for forming monochrome images by developing the latent image bore on the photoconductor 20 using the toner T contained in that developing unit.

Below, an example of a procedure for switching the printer 10 from a monochrome printer to a color printer and an example of a procedure for switching the printer 10 from a color printer to a monochrome printer will be described.

Switching from Monochrome Printer to Color Printer

Figure 13:
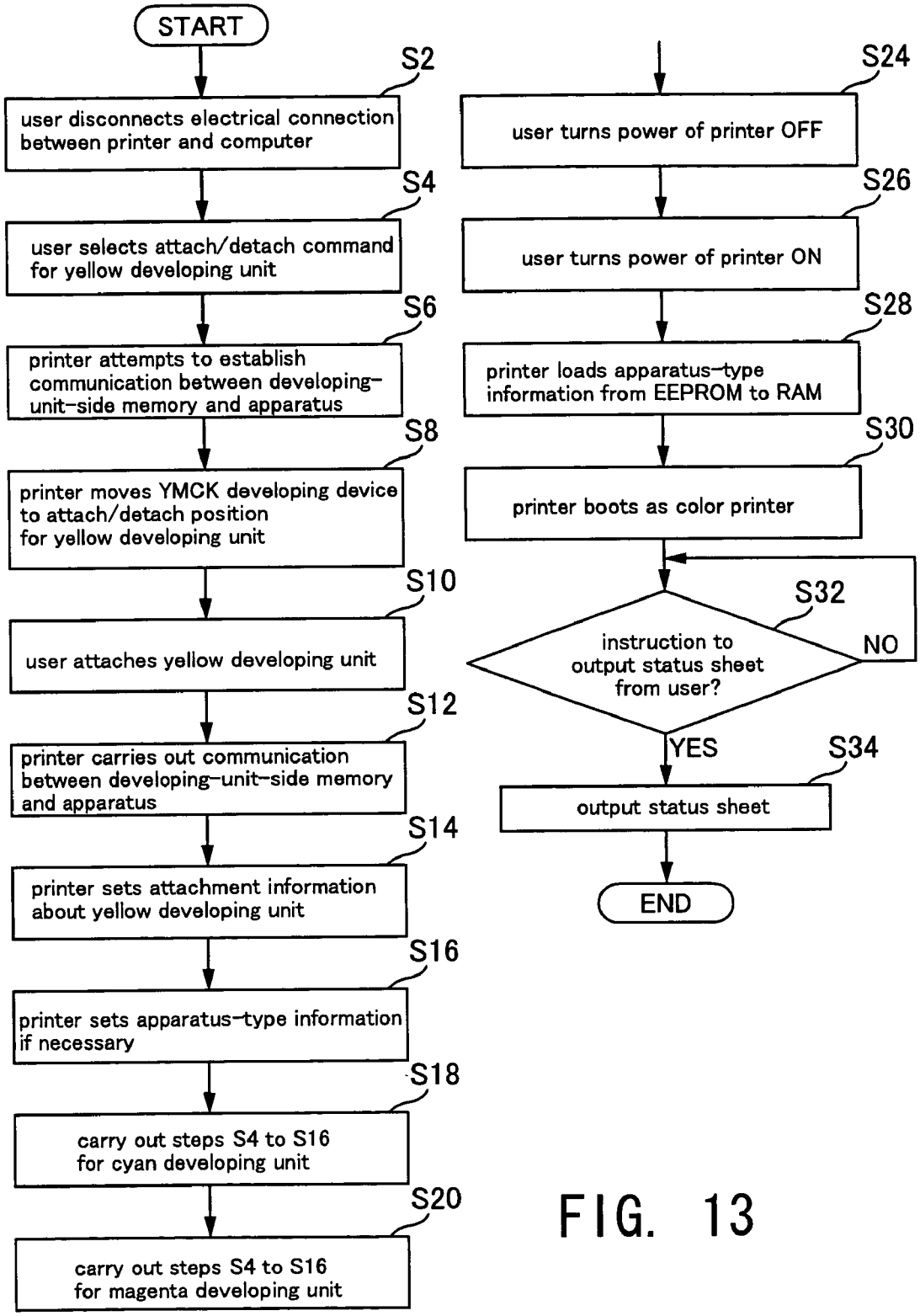
FIG. 13 is a flowchart for illustrating a procedure for switching the printer 10 from a monochrome printer to a color printer.

First, a procedure for switching the printer 10 from a monochrome printer to a color printer will be described using FIG. 13. FIG. 13 is a flowchart for illustrating the procedure for switching the printer 10 from a monochrome printer to a color printer. The various operations of the printer 10 described below are mainly achieved by the main controller 101 or the unit controller 102 in the printer 10. Particularly, in the present embodiment, the operations are achieved by the CPU executing programs that are stored in the programmable ROM. The programs are made of codes for achieving the various operations described below.

This flowchart starts from a state in which the power of the printer 10 has already been turned ON and the printer 10 is on standby for image formation to be carried out. The standby position of the YMCK developing device 50 at this time is the HP position shown in FIG. 6A.

Further, the printer 10, before switching is performed, is used as a monochrome printer, and therefore, the developing unit is attached to only one of the four attach/detach sections, as shown in FIG. 2. That is, the black developing unit 51 is attached to the attach/detach section 50*a*, but no developing unit is attached to the other attach/detach sections 50*b*, 50*c*, and 50*d*.

First, if the printer 10 is electrically connected to a computer, then the user disconnects the electrical connection by turning the power of the computer OFF, disconnecting the cable that connects the printer 10 and the computer, and so forth (step S2.)

Then, the user operates a menu button provided, for example, on the displaying unit 95, and by selecting the attach/detach command for a certain developing unit, the user gives an instruction to the printer 10 that he/she wishes to attach or detach a developing unit. At the time of giving this instruction, the user designates the developing unit that is targeted for attachment/detachment.

In the present embodiment, the user first selects the attach/detach command for the yellow developing unit 54 (step S4). The unit controller 102 comprehends this command with the displaying unit drive control circuit. More specifically, the unit controller 102 determines which, among the black developing unit 51, the magenta developing unit 52, the cyan developing unit 53, and the yellow developing unit 54, is the developing unit targeted for attachment/detachment. In the present embodiment, the developing unit targeted for attachment/detachment is the yellow developing unit 54. Therefore, the unit controller 102 rotates the pulse motor for a predetermined number of pulses to rotate the YMCK developing device 50 and to move the position of the YMCK developing device 50 from the HP position to the connector attach/detach position for the yellow developing unit 54.

Then, the unit controller 102 halts the YMCK developing device 50 at the connector attach/detach position. In this halted state, the unit controller 102 moves the apparatus-side connector 34 and attempts to establish communication with the developing-unit-side memory of the developing unit (step S6). In the present embodiment, the yellow developing unit 54 has not been attached yet, and therefore, communication cannot be established.

Next, the unit controller 102 rotates the pulse motor for a predetermined number of pulses to rotate the YMCK developing device 50 and to move the position of the YMCK developing device 50 from the connector attach/detach position for the yellow developing unit 54 to the attach/detach position for the yellow developing unit 54 (step S8).

In this state, the unit controller 102 notifies the user that the yellow developing unit 54 can be attached to (or detached from) the attach/detach section by displaying a message on a displaying section etc. provided in the displaying unit 95.

Confirming the display, the user opens the outer cover of the printer 10 and attaches the yellow developing unit 54 to the attach/detach section 50*d* of the YMCK developing device 50 through the attach/detach dedicated opening 37 (step S10). After the user attaches the yellow developing unit 54 and closes the outer cover of the printer 10, the unit controller 102 detects this and moves the position of the YMCK developing device 50 from the attach/detach position for the yellow developing unit 54 to the connector attach/detach position for the yellow developing unit 54.

Then, the unit controller 102 halts the YMCK developing device 50 at the connector attach/detach position. In this halted state, the unit controller 102 moves the apparatus-side connector 34 and makes the apparatus-side connector 34 and the developing-unit-side connector 54*b* of the yellow developing unit 54 abut against each other. In this state, the developing-unit-side memory 54*a* of the yellow developing unit 54 is electrically connected to the unit controller 102 of the control unit 100, and communication is established between the developing-unit-side memory 54*a* and the apparatus body (step S12). The unit controller 102 also determines whether the communication has succeeded. If the communication has succeeded, then the unit controller 102 assumes that the yellow developing unit 54 has been attached, and sets the attachment information for the yellow developing unit 54 in the EEPROM 116*a* to "1". On the other hand, if it is determined that the communication has failed, then the unit controller 102 assumes that the yellow developing unit 54 has not been attached, and sets the attachment information for the yellow developing unit 54 in the EEPROM 116*a* to "0" (step S14). In the present embodiment, it is assumed that the communication has succeeded, and the attachment information for the yellow developing unit 54 in the EEPROM 116*a* is changed from "0" to "1".

After finishing the above-described processes relating to the attachment information, the unit controller 102 sends the attachment information for all four developing units to the main controller 101. The main controller 101 receives the attachment information and sets the above-described apparatus-type information based on the attachment information (step S16).

An algorithm according to which the main controller 101 sets the apparatus-type information based on the attachment information of the four developing units is described below. If the value of only one of the four pieces of attachment information is "1", which indicates that a developing unit is attached, then the main controller 101 sets the value of the apparatus-type information in the EEPROM 114*a* to "1", which indicates that the printer is to be used as a monochrome printer. On the other hand, if the value of two or more pieces of attachment information is "1", then the main controller 101 sets the value of the apparatus-type information to "0", which indicates that the printer is to be used as a color printer. In both cases, however, if the value of the attachment information for the black developing unit 51 is "0", then the main controller 101 does not execute the operation of setting the apparatus-type information. (That is, if the black developing unit 51, which should be attached regardless of whether the printer is to be used as a color printer or as a monochrome printer, is not attached, the apparatus-type information is not rewritten and the value of the apparatus-type information is kept the same.) The relationship between the values of the attachment information and the operations of setting the apparatus-type information is as shown in FIG. 14.

In the present embodiment, the values of the attachment information of the developing units are "1" for the black developing unit, "0" for the magenta developing unit, "0" for the cyan developing unit, and "1" for the yellow developing unit (i.e., the values match case "J" of FIG. 14). Therefore, the main controller 101 rewrites the value of the apparatus-type information from "1", which indicates "monochrome printer", to "0", which indicates "color printer".

Next, the processes from step S4 through step S16 described above are carried out for the cyan developing unit 53 and the magenta developing unit 52 (step S18 and step S20). As a result of carrying out these processes, the values of the attachment information for the cyan developing unit 53 and the magenta developing unit 52 are rewritten from "0" to "1". It should be noted that in step S18, the values of the attachment information of the developing units received by the main controller 101 are "1" for the black developing unit, "0" for the magenta developing unit, "1" for the cyan developing unit, and "1" for the yellow developing unit (i.e., the values match case "L" of FIG. 14). Therefore, the value of the apparatus-type information after step S18 stays at "0". Similarly, in step S20, the values of the attachment information of the developing units received by the main controller 101 are "1" for the black developing unit, "1" for the magenta developing unit, "1" for the cyan developing unit, and "1" for the yellow developing unit (i.e., the values match case "Q" of FIG. 14). Therefore, the value of the apparatus-type information after step S20 stays at "0".

Next, the user temporarily halts power supply to the printer by turning the power of the printer 10 OFF, for example (step S24). The user then supplies power to the printer again by turning the power of the printer 10 ON, for example (step S26).

When power is supplied to the printer 10, the main controller 101 detects this and loads the apparatus-type information from the EEPROM 114*a* to the RAM 114*b* (step S28). Here, the value "0", which indicates "color printer", is loaded to the RAM 114*b*. The CPU 120 of the unit controller 102 then controls the drive control circuits based on the apparatus-type information that has been loaded to the RAM 114*b*. More specifically, as a result of referencing the apparatus-type information in the RAM 114*b*, the printer 10 boots as a color printer, and the units and the YMCK developing device 50 of the printer 10 are controlled to function as a color printer (step S30).

Figure 15:
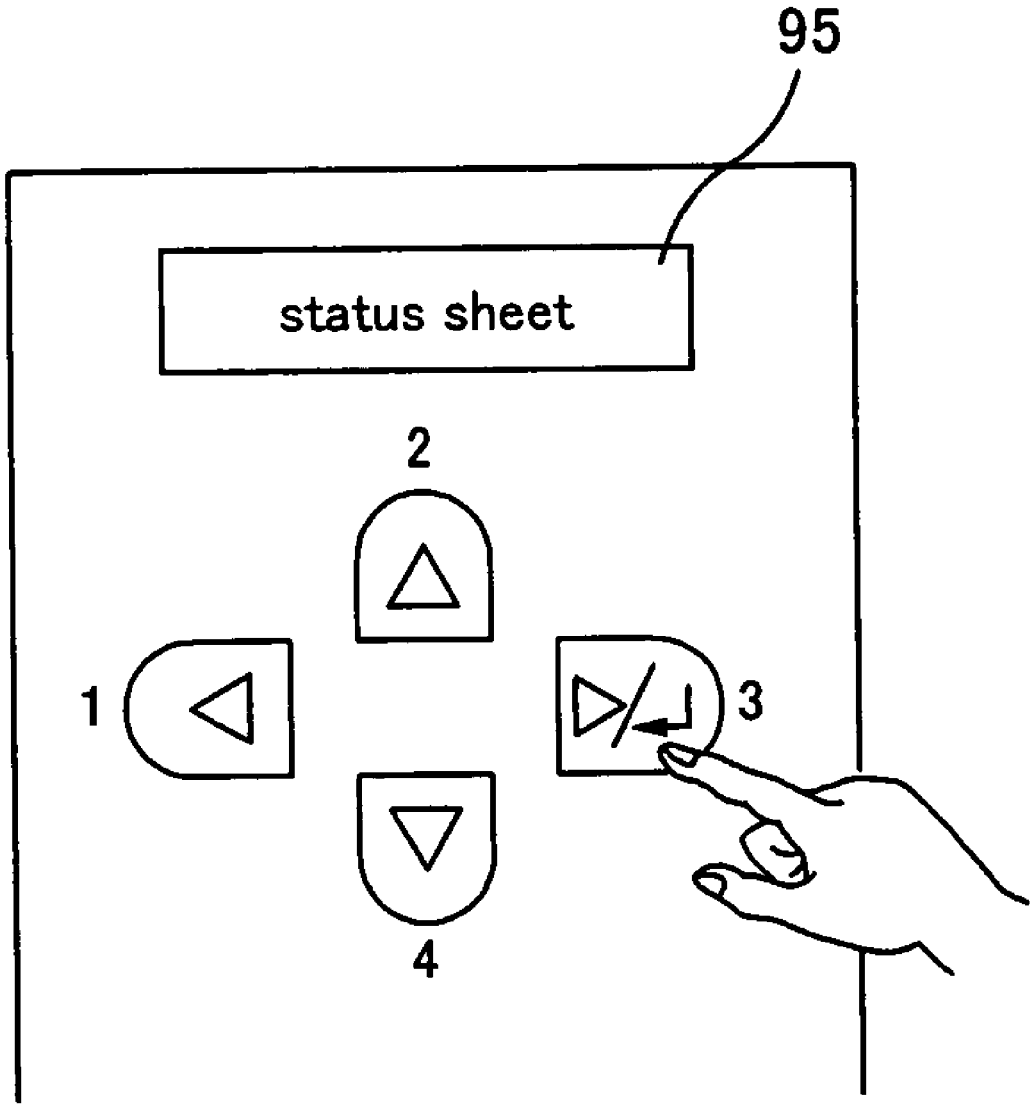
FIG. 15 shows a displaying unit 95.

After confirming that a message, such as "printable", is displayed on the displaying unit 95 of the printer 10, the user carries out a predetermined operation using operation buttons of the displaying unit 95 shown in FIG. 15. (For example, the user presses the button on the right twice.) Then, a message, "status sheet", will be displayed on the displaying unit 95. When the user again carries out a predetermined operation using the operation buttons of the displaying unit 95 (for example, when the user presses the button on the right once), an instruction is input to the printer 10 to print a status sheet, as apparatus information that indicates whether the printer 10 is usable as a monochrome printer or as a color printer (if YES at step S32).

Then, the printer 10 outputs a status sheet (step S34). Below, the status sheet is described with reference to FIG. 16. As shown in FIG. 16, on the status sheet are printed, for example, the printer-type name, printer information, the print format, and the printer settings. In the example of the status sheet shown in FIG. 16, "LP-9000A" is printed as the printer-type name, and as regards the printer information, the remaining amount of black toner for when the printer is used as a color printer and the remaining amount of cyan toner, magenta toner, and yellow toner, which is information specific to a color printer, are printed using indicators.

With this printer 10, information that would be printed when the printer 10 is used as a monochrome printer can be as well printed even when the printer 10 is used as a color printer, and also, it is possible to print information specific to a color printer.

As described above, switching of the printer 10 from a monochrome printer to a color printer is executed when: the state of the printer 10 changes from a state where a developing unit is attached only to the attach/detach section 50*a* to a state where developing units are attached to at least two of the four attach/detach sections by attaching developing units to attach/detach sections other than the attach/detach section 50*a* while power is being supplied to the printer 10; and the power supply to the printer 10 is once stopped and then started again.

In other words, the apparatus-type information will not be loaded from the EEPROM 114*a* to the RAM 114*b* only by changing the state of the printer 10 from a state where a developing unit is attached only to the attach/detach section 50*a* to a state where developing units are attached to at least two of the four attach/detach sections. Therefore, in this case, the value of the apparatus-type information in the RAM 114*b* remains the same as that before the change in state (i.e., the value remains at "1" indicative of "monochrome printer"), and the printer 10 will not switch from the monochrome printer to the color printer. The apparatus-type information is loaded to the RAM 114*b* only after power is supplied again to the printer 10 at step S26, and in this case, the printer 10 references the apparatus-type information in the RAM 114*b* and boots as a color printer.

It should be noted that in the present embodiment, it is possible to attach developing units to attach/detach sections other than the attach/detach section 50*a*, in order to change the state of the printer 10 from a state where a developing unit is attached only to the attach/detach section 50*a* to a state where developing units are attached to at least two attach/detach sections, only when power is being supplied to the printer 10.

Switching from Color Printer to Monochrome Printer

Figure 17:
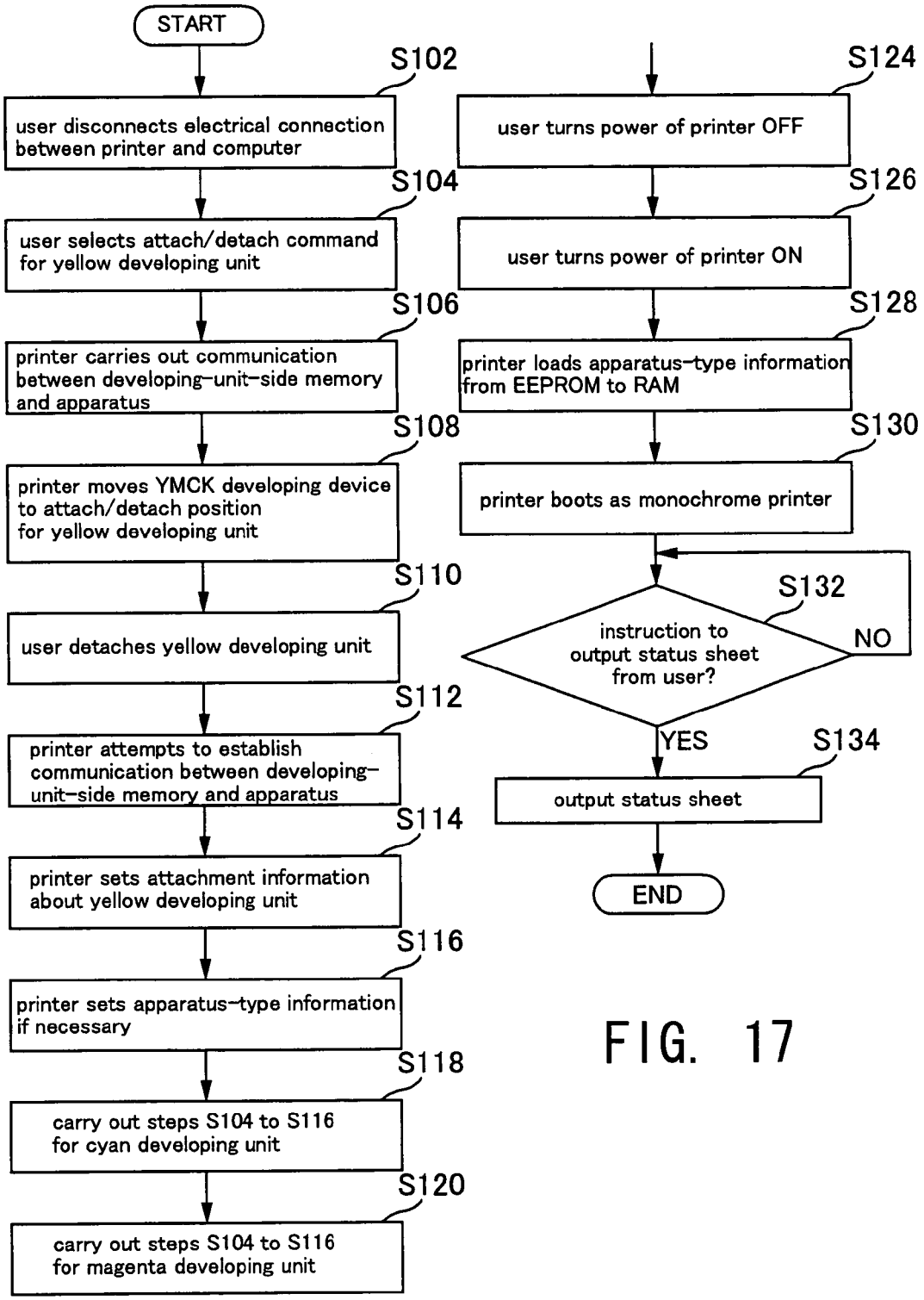
FIG. 17 is a flowchart for illustrating a procedure for switching the printer 10 from a color printer to a monochrome printer.

Next, a procedure for switching the printer 10 from a color printer to a monochrome printer will be described using FIG. 17. FIG. 17 is a flowchart for illustrating the procedure for switching the printer 10 from a color printer to a monochrome printer. The various operations of the printer 10 described below are mainly achieved by the main controller 101 or the unit controller 102 in the printer 10. Particularly, in the present embodiment, the operations are achieved by the CPU executing programs that are stored in the programmable ROM. The programs are made of codes for achieving the various operations described below.

This flowchart starts from a state in which the power of the printer 10 has already been turned ON and the printer 10 is on standby for image formation to be carried out. The standby position of the YMCK developing device 50 at this time is the HP position shown in FIG. 6A.

Further, the printer 10, before switching is performed, is used as a color printer, and therefore, the developing units are attached to all four attach/detach sections, as shown in FIG. 1. That is, the black developing unit 51 is attached to the attach/detach section 50*a*, the magenta developing unit 52 is attached to the attach/detach section 50*b*, the cyan developing unit 53 is attached to the attach/detach section 50*c*, and the yellow developing unit 54 is attached to the attach/detach section 50*d*.

First, if the printer 10 is electrically connected to a computer, then the user disconnects the electrical connection by turning the power of the computer OFF, disconnecting the cable that connects the printer 10 and the computer, and so forth (step S102.)

Then, the user operates a menu button provided, for example, on the displaying unit 95, and by selecting the attach/detach command for a certain developing unit, the user gives an instruction to the printer 10 that he/she wishes to attach or detach a developing unit. At the time of giving this instruction, the user designates the developing unit that is targeted for attachment/detachment.

In the present embodiment, the user first selects the attach/detach command for the yellow developing unit 54 (step S104). The unit controller 102 comprehends this command with the displaying unit drive control circuit. More specifically, the unit controller 102 determines which, among the black developing unit 51, the magenta developing unit 52, the cyan developing unit 53, and the yellow developing unit 54, is the developing unit targeted for attachment/detachment. In the present embodiment, the developing unit targeted for attachment/detachment is the yellow developing unit 54. Therefore, the unit controller 102 rotates the pulse motor for a predetermined number of pulses to rotate the YMCK developing device 50 and to move the position of the YMCK developing device 50 from the HP position to the connector attach/detach position for the yellow developing unit 54.

Then, the unit controller 102 halts the YMCK developing device 50 at the connector attach/detach position. In this halted state, the unit controller 102 moves the apparatus-side connector 34 and makes the apparatus-side connector 34 and the developing-unit-side connector 54*b* of the yellow developing unit 54 abut against each other. In this state, the developing-unit-side memory 54*a* of the yellow developing unit 54 is electrically connected to the unit controller 102 of the control unit 100, and communication is established between the developing-unit-side memory 54*a* and the apparatus body (step S106).

After finishing the communication and separating the apparatus-side connector 34 from the developing-unit-side connector 54*b*, the unit controller 102 rotates the pulse motor for a predetermined number of pulses to rotate the YMCK developing device 50 and to move the position of the YMCK developing device 50 from the connector attach/detach position for the yellow developing unit 54 to the attach/detach position for the yellow developing unit 54 (step S108).

In this state, the unit controller 102 notifies the user that the yellow developing unit 54 can be detached from (or attached to) the attach/detach section by displaying a message on the displaying section etc. provided in the displaying unit 95.

Confirming the display, the user opens the outer cover of the printer 10 and detaches the yellow developing unit 54, which is arranged inside the attach/detach dedicated opening 37, from the YMCK developing device 50 through the attach/detach dedicated opening 37 (step S110). After the user detaches the yellow developing unit 54 and closes the outer cover of the printer 10, the unit controller 102 detects this and moves the position of the YMCK developing device 50 from the attach/detach position for the yellow developing unit 54 to the connector attach/detach position for the yellow developing unit 54.

Then, the unit controller 102 halts the YMCK developing device 50 at the connector attach/detach position. In this halted state, the unit controller 102 moves the apparatus-side connector 34 and attempts to establish communication with the developing-unit-side memory of the developing unit (step S112). If communication succeeds, then the unit controller 102 assumes that the yellow developing unit 54 is attached, and sets the attachment information for the yellow developing unit 54 in the EEPROM 116*a* to "1". On the other hand, if communication fails, then the unit controller 102 assumes that the yellow developing unit 54 is not attached, and sets the attachment information for the yellow developing unit 54 in the EEPROM 116*a* to "0" (step S114). In the present embodiment, since the yellow developing unit 54 has been detached at step S110, it is assumed that the communication has failed, and the attachment information for the yellow developing unit 54 in the EEPROM 116*a* is changed from "1" to "0".

After finishing the above-described processes relating to the attachment information, the unit controller 102 sends the attachment information for all four developing units to the main controller 101. The main controller 101 receives the attachment information and sets the above-described apparatus-type information based on the attachment information (step S116).

In the present embodiment, the value of the attachment information only for the yellow developing unit 54 is "0" (and this situation matches case "P" of FIG. 14). Therefore, the main controller 101 sets the value of the apparatus-type information to "0", which indicates "color printer", in accordance with the algorithm described above. In this example, however, the value of the apparatus-type information is not changed because before detachment of the yellow developing unit 54, all four developing units were attached and the value of the apparatus-type information was "0" (the situation for case "Q" of FIG. 14).

Next, the processes from step S104 through step S116 described above are carried out for the cyan developing unit 53 and the magenta developing unit 52 (step S118 and step S120). As a result of carrying out these processes, the values of the attachment information for the cyan developing unit 53 and the magenta developing unit 52 are rewritten from "1" to "0". The values of the attachment information of the developing units received by the main controller 101 become "1" for the black developing unit, "0" for the magenta developing unit, "0" for the cyan developing unit, and "0" for the yellow developing unit (i.e., the values match case "I" of FIG. 14). Therefore, the main controller 101 changes the value of the apparatus-type information from "0", which indicates "color printer", to "1", which indicates "monochrome printer", in accordance with the algorithm described above.

Next, the user temporarily halts power supply to the printer by turning the power of the printer 10 OFF, for example (step S124). The user then supplies power to the printer again by turning the power of the printer 10 ON, for example (step S126).

When power is supplied to the printer 10, the main controller 101 detects this and loads the apparatus-type information from the EEPROM 114*a* to the RAM 114*b* (step S128). Here, the value "1", which indicates "monochrome printer", is loaded to the RAM 114*b*. The CPU 120 of the unit controller 102 then controls the drive control circuits based on the apparatus-type information that has been loaded to the RAM 114*b*. More specifically, as a result of referencing the apparatus-type information in the RAM 114*b*, the printer 10 boots as a monochrome printer, and the units and the YMCK developing device 50 of the printer 10 are controlled to function as a monochrome printer (step S130).

After confirming that a message, such as "printable", is displayed on the displaying unit 95 of the printer 10, the user carries out a predetermined operation using operation buttons of the displaying unit 95 shown in FIG. 15. (For example, the user presses the button on the right twice.) Then, a message, "status sheet", will be displayed on the displaying unit 95. When the user again carries out a predetermined operation using the operation buttons of the displaying unit 95 (for example, when the user presses the button on the right once), an instruction is input to the printer 10 to print a status sheet, as apparatus information that indicates whether the printer 10 is usable as a monochrome printer or as a color printer (if YES at step S132).

Then, the printer 10 outputs a status sheet (step S134). Below, the status sheet that is output when the printer is switched from a color printer to a monochrome printer is described with reference to FIG. 18. As shown in FIG. 18, on the status sheet are printed, for example, the printer-type name, printer information, the print format, and the printer settings. In the example of the status sheet shown in FIG. 18, "LP-9000B" is printed as the printer-type name, and as regards the printer information, the remaining amount of black toner for when the printer is used as a monochrome printer is printed using indicators.

In this way, the information printed on the status sheet that is output when the printer is switched from a monochrome printer to a color printer as shown in FIG. 16 and the information printed on the status sheet that is output when the printer is switched from a color printer to a monochrome printer as shown in FIG. 18 are different from each other (i.e., are not the same). Therefore, it is possible to print suitable printing information on the status sheet in accordance with printing information for when printing is carried out in either the monochrome printer state or the color printer state.

"Printing of suitable printing information on the status sheet" means, for example, that information about the remaining amount of black toner for when the printer is used as a color printer as well as information about the remaining amount of cyan toner, magenta toner, and yellow toner, which is information specific to a color printer, are printed as information regarding the remaining amount of developer in the printer information printed on the status sheet that is output when the printer is switched from a monochrome printer to a color printer, whereas only information about the remaining amount of black toner for when the printer is used as a monochrome printer, and not the remaining amount of cyan toner, magenta toner, and yellow toner which are not used, is printed as information regarding the remaining amount of developer in the printer information printed on the status sheet that is output when the printer is switched from a color printer to a monochrome printer.

As described above, switching of the printer 10 from a color printer to a monochrome printer is executed when: the state of the printer 10 changes from a state where developing units are attached to at least two of the four attach/detach sections to a state where a developing unit is attached only to the attach/detach section 50*a* by detaching developing units from attach/detach sections other than the attach/detach section 50*a* while power is being supplied to the printer 10; and the power supply to the printer 10 is once stopped and then started again.

In other words, the apparatus-type information will not be loaded from the EEPROM 114*a* to the RAM 114*b* only by changing the state of the printer 10 from a state where developing units are attached to at least two of the four attach/detach sections to a state where a developing unit is attached only to the attach/detach section 50*a*. Therefore, in this case, the value of the apparatus-type information in the RAM 114*b* remains the same as that before the change in state (i.e., the value remains at "0" indicative of "color printer"), and the printer 10 will not switch from the color printer to the monochrome printer. The apparatus-type information is loaded to the RAM 114*b* only after power is supplied again to the printer 10 at step S126, and in this case, the printer 10 references the apparatus-type information in the RAM 114*b* and boots as a monochrome printer.

It should be noted that in the present embodiment, it is possible to detach developing units from attach/detach sections other than the attach/detach section 50*a*, in order to change the state of the printer 10 from a state where developing units are attached to at least two attach/detach sections to a state where a developing unit is attached only to the attach/detach section 50*a*, only when power is being supplied to the printer 10.

Above, an example of a procedure for switching the printer 10 from a monochrome printer to a color printer and an example of a procedure for switching the printer 10 from a color printer to a monochrome printer were described. In both cases, "apparatus switching" (i.e., switching of the printer between the single-color mode and the color mode) is executed when power is supplied to the printer 10. In this way, it is possible to achieve a printer that is convenient for users etc.

More specifically, apparatus switching of the printer is executed, for example, based on attachment/no-attachment information of developing units with respect to each of the attach/detach sections. Therefore, if a user etc. wishes to switch the printer mode, then he/she carries out apparatus switching by either attaching a developing unit to an attach/detach section or detaching a developing unit from an attach/detach section.

However, there are cases in which the user etc. attaches a developing unit to an attach/detach section or detaches a developing unit from an attach/detach section, even though apparatus switching of the printer is not intended. For example, the user may exchange developing units, or the user may confirm the developing units to specify causes of a printer malfunction. If apparatus switching of the printer is executed, contrary to the user's intentions, due to attachment/detachment of a developing unit in the above-described cases, then it will become inconvenient for the user etc.

In view of the above, in the present embodiment, switching from a monochrome printer to a color printer, and vice versa, is executed only when power is supplied to the printer (i.e., when the printer is turned ON). In this way, apparatus switching will not be executed as long as power is not re-supplied to the printer, even when the user etc. attaches a developing unit to an attach/detach section or detaches a developing unit from an attach/detach section in cases where he/she does not intend to execute apparatus switching of the printer. Therefore, the printer will not operate contrary to the user's intentions. On the other hand, if the user etc. intends to execute apparatus switching of the printer, then he/she would only need to temporarily stop power supply to the printer by, for example, turning the power of the printer 10

OFF after attaching/detaching a developing unit, and to supply power to the printer again by, for example, turning the power of the printer 10 ON.

In this way, it is possible to achieve a printer that is convenient for users etc.

To Output a Status Sheet at an Appropriate Timing

An example of outputting a status sheet when the printer was switched between a color printer and a monochrome printer was described above. Below, an example of outputting a status sheet at an appropriate timing is described.

In this case, it is only necessary to operate the buttons on the displaying unit 95, which is shown in FIG. 1 and FIG. 2 and which is provided on the main body of the printer 10, at appropriate timings. By operating the buttons on the displaying unit 95, the user can make the printer 10 output a status sheet that corresponds to the printer state for when the buttons are operated.

For example, if the printer 10 is being used as a monochrome printer when the user carries out predetermined operations, as shown in FIG. 15, with respect to the operating buttons displayed on the displaying unit 95, which serves as an example of an operating section, then the printer 10 outputs a status sheet such as that shown in FIG. 18. In the example of the status sheet shown in FIG. 18, "LP-9000B" is printed as the printer-type name, and as regards the printer information, the remaining amount of black toner for when the printer is used as a monochrome printer is printed using indicators, and "1922 sheets" is printed as the number of sheets printed as a monochrome printer.

On the other hand, if the printer 10 is being used as a color printer when the user carries out predetermined operations with respect to the operating buttons displayed on the displaying unit 95, which serves as an example of the operating section, the printer 10 outputs a status sheet such as that shown in FIG. 16. In the example of the status sheet shown in FIG. 16, "LP-9000A" is printed as the printer-type name, and as regards the printer information, the remaining amount of black toner for when the printer is used as a color printer as well as the remaining amount of cyan toner, magenta toner, and yellow toner, which is information specific to a color printer, are printed using indicators, and "2071 sheets" is printed as the number of sheets printed as a color printer.

As described above, the number of sheets printed as a color printer is printed on the status sheet when the printer 10 is being used as a color printer, but the number of sheets printed as a color printer is not printed on the status sheet when the printer 10 is being used as a monochrome printer. In this way, it is possible to print the number of sheets printed as a color printer on the status sheet only when necessary.

Further, although the printer-type name that corresponds to the printer state is printed on the status sheet, the printer-type name "LP-9000B" for when the printer is being used as a monochrome printer, as shown in FIG. 18, and the printer-type name "LP-9000A" for when the printer is being used as a color printer, as shown in FIG. 16, are different from each other (i.e., are not the same).

Therefore, the user can easily confirm, at appropriate timings, whether the printer is currently being used as a monochrome printer or as a color printer.

Further, when the printer is being used as a monochrome printer, the remaining amount of black toner for when the printer is used as a monochrome printer is shown, as printer information, using indicators. On the other hand, when the printer is being used as a color printer, the remaining amount of black toner for when the printer is used as a color printer as well as the remaining amount of cyan toner, magenta toner, and yellow toner, which are information specific to a color printer, are shown, as printer information, using indicators. In this way, the user can accurately confirm the information necessary for when the printer is being used as a monochrome printer and the information necessary for when the printer is being used as a color printer.

Other Considerations

In the foregoing, an image forming apparatus etc. according to the present invention was described according to the above-described embodiment thereof. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

In the foregoing embodiment, an intermediate transferring type laser beam printer was described as an example of the image forming apparatus, but the present invention is also applicable to various other types of image forming apparatuses, such as laser beam printers that are not of the intermediate transferring type, copying machines, and facsimiles.

Further, in the foregoing embodiment, an image forming apparatus provided with a rotary-type developing device was described as an example. This, however, is not a limitation, and the present invention is applicable to, for example, image forming apparatuses provided with tandem-type developing devices.

Further, in the foregoing embodiment, communication between the developing-unit-side memories and the main body of the apparatus was carried out by making the apparatus-side connector abut against the developing-unit-side connectors. This, however, is not a limitation. Communication may be achieved without making the members of the developing units and a member of the main body of the apparatus coming into contact with each other.

Further, the photoconductor is not limited to a so-called photoconductive roller having a structure in which a photoconductive layer is provided on the outer peripheral surface of a cylindrical, conductive base. The photoconductor can be a so-called photoconductive belt structured by providing a photoconductive layer on a surface of a belt-like conductive base, for example.

Further, in the foregoing embodiment, the single-color printer was a monochrome printer that forms monochrome images, when a developing unit is attached to only one of the plurality of attach/detach sections, by developing the latent image bore on the photoconductor with the toner contained in the developing unit, but this is not a limitation. More specifically, in the foregoing embodiment, the developing unit attached to the one attach/detach section was a black developing unit, and monochrome images were formed by developing the latent image with the toner contained in the black developing unit, but this is not a limitation. The developing unit attached to the one attach/detach section may be a developing unit having toner of another color, and images in that color may be formed by developing the latent image with the toner contained in that developing unit.

Further, in the foregoing embodiment, switching of the printer from a single-color printer to a color printer was executed when: the state of the printer was changed from a state where a developing unit is attached only to one attach/detach section to a state where developing units are attached to at least two of the plurality of attach/detach sections; and thereafter, power is supplied to the printer in this state. This, however, is not a limitation. For example, switching of the printer may be executed when: the state of the printer is changed from a state where a developing unit is attached only to one attach/detach section to a state where developing units are attached to all of the attach/detach sections; and thereafter, power is supplied to the printer in this state.

Further, in the foregoing embodiment, attachment of developing units to attach/detach sections other than a certain attach/detach section, in order to change the state of the printer from a state where a developing unit is attached only to that certain attach/detach section to a state where developing units are attached to at least two attach/detach sections, was possible only when power was being supplied to the printer. This, however, is not a limitation. For example, attachment can be made possible even when power is not being supplied to the printer.

However, in cases where attachment of developing units is possible only when power is being supplied to the printer, the user etc. has to attach developing units when power is being supplied to the printer. In such cases, the above-described problem in that apparatus switching of the printer is executed contrary to the user's intention is more likely to arise. The foregoing embodiment is therefore more preferable in terms that the importance of the present invention increases and that the objects of the present invention are achieved more advantageously in cases where attachment of the developing units is possible only when power is being supplied to the printer.

Further, in the foregoing embodiment, switching of the printer from a color printer to a single-color printer was executed when: the state of the printer was changed from a state where developing units are attached to at least two of the plurality of attach/detach sections to a state where a developing unit is attached only to one attach/detach section; and thereafter, power is supplied to the printer in this state. This, however, is not a limitation. For example, switching of the printer may be executed when: the state of the printer is changed from a state where developing units are attached to all of the attach/detach sections to a state where a developing unit is attached only to one attach/detach section; and thereafter, power is supplied to the printer in this state.

Further, in the foregoing embodiment, detachment of developing units from attach/detach sections other than a certain attach/detach section, in order to change the state of the printer from a state where developing units are attached to at least two attach/detach sections to a state where a developing unit is attached only to that certain attach/detach section, was possible only when power was being supplied to the printer. This, however, is not a limitation. For example, detachment can be made possible even when power is not being supplied to the printer.

However, in cases where detachment of developing units is possible only when power is being supplied to the printer, the user etc. has to detach developing units when power is being supplied to the printer. In such cases, the above-described problem in that apparatus switching of the printer is executed contrary to the user's intention is more likely to arise. The foregoing embodiment is therefore more preferable in terms that the importance of the present invention increases and that the objects of the present invention are achieved more advantageously in cases where detachment of the developing units is possible only when power is being supplied to the printer.

Further, in the foregoing embodiment, power supply to the printer was stopped and started again by turning the power of the printer ON and OFF. This, however, is not a limitation. For example, this can be achieved by resetting the printer.

THIRD EMBODIMENT

A third embodiment of the present invention is described below. It should be noted that the configuration of the image forming apparatus (the printer 10), including the developing units and the YMCK developing device 50, is substantially the same as that of the first embodiment. Therefore, detailed description thereof is omitted.

The configuration of the control unit 100 is substantially the same as that of the first embodiment, but the way in which some of the data etc. are stored is different.

As described above, the control unit 100 includes a main controller 101 and a unit controller 102 (as shown in FIG. 3).

The main controller 101 includes a CPU 111, an interface 112 for establishing connection with a not-shown computer, an image memory 113 for storing image signals that have been input from the computer, and a main-controller-side memory 114 that is made up of, for example, an electrically rewritable EEPROM 114*a* (which is an example of a non-volatile memory), a RAM 114*b* (which is an example of a volatile memory), and a programmable ROM in which various programs for control are written.

The CPU 111 of the main controller 101 manages control of writing and reading of image data, which have been input via the interface, to and from the image memory 113, as well as manages overall control of the apparatus in synchronism with the CPU 120 of the unit controller 102 according to control signals that have been input from the computer.

Further, the RAM 114*b* stores apparatus-type information indicative of whether the printer 10 is being used as a color printer or as a monochrome printer.

Although detailed description will be given further below, the CPU 111 receives, from the unit controller 102 at predetermined timings, developing-unit attachment/no-attachment information which indicates where, among the four attach/detach sections, the developing units are currently attached, and based on the attachment/no-attachment information, the CPU 111 temporarily sets the apparatus-type information to the EEPROM 114*a*. The apparatus-type information that has been temporarily set to the EEPROM 114*a* is read into the RAM 114*b* and set to the RAM 114*b* when power is supplied to the printer 10 (for example, when the power of the printer 10 is turned ON). It should be noted that the apparatus-type information that has been set to the RAM 114*b* is not updated until power supply to the printer 10 is stopped, and the value of the apparatus-type information is maintained. Further, the apparatus-type information is 1-bit information; value "0" indicates that the printer 10 is used as a color printer, and value "1" indicates that the printer 10 is used as a monochrome printer.

The unit controller 102 includes, for example, a CPU 120, a unit-controller-side memory 116 that is made up of, for example, an electrically rewritable EEPROM 116*a*, a RAM, and a programmable ROM in which various programs for control are written, and various drive control circuits for driving and controlling the units in the apparatus body (i.e., the charging unit 30, the exposing unit 40, the first transferring unit 60, the cleaning unit 75, the second transferring unit 80, the fusing unit 90, and the displaying unit 95) and the YMCK developing device 50.

The CPU 120 of the unit controller 102 is electrically connected to each of the drive control circuits and controls the drive control circuits according to control signals from the CPU 111 of the main controller 101. More specifically, the CPU 120 controls each of the units and the YMCK developing device 50 according to signals received from the main controller 101 while detecting the state of each of the units and the YMCK developing device 50 by receiving signals from sensors provided in each unit.

The CPU 120 also controls each of the drive control circuits according to the apparatus-type information that has been set to the RAM 114*b*. More specifically, if the value of the apparatus-type information is "0", then the CPU 120 controls the units and the YMCK developing device 50 of the printer 10 to function as a color printer, and if the value of the apparatus-type information is "1", then the CPU 120 controls the units and the YMCK developing device 50 of the printer 10 to function as a monochrome printer.

The EEPROM 116*a* stores the developing-unit attachment/no-attachment information which indicates where, among the four attach/detach sections, the developing units are currently attached. Although detailed description will be given further below, the CPU 120 sends the attachment/no-attachment information of a developing unit to the main controller 101 after attachment/detachment of the developing unit is finished. Then, the CPU 111 of the main controller 101 temporarily sets the apparatus-type information to the EEPROM 114*a*, if necessary, based on the attachment/no-attachment information that has been received. It should be noted that the attachment/no-attachment information is written in the EEPROM 116*a* as 4-bit information, i.e., 1-bit information for each attach/detach section; value "0" indicates that no developing unit is attached, and value "1" indicates that a developing unit is attached.

Further, the CPU 120 of the unit controller 102 is connected, via a serial interface (I/F) 121, to a storage element 122 (which is referred to below as "apparatus-side memory") which is, for example, a serial EEPROM. Data necessary for controlling the apparatus are stored in the apparatus-side memory 122. The CPU 120 is not only connected to the apparatus-side memory 122, but is also connected to the developing-unit-side memories 51*a*, 52*a*, 53*a*, and 54*a*, which are provided on the respective developing units 51, 52, 53, and 54, via the serial interface 121. Therefore, data can be exchanged between the apparatus-side memory 122 and the developing-unit-side memories 51*a*, 52*a*, 53*a*, and 54*a*, and also, it is possible to input chip-select signals CS to the developing-unit-side memories 51*a*, 52*a*, 53*a*, and 54*a* via the input/output port 123. The CPU 120 is also connected to the HP detector 31 via the input/output port 123.

Procedure of Apparatus Switching of the Image Forming Apparatus

As described above, when the developing units are attached to each of the attach/detach sections 50*a*, 50*b*, 50*c*, and 50*d*, the printer 10 according to the present embodiment can be used as a color printer for forming color images by developing the latent image bore on the photoconductor 20 using the toner T contained in each of the developing units, whereas when a developing unit is attached to only one of the attach/detach sections 50*a*, 50*b*, 50*c*, or 50*d*, then the printer 10 can be used as a monochrome printer for forming monochrome images by developing the latent image bore on the photoconductor 20 using the toner T contained in that developing unit.

Below, an example of a procedure for switching the printer 10 from a monochrome printer to a color printer and an example of a procedure for switching the printer 10 from a color printer to a monochrome printer will be described.

Switching from Monochrome Printer to Color Printer

Figure 19:
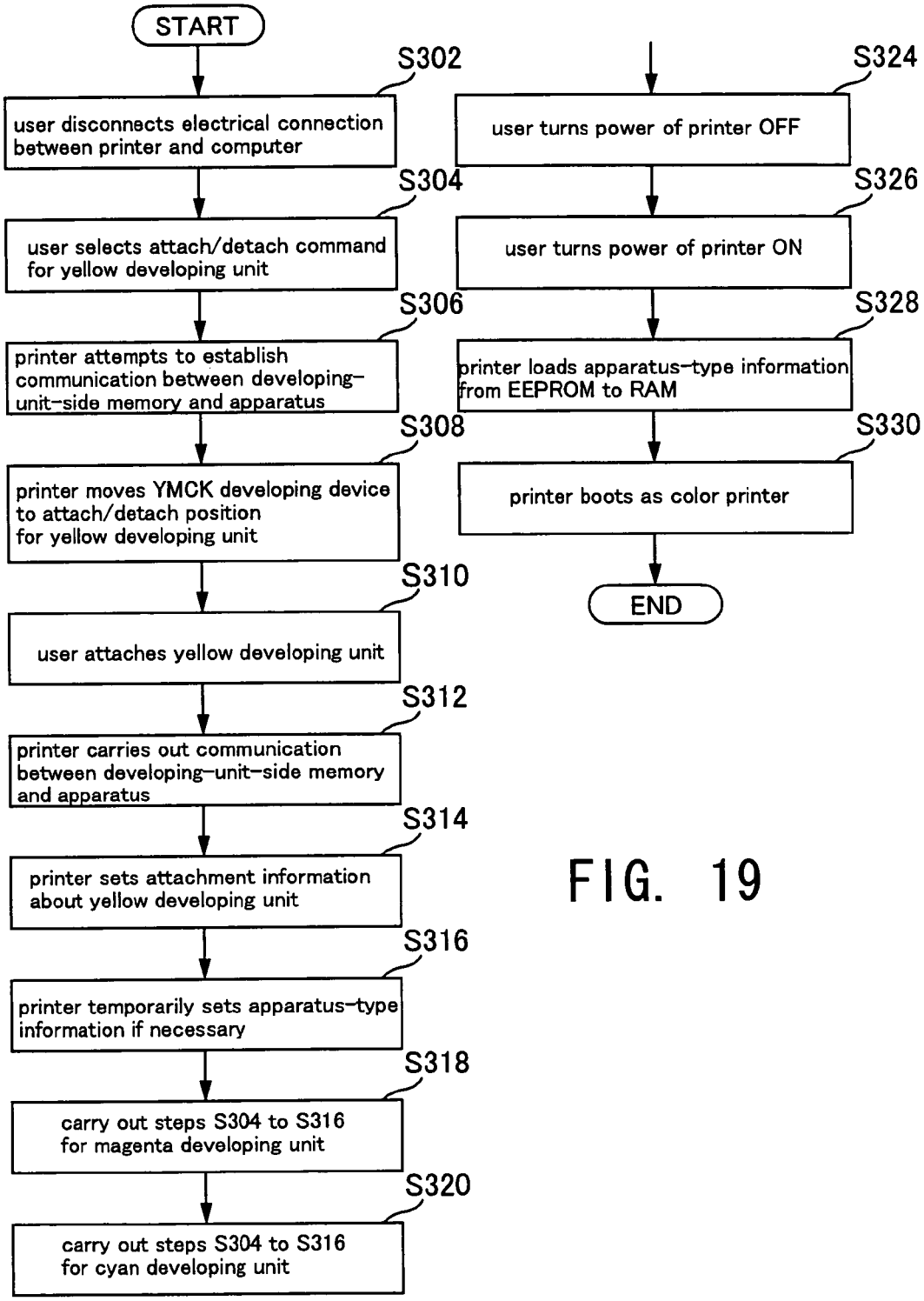
FIG. 19 is a flowchart for illustrating a procedure for switching the printer 10 from a monochrome printer to a color printer.

First, a procedure for switching the printer 10 from a monochrome printer to a color printer will be described using FIG. 19. FIG. 19 is a flowchart for illustrating the procedure for switching the printer 10 from a monochrome printer to a color printer. The various operations of the printer 10 described below are mainly achieved by the main controller 101 or the unit controller 102 in the printer 10. Particularly, in the present embodiment, the operations are achieved by the CPU executing programs that are stored in the programmable ROM. The programs are made of codes for achieving the various operations described below.

This flowchart starts from a state in which the power of the printer 10 has already been turned ON and the printer 10 is on standby for image formation to be carried out. The standby position of the YMCK developing device 50 at this time is the HP position shown in FIG. 6A.

Further, the printer 10, before switching is performed, is used as a monochrome printer, and therefore, the developing unit is attached to only one of the four attach/detach sections, as shown in FIG. 2. That is, the black developing unit 51 is attached to the attach/detach section 50*a*, but no developing unit is attached to the other attach/detach sections 50*b*, 50*c*, and 50*d*.

First, if the printer 10 is electrically connected to a computer, then the user disconnects the electrical connection by turning the power of the computer OFF, disconnecting the cable that connects the printer 10 and the computer, and so forth (step S302.)

Then, the user operates a menu button provided, for example, on the displaying unit 95, and by selecting the attach/detach command for a certain developing unit, the user gives an instruction to the printer 10 that he/she wishes to attach or detach a developing unit. At the time of giving this instruction, the user designates the developing unit that is targeted for attachment/detachment.

In the present embodiment, the user first selects the attach/detach command for the yellow developing unit 54 (step S304). The unit controller 102 comprehends this command with the displaying unit drive control circuit. More specifically, the unit controller 102 determines which, among the black developing unit 51, the magenta developing unit 52, the cyan developing unit 53, and the yellow developing unit 54, is the developing unit targeted for attachment/detachment. In the present embodiment, the developing unit targeted for attachment/detachment is the yellow developing unit 54. Therefore, the unit controller 102 rotates the pulse motor for a predetermined number of pulses to rotate the YMCK developing device 50 and to move the position of the YMCK developing device 50 from the HP position to the connector attach/detach position for the yellow developing unit 54.

Then, the unit controller 102 halts the YMCK developing device 50 at the connector attach/detach position. In this halted state, the unit controller 102 moves the apparatus-side connector 34 and attempts to establish communication with the developing-unit-side memory of the developing unit (step S306). In the present embodiment, the yellow developing unit 54 has not been attached yet, and therefore, communication cannot be established.

Next, the unit controller 102 rotates the pulse motor for a predetermined number of pulses to rotate the YMCK developing device 50 and to move the position of the YMCK developing device 50 from the connector attach/detach position for the yellow developing unit 54 to the attach/detach position for the yellow developing unit 54 (step S308).

In this state, the unit controller 102 notifies the user that the yellow developing unit 54 can be attached to (or detached from) the attach/detach section by displaying a message on a displaying section etc. provided in the displaying unit 95.

Confirming the display, the user opens the outer cover of the printer 10 and attaches the yellow developing unit 54 to the attach/detach section 50*d* of the YMCK developing device 50 through the attach/detach dedicated opening 37 (step S310). After the user attaches the yellow developing unit 54 and closes the outer cover of the printer 10, the unit controller 102 detects this and moves the position of the YMCK developing device 50 from the attach/detach position for the yellow developing unit 54 to the connector attach/detach position for the yellow developing unit 54.

Then, the unit controller 102 halts the YMCK developing device 50 at the connector attach/detach position. In this halted state, the unit controller 102 moves the apparatus-side connector 34 and makes the apparatus-side connector 34 and the developing-unit-side connector 54*b* of the yellow developing unit 54 abut against each other. In this state, the developing-unit-side memory 54*a* of the yellow developing unit 54 is electrically connected to the unit controller 102 of the control unit 100, and communication is established between the developing-unit-side memory 54*a* and the apparatus body (step S312). The unit controller 102 also determines whether the communication has succeeded. If the communication has succeeded, then the unit controller 102 assumes that the yellow developing unit 54 has been attached, and sets the attachment/no-attachment information for the yellow developing unit 54 in the EEPROM 116*a* to "1". On the other hand, if it is determined that the communication has failed, then the unit controller 102 assumes that the yellow developing unit 54 has not been attached, and sets the attachment/no-attachment information for the yellow developing unit 54 in the EEPROM 116*a* to "0" (step S314). In the present embodiment, it is assumed that the communication has succeeded, and the attachment/no-attachment information for the yellow developing unit 54 in the EEPROM 116*a* is changed from "0" to "1".

After finishing the above-described processes relating to the attachment/no-attachment information, the unit controller 102 sends the attachment/no-attachment information for all four developing units to the main controller 101. The main controller 101 receives the attachment/no-attachment information, and temporarily sets the above-described apparatus-type information to the EEPROM 114*a* based on the attachment/no-attachment information (step S316).

An algorithm according to which the main controller 101 temporarily sets the apparatus-type information based on the attachment/no-attachment information of the four developing units is described below. If the value of only the attachment/no-attachment information for the black developing unit 51, among the four pieces of attachment/no-attachment information, is "1", which indicates that a developing unit is attached, then the main controller 101 temporarily sets the value of the apparatus-type information in the EEPROM 114*a* to "1", which indicates that the printer is to be used as a monochrome printer. On the other hand, if the value of the attachment/no-attachment information for the black developing unit 51 and a value of the attachment/no-attachment information for at least one developing unit other than the black developing unit 51 are "1", then the main controller 101 temporarily sets the value of the apparatus-type information to "0", which indicates that the printer is to be used as a color printer. Further, if the value of the attachment/no-attachment information for the black developing unit 51 is "0", then the main controller 101 does not execute the operation of temporarily setting the apparatus-type information. (That is, if the black developing unit 51, which should be attached regardless of whether the printer is to be used as a color printer or as a monochrome printer, is not attached, then the temporary setting of the apparatus-type information is not carried out and the value of the apparatus-type information is kept the same.) The relationship between the values of the attachment/no-attachment information and the operations of temporarily setting the apparatus-type information is as shown in FIG. 20.

In the present embodiment, the values of the attachment/no-attachment information of the developing units are "1" for the black developing unit, "0" for the magenta developing unit, "0" for the cyan developing unit, and "1" for the yellow developing unit (i.e., the values match case "J" of FIG. 20). Therefore, the main controller 101 rewrites the value of the apparatus-type information from "1", which indicates "monochrome printer", to "0", which indicates "color printer".

Next, the processes from step S304 through step S316 described above are carried out for the cyan developing unit 53 and the magenta developing unit 52 (step S318 and step S320). As a result of carrying out these processes, the values of the attachment/no-attachment information for the cyan developing unit 53 and the magenta developing unit 52 are rewritten from "0" to "1". It should be noted that in step S318, the values of the attachment/no-attachment information of the developing units received by the main controller 101 are "1" for the black developing unit, "0" for the magenta developing unit, "1" for the cyan developing unit, and "1" for the yellow developing unit (i.e., the values match case "L" of FIG. 20). Therefore, the value of the apparatus-type information after step S318 stays at "0". Similarly, in step S320, the values of the attachment/no-attachment information of the developing units received by the main controller 101 are "1" for the black developing unit, "1" for the magenta developing unit, "1" for the cyan developing unit, and "1", for the yellow developing unit (i.e., the values match case "Q" of FIG. 20). Therefore, the value of the apparatus-type information after step S320 stays at "0".

Next, the user temporarily halts power supply to the printer by turning the power of the printer 10 OFF, for example (step S324). The user then supplies power to the printer again by turning the power of the printer 10 ON, for example (step S326).

When power is supplied to the printer 10, the main controller 101 detects this and loads the apparatus-type information from the EEPROM 114*a* to the RAM 114*b* (step S328). That is, the apparatus information that has been temporarily set to the EEPROM 114*a* is read into the RAM 114*b* and is "permanently" set to the RAM 114*b* when power is supplied to the printer 10.

Here, the value "0", which indicates "color printer", is loaded to the RAM 114*b*. The CPU 120 of the unit controller 102 then controls the drive control circuits based on the apparatus-type information that has been set to the RAM 114*b*. More specifically, as a result of referencing the apparatus-type information in the RAM 114*b*, the printer 10 boots as a color printer, and the units and the YMCK developing device 50 of the printer 10 are controlled to function as a color printer (step S330).

As described above, switching of the printer 10 from a monochrome printer to a color printer is executed when: the state of the printer 10 changes from a state where a developing unit is attached only to the attach/detach section 50*a* to a state where developing units are attached to the attach/detach section 50*a* and at least another attach/detach section other than the attach/detach section 50*a* by attaching developing units to attach/detach sections other than the attach/detach section 50*a* while power is being supplied to the printer 10; and the power supply to the printer 10 is once stopped and then started again.

In other words, although the apparatus-type information may temporarily be set to the EEPROM 114*a*, the apparatus-type information will not be "permanently" set to the RAM 114*b* only by changing the state of the printer 10 from a state where a developing unit is attached only to the attach/detach section 50*a* to a state where developing units are attached to the attach/detach section 50*a* and at least another attach/detach section other than the attach/detach section 50*a*. Therefore, in this case, the value of the apparatus-type information in the RAM 114*b* remains the same as that before the change in state (i.e., the value remains at "1" indicative of "monochrome printer"), and the printer 10 will not switch from the monochrome printer to the color printer. The apparatus-type information is set to the RAM 114*b* only after power is supplied again to the printer 10 at step S326, and in this case, the printer 10 boots as a color printer. The apparatus-type information that has been set to the RAM 114*b* will not be updated until power supply to the printer 10 is stopped, and therefore, the printer 10 operates as a color printer at least until power supply to the printer is stopped.

Switching from Color Printer to Monochrome Printer

Figure 21:
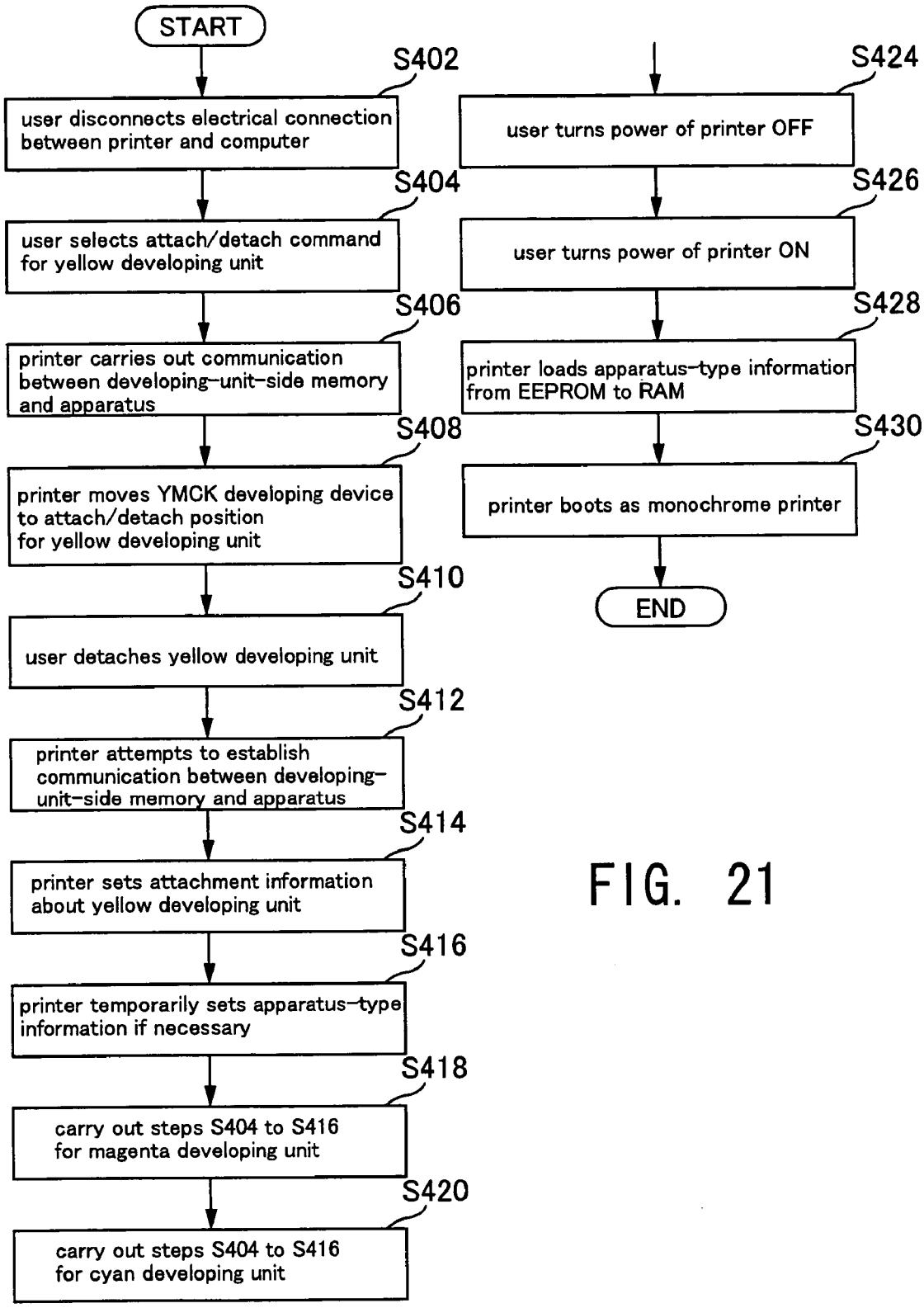
FIG. 21 is a flowchart for illustrating a procedure for switching the printer 10 from a color printer to a monochrome printer.

Next, a procedure for switching the printer 10 from a color printer to a monochrome printer will be described using FIG. 21. FIG. 21 is a flowchart for illustrating the procedure for switching the printer 10 from a color printer to a monochrome printer. The various operations of the printer 10 described below are mainly achieved by the main controller 101 or the unit controller 102 in the printer 10. Particularly, in the present embodiment, the operations are achieved by the CPU executing programs that are stored in the programmable ROM. The programs are made of codes for achieving the various operations described below.

This flowchart starts from a state in which the power of the printer 10 has already been turned ON and the printer 10 is on standby for image formation to be carried out. The standby position of the YMCK developing device 50 at this time is the HP position shown in FIG. 6A.

Further, the printer 10, before switching is performed, is used as a color printer, and therefore, the developing units are attached to all four attach/detach sections, as shown in FIG. 1. That is, the black developing unit 51 is attached to the attach/detach section 50*a*, the magenta developing unit 52 is attached to the attach/detach section 50*b*, the cyan developing unit 53 is attached to the attach/detach section 50*c*, and the yellow developing unit 54 is attached to the attach/detach section 50*d*.

First, if the printer 10 is electrically connected to a computer, then the user disconnects the electrical connection by turning the power of the computer OFF, disconnecting the cable that connects the printer 10 and the computer, and so forth (step S402.)

Then, the user operates a menu button provided, for example, on the displaying unit 95, and by selecting the attach/detach command for a certain developing unit, the user gives an instruction to the printer 10 that he/she wishes to attach or detach a developing unit. At the time of giving this instruction, the user designates the developing unit that is targeted for attachment/detachment.

In the present embodiment, the user first selects the attach/detach command for the yellow developing unit 54 (step S404). The unit controller 102 comprehends this command with the displaying unit drive control circuit. More specifically, the unit controller 102 determines which, among the black developing unit 51, the magenta developing unit 52, the cyan developing unit 53, and the yellow developing unit 54, is the developing unit targeted for attachment/detachment. In the present embodiment, the developing unit targeted for attachment/detachment is the yellow developing unit 54. Therefore, the unit controller 102 rotates the pulse motor for a predetermined number of pulses to rotate the YMCK developing device 50 and to move the position of the YMCK developing device 50 from the HP position to the connector attach/detach position for the yellow developing unit 54.

Then, the unit controller 102 halts the YMCK developing device 50 at the connector attach/detach position. In this halted state, the unit controller 102 moves the apparatus-side connector 34 and makes the apparatus-side connector 34 and the developing-unit-side connector 54*b* of the yellow developing unit 54 abut against each other. In this state, the developing-unit-side memory 54*a* of the yellow developing unit 54 is electrically connected to the unit controller 102 of the control unit 100, and communication is established between the developing-unit-side memory 54*a* and the apparatus body (step S406).

After finishing the communication and separating the apparatus-side connector 34 from the developing-unit-side connector 54*b*, the unit controller 102 rotates the pulse motor for a predetermined number of pulses to rotate the YMCK developing device 50 and to move the position of the YMCK developing device 50 from the connector attach/detach position for the yellow developing unit 54 to the attach/detach position for the yellow developing unit 54 (step S408).

In this state, the unit controller 102 notifies the user that the yellow developing unit 54 can be detached from (or attached to) the attach/detach section by displaying a message on the displaying section etc. provided in the displaying unit 95.

Confirming the display, the user opens the outer cover of the printer 10 and detaches the yellow developing unit 54, which is arranged inside the attach/detach dedicated opening 37, from the YMCK developing device 50 through the attach/detach dedicated opening 37 (step S410). After the user detaches the yellow developing unit 54 and closes the outer cover of the printer 10, the unit controller 102 detects this and moves the position of the YMCK developing device 50 from the attach/detach position for the yellow developing unit 54 to the connector attach/detach position for the yellow developing unit 54.

Then, the unit controller 102 halts the YMCK developing device 50 at the connector attach/detach position. In this halted state, the unit controller 102 moves the apparatus-side connector 34 and attempts to establish communication with the developing-unit-side memory of the developing unit (step S412). If communication succeeds, then the unit controller 102 assumes that the yellow developing unit 54 is attached, and sets the attachment/no-attachment information for the yellow developing unit 54 in the EEPROM 116*a* to "1". On the other hand, if communication fails, then the unit controller 102 assumes that the yellow developing unit 54 is not attached, and sets the attachment/no-attachment information for the yellow developing unit 54 in the EEPROM 116*a* to "0" (step S414). In the present embodiment, since the yellow developing unit 54 has been detached at step S410, it is assumed that the communication has failed, and the attachment/no-attachment information for the yellow developing unit 54 in the EEPROM 116*a* is changed from "1" to "0".

After finishing the above-described processes relating to the attachment/no-attachment information, the unit controller 102 sends the attachment/no-attachment information for all four developing units to the main controller 101. The main controller 101 receives the attachment/no-attachment information and temporarily sets the above-described apparatus-type information to the EEPROM 114*a* based on the attachment/no-attachment information (step S416).

In the present embodiment, the value of the attachment/no-attachment information only for the yellow developing unit 54 is "0" (and this situation matches case "P" of FIG. 20). Therefore, the main controller 101 temporarily sets the value of the apparatus-type information to "0", which indicates "color printer", in accordance with the algorithm described above. In this example, however, the value of the apparatus-type information is not changed because before detachment of the yellow developing unit 54, all four developing units were attached and the value of the apparatus-type information was "0" (the situation for case "Q" of FIG. 20).

Next, the processes from step S404 through step S416 described above are carried out for the cyan developing unit 53 and the magenta developing unit 52 (step S418 and step S420). As a result of carrying out these processes, the values of the attachment/no-attachment information for the cyan developing unit 53 and the magenta developing unit 52 are rewritten from "1" to "0". The values of the attachment/no-attachment information of the developing units received by the main controller 101 become "1" for the black developing unit, "0" for the magenta developing unit, "0" for the cyan developing unit, and "0" for the yellow developing unit (i.e., the values match case "I" of FIG. 20). Therefore, the main controller 101 changes the value of the apparatus-type information in the EEPROM 114*a* from "0", which indicates "color printer", to "1", which indicates "monochrome printer", in accordance with the algorithm described above.

Next, the user temporarily halts power supply to the printer by turning the power of the printer 10 OFF, for example (step S424). The user then supplies power to the printer again by turning the power of the printer 10 ON, for example (step S426).

When power is supplied to the printer 10, the main controller 101 detects this and loads the apparatus-type information from the EEPROM 114*a* to the RAM 114*b* (step S428). That is, the apparatus information that has been temporarily set to the EEPROM 114*a* is read into the RAM 114*b* and is "permanently" set to the RAM 114*b* when power is supplied to the printer 10.

Here, the value "1", which indicates "monochrome printer", is loaded to the RAM 114*b*. The CPU 120 of the unit controller 102 then controls the drive control circuits based on the apparatus-type information that has been set to the RAM 114*b*. More specifically, as a result of referencing the apparatus-type information in the RAM 114*b*, the printer 10 boots as a monochrome printer, and the units and the YMCK developing device 50 of the printer 10 are controlled to function as a monochrome printer (step S430).

As described above, switching of the printer 10 from a color printer to a monochrome printer is executed when: the state of the printer 10 changes from a state where developing units are attached to the attach/detach section 50*a* and at least another attach/detach section other than the attach/detach section 50*a* to a state where a developing unit is attached only to the attach/detach section 50*a* by detaching developing units from attach/detach sections other than the attach/detach section 50*a* while power is being supplied to the printer 10; and the power supply to the printer 10 is once stopped and then started again.

In other words, although the apparatus-type information may temporarily be set to the EEPROM 114*a*, the apparatus-type information will not be "permanently" set to the RAM 114*b* only by changing the state of the printer 10 from a state where developing units are attached to the attach/detach section 50*a* and at least another attach/detach section other than the attach/detach section 50*a* to a state where a developing unit is attached only to the attach/detach section 50*a*. Therefore, in this case, the value of the apparatus-type information in the RAM 114*b* remains the same as that before the change in state (i.e., the value remains at "0" indicative of "color printer"), and the printer 10 will not switch from the color printer to the monochrome printer. The apparatus-type information is set to the RAM 114*b* only after power is supplied again to the printer 10 at step S426, and in this case, the printer 10 boots as a monochrome printer. The apparatus-type information that has been set to the RAM 114*b* will not be updated until power supply to the printer 10 is stopped, and therefore, the printer 10 operates as a monochrome printer at least until power supply to the printer is stopped.

As described in the section of the "Description of the Related Art", there are situations in which the user etc. wishes to execute apparatus switching of the printer 10. In such a case, the user etc. carries out apparatus switching by either attaching a developing unit to an attach/detach section or detaching a developing unit from an attach/detach section.

However, there are cases in which the user etc. attaches a developing unit to an attach/detach section or detaches a developing unit from an attach/detach section, even though apparatus switching of the printer 10 is not intended. For example, the user may exchange developing units, or the user may confirm the developing units to specify causes of a malfunction of the printer 10. If apparatus switching of the printer 10 is executed, contrary to the user's intentions, due to attachment/detachment of a developing unit in the above-described cases, then it will become inconvenient for the user etc.

In view of the above, in the present embodiment, the printer 10 has apparatus-type information that indicates whether the printer 10 is being used as a color printer or as a monochrome printer. In this way, it is possible to achieve a printer that is convenient for users etc.

More specifically, if the printer 10 does not have the apparatus-type information but is to directly determine, from the attachment/no-attachment information for the developing units, whether the printer is being used as a color printer or a monochrome printer, then it would be difficult to overcome the above-described problem in that apparatus switching is executed merely by attachment/detachment of a developing unit even when the user etc. does not intend to carry out apparatus switching of the printer 10.

On the other hand, if the printer 10 has, in addition to the attachment/no-attachment information, the apparatus-type information that indicates whether the printer 10 is being used as a color printer or as a monochrome printer, then it becomes possible to easily overcome the above-described problem in that apparatus switching is executed merely by attachment/detachment of a developing unit even when the user etc. does not intend to carry out apparatus switching of the printer 10. Thus, it is possible to achieve a printer that is convenient for users etc.

It should be noted that in the present embodiment, attachment/detachment of developing units with respect to the attach/detach sections can only be carried out when power is being supplied to the printer 10.

Other Considerations

In the foregoing, an image forming apparatus etc. according to the present invention was described according to the above-described embodiment thereof. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

In the foregoing embodiment, an intermediate transferring type laser beam printer was described as an example of the image forming apparatus, but the present invention is also applicable to various other types of image forming apparatuses, such as laser beam printers that are not of the intermediate transferring type, copying machines, and facsimiles.

Further, in the foregoing embodiment, an image forming apparatus provided with a rotary-type developing device was described as an example. This, however, is not a limitation, and the present invention is applicable to, for example, image forming apparatuses provided with tandem-type developing devices.

Further, in the foregoing embodiment, communication between the developing-unit-side memories and the main body of the apparatus was carried out by making the apparatus-side connector abut against the developing-unit-side connectors. This, however, is not a limitation. Communication may be achieved without making the members of the developing units and a member of the main body of the apparatus coming into contact with each other.

Further, the photoconductor is not limited to a so-called photoconductive roller having a structure in which a photoconductive layer is provided on the outer peripheral surface of a cylindrical, conductive base. The photoconductor can be a so-called photoconductive belt structured by providing a photoconductive layer on a surface of a belt-like conductive base, for example.

Further, in the foregoing embodiment, attachment/detachment of developing units with respect to the plurality of attach/detach sections was possible only when power was being supplied to the printer 10. This, however, is not a limitation. For example, attachment/detachment may be made possible when power is not being supplied to the printer.

However, in cases where attachment/detachment is possible only when power is being supplied to the printer, the user etc. has to attach/detach developing units when power is being supplied to the printer. In such cases, the above-described problem in that apparatus switching of the printer is executed contrary to the user's intention is more likely to arise. The present embodiment is therefore more effective in terms that the importance of the present invention increases and that the objects of the present invention are achieved more advantageously in cases where attachment/detachment of the developing units is possible only when power is being supplied to the printer.

Further, in the foregoing embodiment, the apparatus-type information was set when power was supplied to the printer 10 and was not updated until power supply to the printer 10 was stopped. This, however, is not a limitation. For example, the apparatus-type information may be set after a predetermined period of time has lapsed from when power was supplied to the printer.

The foregoing embodiment, however, is more preferable in terms that, while power is being supplied to the printer, it is possible to certainly overcome the above-described problem in that apparatus switching of the printer is executed contrary to the user's intention.

Further, in the foregoing embodiment, the single-color printer was a monochrome printer that forms monochrome images, when the black developing unit 51 containing black toner T is attached to only one of the plurality of attach/detach sections, by developing the latent image bore on the photoconductor 20 with the black toner T contained in the black developing unit 51, but this is not a limitation. More specifically, in the foregoing embodiment, the developing unit attached to the one attach/detach section was a black developing unit, and monochrome images were formed by developing the latent image with the toner contained in the black developing unit, but this is not a limitation. The developing unit attached to the one attach/detach section may be a developing unit having toner of another color, and images in that color may be formed by developing the latent image with the toner contained in that developing unit.

Further, in the foregoing embodiment, if the black developing unit 51 was attached only to one attach/detach section when power is supplied to the printer 10, then the information was set as information that indicates that the printer 10 is being used as a monochrome printer; and if the black developing unit 51 and at least one developing unit other than the black developing unit 51 were attached to the plurality of attach/detach sections when power is supplied to the printer 10, then the information was set as information that indicates that the printer 10 is being used as a color printer. This, however, is not a limitation. For example, the information may be set such that, if the black developing unit 51 is attached only to one attach/detach section when power is supplied to the printer 10, then the information is set as information that indicates that the printer 10 is being used as a monochrome printer; and if developing units are attached to all of the attach/detach sections when power is supplied to the printer 10, then the information is set as information that indicates that the printer 10 is being used as the color printer.

Further, in the foregoing embodiment, the printer 10 included a control unit 100 that controls the printer 10; the control unit included a RAM 114*b* as a volatile memory; and the apparatus-type information was set to the RAM 114*b*. This, however, is not a limitation. For example, the apparatus-type information may be set to a non-volatile memory. The foregoing embodiment, however, is more preferable in terms of cost reduction.

Further, in the foregoing embodiment, the control unit 100 included an EEPROM 114*a* as a non-volatile memory; and the apparatus-type information was temporarily set to the EEPROM 114*a*, and the apparatus-type information, which had been temporarily set to the EEPROM 114*a*, was read into the RAM 114*b* when power was supplied to the printer 10 and was set to the RAM 114*b*. This, however, is not a limitation. For example, the printer does not have to execute the operations for temporarily setting the apparatus-type information, and the apparatus-type information may be set, for the first time, when power is supplied to the printer.

However, by temporarily setting the apparatus-type information to the EEPROM 114*a* before setting it to the RAM 114*b*, "permanent" setting of the apparatus-type information can be completed just by loading the apparatus-type information from the EEPROM 114*a* to the RAM 114*b*. The foregoing embodiment is therefore more preferable in terms that it is possible to reduce the loads on the printer 10 during initial operation when power is supplied thereto.

Further, in the foregoing embodiment, the apparatus-type information was temporarily set to the EEPROM 114*a* when attachment or detachment of a developing unit to or from one of the plurality of attach/detach sections was finished. This, however, is not a limitation. For example, the apparatus-type information may temporarily be set to the EEPROM 114*a* at predetermined time intervals.

The foregoing embodiment, however, is more preferable in terms that the apparatus-type information can temporarily be set efficiently through temporary setting of the apparatus-type information to the EEPROM 114*a* upon completion of attachment or detachment of a developing unit, because a change in the value of the apparatus-type information might be triggered by attachment/detachment of a developing unit.

Further, in the foregoing embodiment, if the black developing unit 51 was attached only to one attach/detach section, then the apparatus-type information was temporarily set as information that indicates that the printer 10 is being used as a monochrome printer; if the black developing unit 51 and at least one developing unit other than the black developing unit 51 were attached to the plurality of attach/detach sections, then the apparatus-type information was temporarily set as information that indicates that the printer 10 is being used as the color printer; and if the black developing unit 51 was not attached, then temporary setting of the information was not carried out. This, however, is not a limitation. For example, temporary setting may be carried out even when the black developing unit is not attached.

The black developing unit, however, is a developing unit that should be attached regardless of whether the printer is to be used as a color printer or as a monochrome printer. Therefore, if the black developing unit is not attached upon temporary setting of the apparatus-type information, then there is a high possibility that the user carried out the previous developing-unit attachment/detachment operation without the intent to execute apparatus switching. The foregoing embodiment is therefore preferable in terms that the user's intention can be met by not carrying out temporary setting when the black developing unit is not attached, and consequently, it becomes possible to achieve a printer that is convenient for users etc.

Further, in the foregoing embodiment, each developing unit was attachable to only one of the plurality of attach/detach sections that it corresponds to; the printer 10 had attachment/no-attachment information about each developing unit for each of the attach/detach sections; and temporary setting of the apparatus-type information was carried out based on the attachment/no-attachment information. This, however, is not a limitation. For example, the developing unit may be made to be attachable to any one of the attach/detach sections, the printer 10 may have attachment/no-attachment information for each of those developing units; and temporary setting of the apparatus-type information may be carried out based on the attachment/no-attachment information.

The foregoing embodiment, however, is more preferable in terms that it becomes possible to easily determine whether or not a developing unit is attached.

Further, in the foregoing embodiment, power supply to the printer was stopped and started again by turning the power of the printer ON and OFF. This, however, is not a limitation. For example, this can be achieved by resetting the printer.

Configuration of Image Forming System etc. Adoptable for Image Forming Apparatus According to First trough Third Embodiments Next, an embodiment of an image forming system, which serve as an example of an embodiment of the present invention, is described with reference to the drawings.

Figure 22:
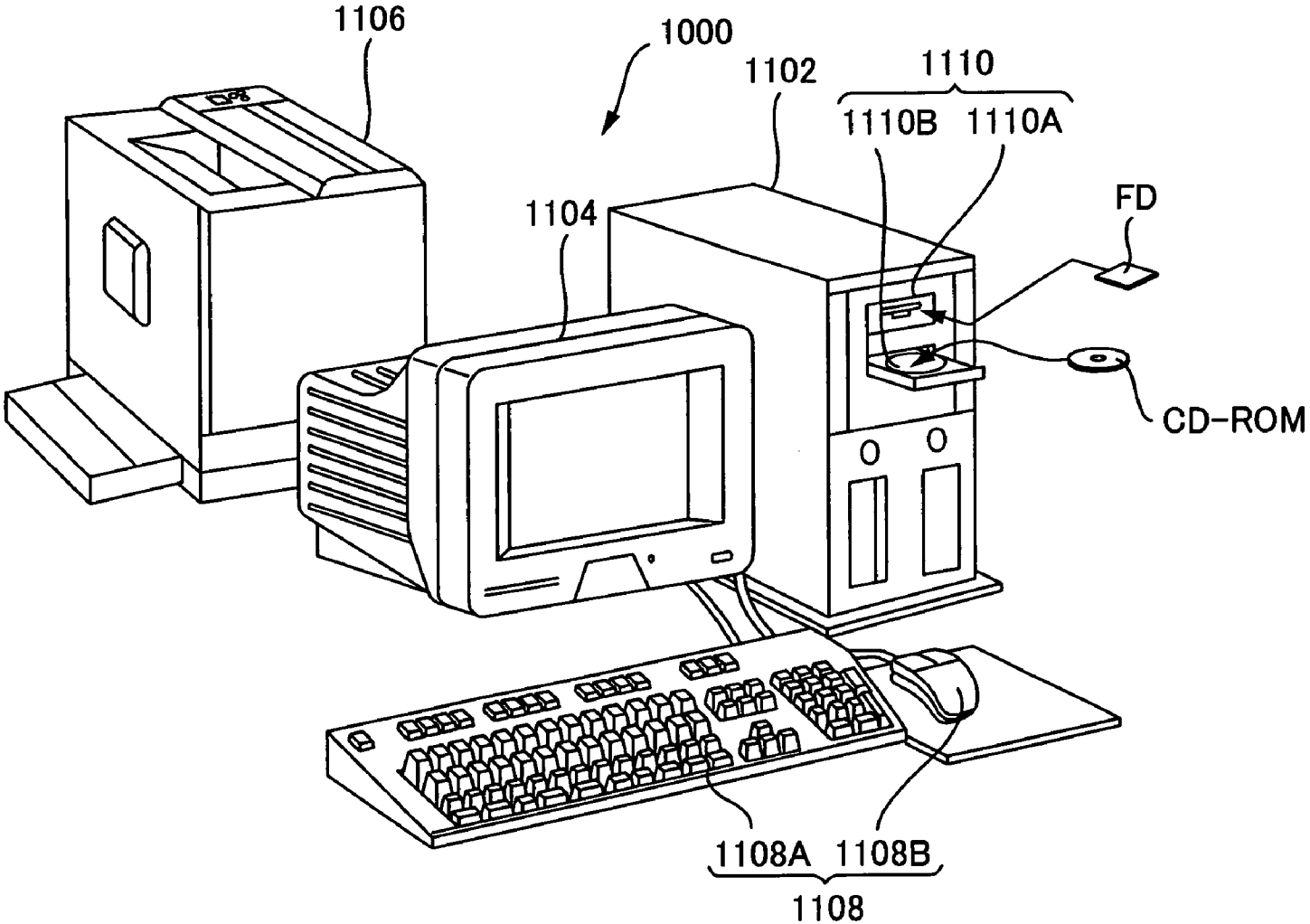
FIG. 22 is an explanatory diagram showing an external configuration of an image forming system.

FIG. 22 is an explanatory drawing showing an external structure of an image forming system. The image forming system 1000 comprises a computer 1102, a display device 1104, a printer 1106, an input device 1108, and a reading device 1110. In this embodiment, the computer 1102 is accommodated in a mini-tower type housing, but this is not a limitation. A CRT (cathode ray tube), a plasma display, or a liquid crystal display device, for example, is generally used as the display device 1104, but this is not a limitation. The printer described above is used as the printer 1106. In this embodiment, a keyboard 1108A and a mouse 1108B are used as the input device 1108, but this is not a limitation. In this embodiment, a flexible disk drive device 1110A and a CD-ROM drive device 1110B are used as the reading device 1110, but the reading device is not limited to these, and it may also be other devices such as a MO (magneto optical) disk drive device and a DVD (digital versatile disk).

Figure 23:
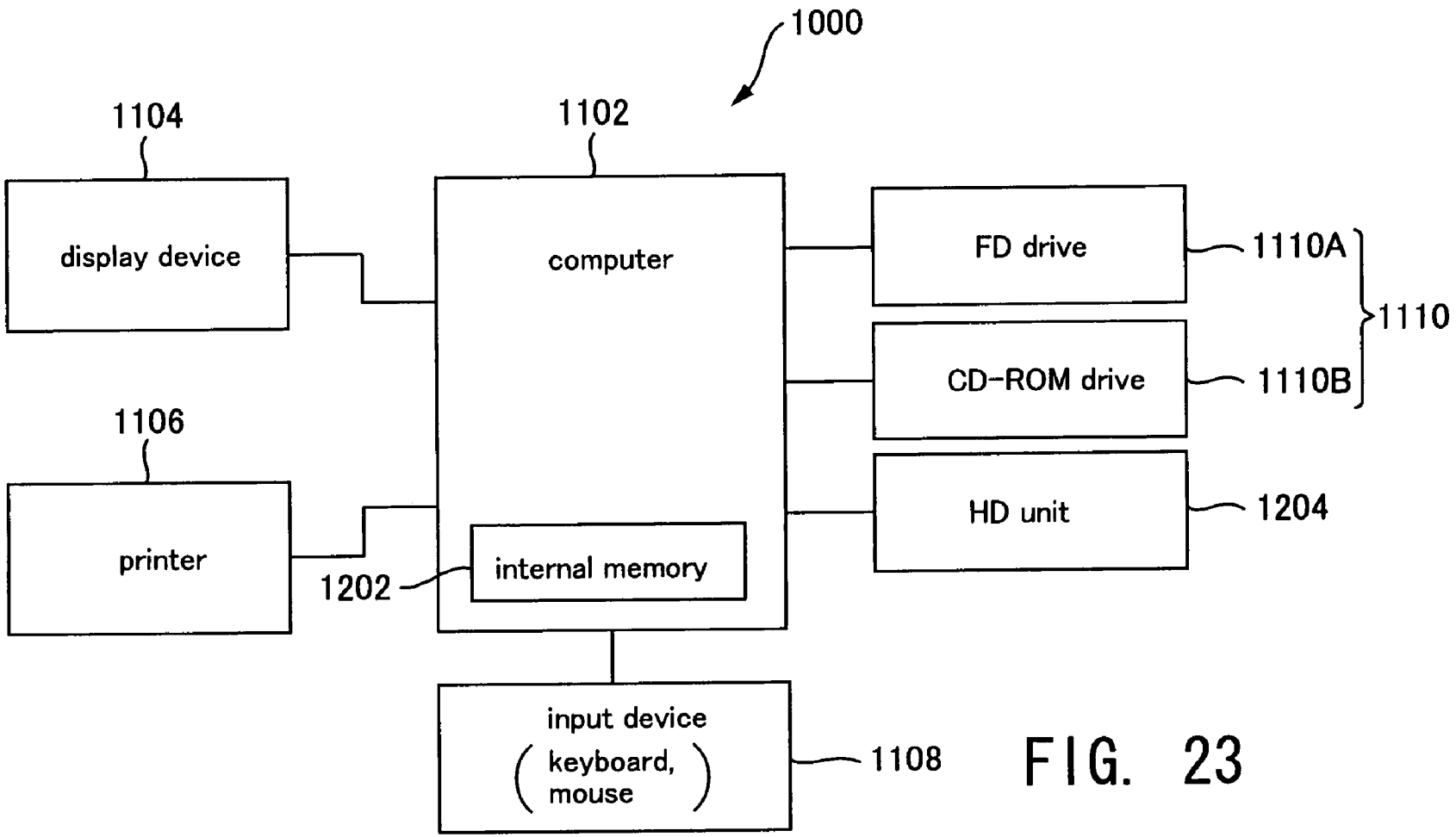
FIG. 23 is a block diagram showing a configuration of the image forming system of FIG. 22.

FIG. 23 is a block diagram showing a configuration of the image forming system shown in FIG. 22. Further provided are an internal memory 1202, such as a RAM inside the housing accommodating the computer 1102, and an external memory such as a hard disk drive unit 1204.

It should be noted that in the above description, an example in which the image forming system is structured by connecting the printer 1106 to the computer 1102, the display device 1104, the input device 1108, and the reading device 1110 was described, but this is not a limitation. For example, the image forming system can be made of the computer 1102 and the printer 1106, or the image forming system does not have to comprise any one of the display device 1104, the input device 1108, and the reading device 1110.

Further, for example, the printer 1106 can have some of the functions or mechanisms of the computer 1102, the display device 1104, the input device 1108, and the reading device 1110. As an example, the printer 1106 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

FOURTH EMBODIMENT

A fourth embodiment of the present invention is described below.

Overall Configuration Example of Image Forming System

Figure 24:
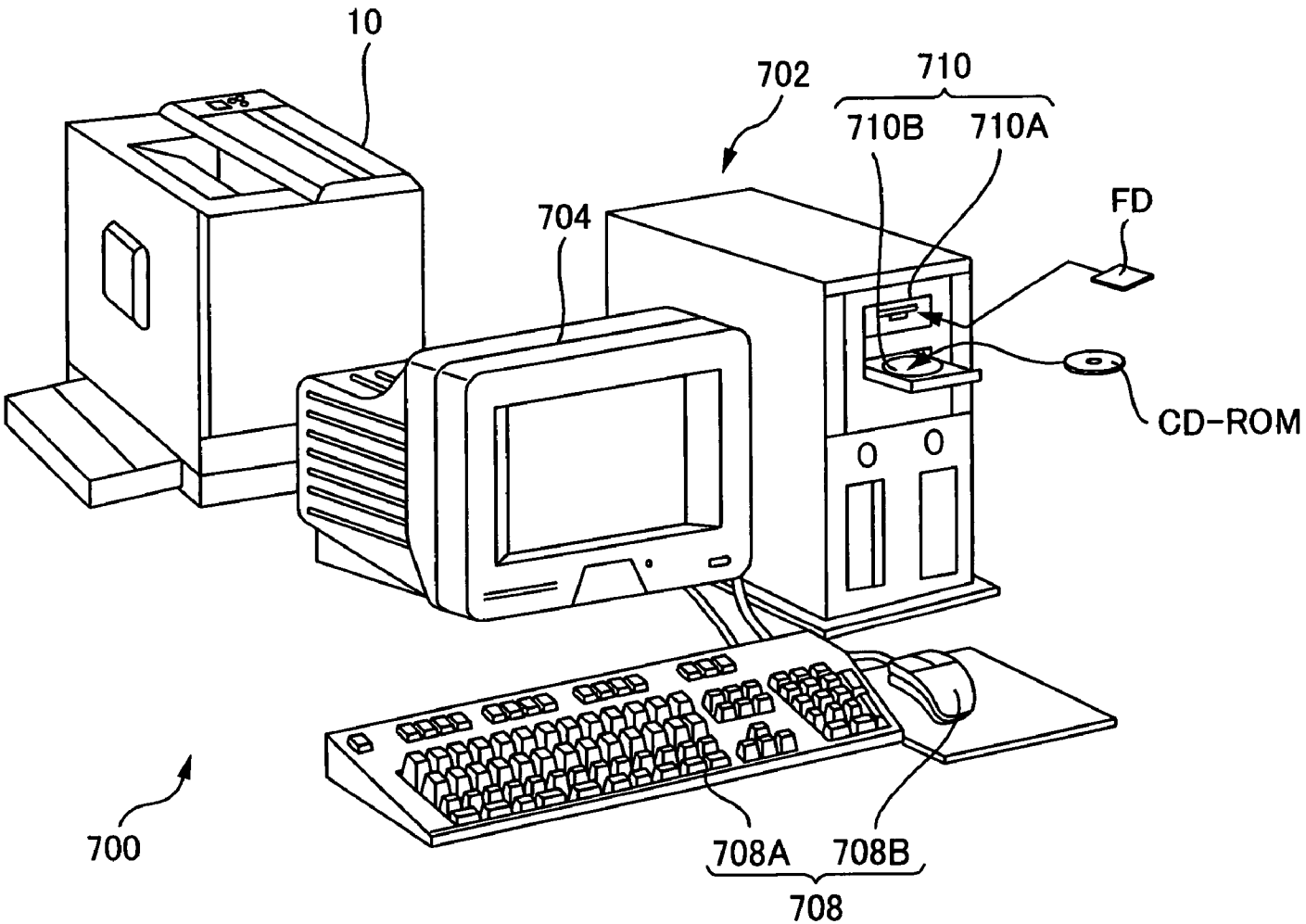
FIG. 24 is an explanatory diagram showing an external configuration of an image forming system 700.
Figure 25:
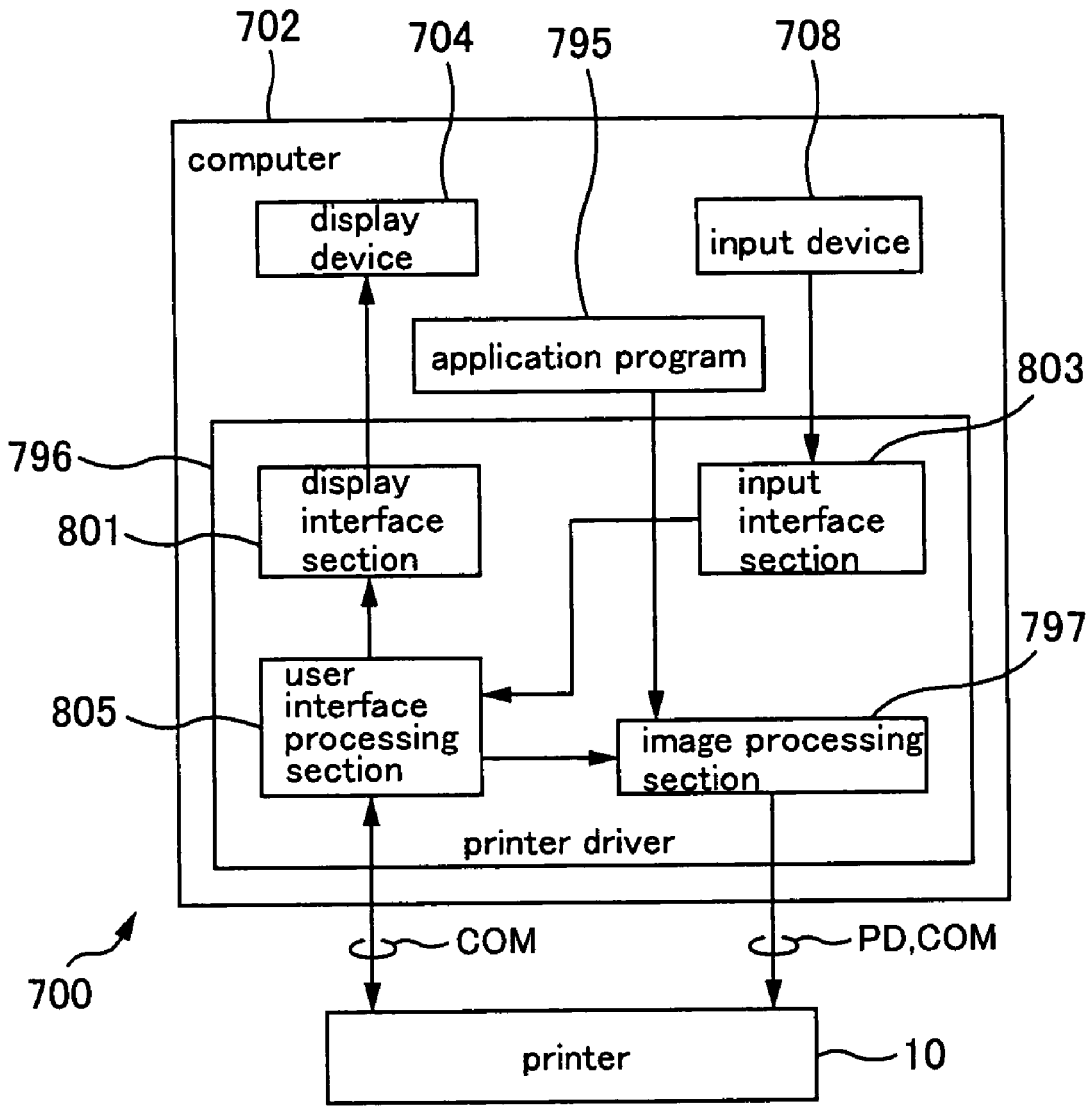
FIG. 25 is a block diagram showing a portion of the structure of the image forming system 700 shown in FIG. 24.

Next, using FIG. 24 and FIG. 25, an outline of an image forming system 700 is described. FIG. 24 is an explanatory diagram showing an external configuration of an image forming system 700. FIG. 25 is a block diagram showing a portion of the structure of the image forming system 700 shown in FIG. 24. The image forming system 700 includes a laser beam printer 10 (which is also referred to as a "printer" below) that serves as an image forming apparatus, and a computer 702 that is capable of communicating with the printer 10. Further, the computer 702 includes a display device 704, such as a CRT (Cathode Ray Tube), a liquid crystal display device, or a plasma display, that serves as an example of a displaying section for displaying information, an input device 708 such as a keyboard 708A and a mouse 708B, a reading device 710 such as an FD (Flexible Disk) device 710A, a CD-ROM drive device 710B, an MO (Magneto Optical) disk drive device (not shown), a DVD (Digital Versatile Disk) device (not shown), an internal memory (not shown) such as a RAM, and an external memory (not shown) such as a hard disk drive unit. Furthermore, in the present embodiment, the computer 702 is contained in a mini-tower-type casing, but this is not a limitation.

The computer 702 also has an operating system, an application program 795 that runs under the operating system, and a printer driver 796 which serves as a driver. The printer driver 796 includes an image processing section 797, a display interface section 801, an input interface section 803, and a user interface processing section 805.

The application program 795 is a program in the computer 702 that makes the printer 10 carry out image formation. In accordance with image-formation execution commands from the application program 795, image data AD in the application program are sent to the printer driver 796.

The image processing section 797 has the functions of receiving the image data AD, which can be interpreted by the application program 795, converting the data AD into image data PD which can be interpreted by the printer 10, and sending the converted image data PD to the printer 10 along with various control signals COM. In other words, the image processing section 797 of the printer driver 796 instructs execution of image formation to the printer 10 after carrying out the above-described image processing. In order to achieve the functions described above, the image processing section 797 executes, for example, resolution conversion, conversion of color components, and so forth.

The display interface section 801 has the function of displaying, on the display device 704, various user-interface windows relating to image formation. The input interface section 803 has the function of receiving input information that has been input by the user with the input device 708 through the user-interface windows.

The user interface processing section 805 has the function serving as an interface between the printer 10 and the display interface section 801 or the input interface section 803. For example, the user interface processing section 805 receives the input information from the input interface section 803, and interprets the input information. The user interface processing section 805 then sends various command signals COM to the printer 10 and/or the image processing section 797. The user interface processing section 805 also interprets the various command signals COM received from the printer 10 and sends display-related information to the display interface section 801.

It should be noted that the printer driver 796 of the computer 702 is supplied in a form recorded on computer-readable storage media. Various kinds of computer-readable storage media can be used for these storage media, such as flexible disks, CD-ROMS, magneto-optical disks, IC cards, ROM cartridges, punched cards, printed articles on which codes such as barcodes have been printed, internal storage devices in computers (e.g., memories such as RAMs and ROMS), and external storage devices. Furthermore, such computer programs may be downloaded to the computer 702 via the Internet.

Further, although detailed description will be given further below, when developing units are attached to each of the attach/detach sections, the printer 10 according to the present embodiment can be used as a color printer that forms color images by developing a latent image bore on a photoconductor with toner contained in those developing units, and when a developing unit is attached to only one of the attach/detach sections, the printer 10 can be used as a monochrome printer that forms monochrome images by developing a latent image bore on the photoconductor with the toner contained in that developing unit. As regards the printer driver 796, a color driver that corresponds to the printer 10 when it is used as a color printer and a monochrome driver that corresponds to the printer 10 when it is used as a monochrome printer are supplied.

The color driver and the monochrome driver differ in terms of the following aspects. First, the monochrome driver does not have functions specific to colors. For example, information specific to colors is not shown on the user-interface windows displayed on the display device 704 by the display interface section 801 of the monochrome driver, and the input interface section 803 of the monochrome driver does not accept input information specific to colors.

On the other hand, the color driver is capable of instructing both execution of color-image formation and execution of monochrome-image formation to the printer 10. More specifically, the display interface section 801 of the color driver displays, on the display device 704, a user-interface window for allowing a user to select either execution of color-image formation or execution of monochrome-image formation. Then, the input interface section 803 receives input information that has been entered by the user through the user-interface window using the input device 708, i.e., information that indicates either execution of color-image formation or execution of monochrome-image formation. The image processing section 797 then receives the information through the user interface processing section 805; if the information indicates execution of color-image formation, then the image processing section executes image processing for forming color images, whereas if the information indicates execution of monochrome-image formation, then it executes image processing for forming monochrome images. After image processing is finished, the monochrome or color image data PD that have been processed are sent to the printer. It should be noted that the monochrome driver can only instruct the printer 10 to execute monochrome-image formation.

Overall Configuration Example of Image Forming Apparatus

The printer described in the first embodiment can be used as the printer for the image forming system 700 of the present embodiment. FIG. 1 through FIG. 7 and explanation thereon in the first embodiment should be referred to for details on the printer 10.

The printer 10, as shown in FIG. 1 through FIG. 7, and the computer 702 exchange image data PD and control signals COM via appropriate interfaces such as the interface 112. The main controller 101 in the control unit 100 of the printer 10 receives the image data PD and the control signals COM from the computer 702, and the unit controller 102 in the control unit 100 of the printer 10 controls the various units etc. in the printer 10 according to the image data PD and the control signals COM that have been received.

The configuration of the control unit 100 of the printer 10 is substantially the same as that of the first embodiment, but the way in which some of the data etc. are stored is different.

As described above, the control unit 100 includes the main controller 101 and the unit controller 102 (as shown in FIG. 3).

The main controller 101 includes a CPU 111, the interface 112 for establishing communication with the computer 702, an image memory 113 for storing image data PD that have been input from the computer 702, and a main-controller-side memory 114 that is made up of, for example, an electrically rewritable EEPROM 114*a*, a RAM 114*b*, and a programmable ROM in which various programs for control are written.

The CPU 111 of the main controller 101 manages control of writing and reading of image data PD, which have been input via the interface, to and from the image memory 113, as well as manages overall control of the apparatus in synchronism with the CPU 120 of the unit controller 102 according to control signals COM that have been input from the computer 702.

Further, the EEPROM 114*a* stores apparatus-type information indicative of whether the printer 10 is to be used as a color printer or as a monochrome printer. Although detailed description will be given further below, the CPU 111 receives, from the unit controller 102 at predetermined timings, developing-unit attachment information which indicates where, among the four attach/detach sections, the developing units are currently attached. Based on the attachment information, the CPU 111 rewrites the apparatus-type information in the EEPROM 114*a*, if necessary. It should be noted that the apparatus-type information is 1-bit information that is written in the EEPROM 114*a*; value "0" indicates that the printer 10 is to be used as a color printer, and value "1" indicates that the printer 10 is to be used as a monochrome printer.

Further, a device ID, which is sent to the computer 702 when the printer 10 communicates with the computer 702 in order for the computer to recognize the device that is able to establish communication with the computer, is stored in the EEPROM 114*a*.

The unit controller 102 includes, for example, a CPU 120, a unit-controller-side memory 116 that is made up of, for example, an electrically rewritable EEPROM 116*a*, a RAM, and a programmable ROM in which various programs for control are written, and various drive control circuits for driving and controlling the units in the apparatus body (i.e., the charging unit 30, the exposing unit 40, the first transferring unit 60, the cleaning unit 75, the second transferring unit 80, the fusing unit 90, and the displaying unit 95) and the YMCK developing device 50.

The CPU 120 of the unit controller 102 is electrically connected to each of the drive control circuits and controls the drive control circuits according to control signals from the CPU 111 of the main controller 101. More specifically, the CPU 120 controls each of the units and the YMCK developing device 50 according to signals received from the main controller 101 while detecting the state of each of the units and the YMCK developing device 50 by receiving signals from sensors provided in each unit.

The CPU 120 also controls each of the drive control circuits according to the apparatus-type information described above. More specifically, if the value of the apparatus-type information is "0", then the CPU 120 controls the units and the YMCK developing device 50 of the printer 10 to function as a color printer, and if the value of the apparatus-type information is "1", then the CPU 120 controls the units and the YMCK developing device 50 of the printer 10 to function as a monochrome printer.

The EEPROM 116*a* stores the developing-unit attachment information which indicates where, among the four attach/detach sections, the developing units are currently attached. Although detailed description will be given further below, after detachment and attachment of a developing unit, the CPU 120 determines whether the developing unit has been attached to the corresponding attach/detach section, and according to the determination results, it rewrites the attachment information in the EEPROM 116*a*, if necessary. It should be noted that the attachment information is written in the EEPROM 116*a* as 4-bit information, i.e., 1-bit information for each attach/detach section; value "0" indicates that no developing unit is attached, and value "1" indicates that a developing unit is attached.

Further, the CPU 120 of the unit controller 102 is connected, via a serial interface (I/F) 121, to a non-volatile storage element 122 (which is referred to below as "apparatus-side memory") which is, for example, a serial EEPROM. Data necessary for controlling the apparatus are stored in the apparatus-side memory 122. The CPU 120 is not only connected to the apparatus-side memory 122, but is also connected to the developing-unit-side memories 51*a*, 52*a*, 53*a*, and 54*a*, which are provided on the respective developing units 51, 52, 53, and 54, via the serial interface 121. Therefore, data can be exchanged between the apparatus-side memory 122 and the developing-unit-side memories 51*a*, 52*a*, 53*a*, and 54*a*, and also, it is possible to input chip-select signals CS to the developing-unit-side memories 51*a*, 52*a*, 53*a*, and 54*a* via the input/output port 123. The CPU 120 is also connected to the HP detector 31 via the input/output port 123.

About the Operations of the Image Forming System

As described above, when the developing units are attached to each of the attach/detach sections 50*a*, 50*b*, 50*c*, and 50*d*, the printer 10 according to the present embodiment can be used as a color printer for forming color images by developing the latent image bore on the photoconductor 20 using the toner T contained in each of the developing units, whereas when a developing unit is attached to only one of the attach/detach sections 50*a*, 50*b*, 50*c*, or 50*d*, then the printer 10 can be used as a monochrome printer for forming monochrome images by developing the latent image bore on the photoconductor 20 using the toner T contained in that developing unit.

Below, operations of the image forming system 700 for when the printer 10 is switched from a monochrome printer to a color printer, and then, the image forming apparatus is switched from a color printer to a monochrome printer are described. The various operations of the printer 10 described below are mainly achieved by the main controller 101 or the unit controller 102 in the printer 10. Particularly, in the present embodiment, the operations are achieved by the CPU executing programs that are stored in the programmable ROM. The programs are made of codes for achieving the various operations described below.

Switching from Monochrome Printer to Color Printer

Figure 26:
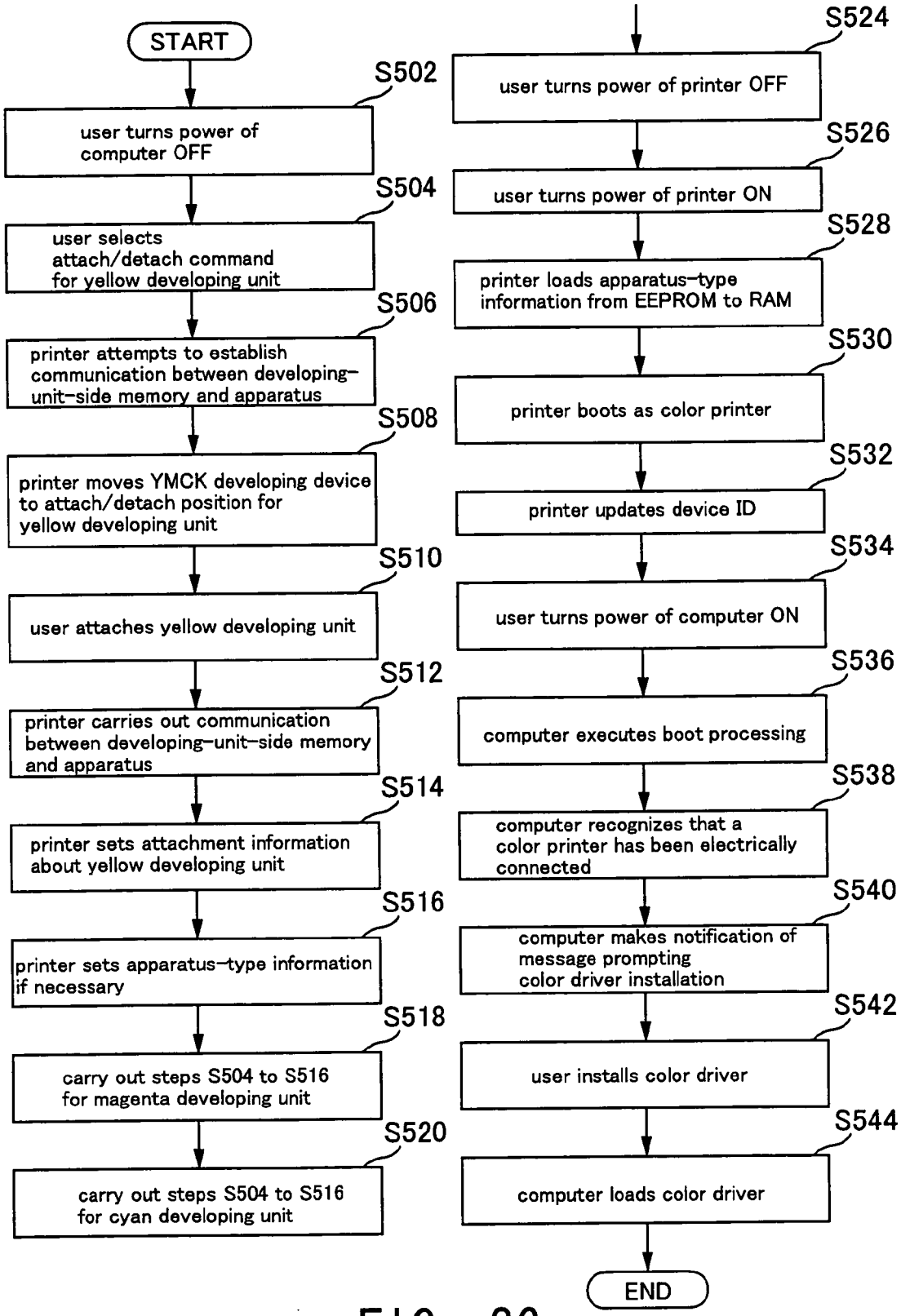
FIG. 26 is a flowchart for illustrating operations of the image forming system 700 for when the printer 10 is switched from a monochrome printer to a color printer.

First, operations of the image forming system 700 for when the printer 10 is switched from a monochrome printer to a color printer will be described using FIG. 26. FIG. 26 is a flowchart for illustrating operations of the image forming system 700 for when the printer 10 is switched from a monochrome printer to a color printer.

This flowchart starts from a state in which the power of the printer 10 and the computer 702, which structure the image forming system 700, has already been turned ON and the system is on standby for image formation to be carried out. The standby position of the YMCK developing device 50 at this time is the HP position shown in FIG. 6A.

It should be noted that the printer 10, before switching is performed, is used as a monochrome printer, and therefore, the developing unit is attached to only one of the four attach/detach sections, as shown in FIG. 2. That is, the black developing unit 51 is attached to the attach/detach section 50*a*, but no developing unit is attached to the other attach/detach sections 50*b*, 50*c*, and 50*d*. Further, the monochrome driver described above is installed to the computer 702 as the printer driver 796.

First, the user turns the power of the computer 702 OFF to disconnect the electrical connection between the computer 702 and the printer 10 (step S502.)

Then, the user operates a menu button provided, for example, on the displaying unit 95, and by selecting the attach/detach command for a certain developing unit, the user gives an instruction to the printer 10 that he/she wishes to attach or detach a developing unit. At the time of giving this instruction, the user designates the developing unit that is targeted for attachment/detachment.

In the present embodiment, the user first selects the attach/detach command for the yellow developing unit 54 (step S504). The unit controller 102 comprehends this command with the displaying unit drive control circuit. More specifically, the unit controller 102 determines which, among the black developing unit 51, the magenta developing unit 52, the cyan developing unit 53, and the yellow developing unit 54, is the developing unit targeted for attachment/detachment. In the present embodiment, the developing unit targeted for attachment/detachment is the yellow developing unit 54. Therefore, the unit controller 102 rotates the pulse motor for a predetermined number of pulses to rotate the YMCK developing device 50 and to move the position of the YMCK developing device 50 from the HP position to the connector attach/detach position for the yellow developing unit 54.

Then, the unit controller 102 halts the YMCK developing device 50 at the connector attach/detach position. In this halted state, the unit controller 102 moves the apparatus-side connector 34 and attempts to establish communication with the developing-unit-side memory of the developing unit (step S506). In the present embodiment, the yellow developing unit 54 has not been attached yet, and therefore, communication cannot be established.

Next, the unit controller 102 rotates the pulse motor for a predetermined number of pulses to rotate the YMCK developing device 50 and to move the position of the YMCK developing device 50 from the connector attach/detach position for the yellow developing unit 54 to the attach/detach position for the yellow developing unit 54 (step S508).

In this state, the unit controller 102 notifies the user that the yellow developing unit 54 can be attached to (or detached from) the attach/detach section by displaying a message on a displaying section etc. provided in the displaying unit 95.

Confirming the display, the user opens the outer cover of the printer 10 and attaches the yellow developing unit 54 to the attach/detach section 50*d* of the YMCK developing device 50 through the attach/detach dedicated opening 37 (step S510). After the user attaches the yellow developing unit 54 and closes the outer cover of the printer 10, the unit controller 102 detects this and moves the position of the YMCK developing device 50 from the attach/detach position for the yellow developing unit 54 to the connector attach/detach position for the yellow developing unit 54.

Then, the unit controller 102 halts the YMCK developing device 50 at the connector attach/detach position. In this halted state, the unit controller 102 moves the apparatus-side connector 34 and makes the apparatus-side connector 34 and the developing-unit-side connector 54*b* of the yellow developing unit 54 abut against each other. In this state, the developing-unit-side memory 54*a* of the yellow developing unit 54 is electrically connected to the unit controller 102 of the control unit 100, and communication is established between the developing-unit-side memory 54*a* and the apparatus body (step S512). The unit controller 102 also determines whether the communication has succeeded. If the communication has succeeded, then the unit controller 102 assumes that the yellow developing unit 54 has been attached, and sets the attachment information for the yellow developing unit 54 in the EEPROM 116*a* to "1". On the other hand, if it is determined that the communication has failed, then the unit controller 102 assumes that the yellow developing unit 54 has not been attached, and sets the attachment information for the yellow developing unit 54 in the EEPROM 116*a* to "0" (step S514). In the present embodiment, it is assumed that the communication has succeeded, and the attachment information for the yellow developing unit 54 in the EEPROM 116*a* is changed from "0" to "1".

After finishing the above-described processes relating to the attachment information, the unit controller 102 sends the attachment information for all four developing units to the main controller 101. The main controller 101 receives the attachment information and sets the above-described apparatus-type information based on the attachment information (step S516).

An algorithm according to which the main controller 101 sets the apparatus-type information based on the attachment information of the four developing units is described below. If the value of only one of the four pieces of attachment information is "1", which indicates that a developing unit is attached, then the main controller 101 sets the value of the apparatus-type information in the EEPROM 114*a* to "1", which indicates that the printer is to be used as a monochrome printer. On the other hand, if the value of two or more pieces of attachment information is "1", then the main controller 101 sets the value of the apparatus-type information to "0", which indicates that the printer is to be used as a color printer. In both cases, however, if the value of the attachment information for the black developing unit 51 is "0", then the main controller 101 does not execute the operation of setting the apparatus-type information. (That is, if the black developing unit 51, which should be attached regardless of whether the printer is to be used as a color printer or as a monochrome printer, is not attached, the apparatus-type information is not rewritten and the value of the apparatus-type information is kept the same.) The relationship between the values of the attachment information and the operations of setting the apparatus-type information is as shown in FIG. 27.

In the present embodiment, the values of the attachment information of the developing units are "1" for the black developing unit, "0" for the magenta developing unit, "0" for the cyan developing unit, and "1" for the yellow developing unit (i.e., the values match case "J" of FIG. 27). Therefore, the main controller 101 rewrites the value of the apparatus-type information from "1", which indicates "monochrome printer", to "0", which indicates "color printer".

Next, the processes from step S504 through step S516 described above are carried out for the cyan developing unit 53 and the magenta developing unit 52 (step S518 and step S520). As a result of carrying out these processes, the values of the attachment information for the cyan developing unit 53 and the magenta developing unit 52 are rewritten from "0" to "1". It should be noted that in step S518, the values of the attachment information of the developing units received by the main controller 101 are "1" for the black developing unit, "0" for the magenta developing unit, "1" for the cyan developing unit, and "1" for the yellow developing unit (i.e., the values match case "L" of FIG. 27). Therefore, the value of the apparatus-type information after step S518 stays at "0". Similarly, in step S520, the values of the attachment information of the developing units received by the main controller 101 are "1" for the black developing unit, "1" for the magenta developing unit, "1" for the cyan developing unit, and "1" for the yellow developing unit (i.e., the values match case "Q" of FIG. 27). Therefore, the value of the apparatus-type information after step S520 stays at "0".

Next, the user temporarily halts power supply to the printer by turning the power of the printer 10 OFF, for example (step S524). The user then supplies power to the printer again by turning the power of the printer 10 ON, for example (step S526).

When power is supplied to the printer 10, the main controller 101 detects this and loads the apparatus-type information from the EEPROM 114*a* to the RAM 114*b* (step S528). Here, the value "0", which indicates "color printer", is loaded to the RAM 114*b*. The CPU 120 of the unit controller 102 then controls the drive control circuits based on the apparatus-type information that has been loaded to the RAM 114*b*. More specifically, as a result of referencing the apparatus-type information in the RAM 114*b*, the printer 10 boots as a color printer, and the units and the YMCK developing device 50 of the printer 10 are controlled to function as a color printer (step S530).

Further, the printer 10 refers to the apparatus-type information in the RAM 114*b* and updates the device ID stored in the EEPROM 114*a* (step S532). In the present example, since the apparatus-type information in the RAM 114*b* has the value "0", which indicates "color printer", the device ID is updated to a device ID that indicates a color printer (which is also referred to as a "color-printer device ID" below). In other words, the device ID is updated at the time when the printer is switched from a monochrome printer to a color printer.

Next, the user turns the power of the computer 702 ON in order to electrically connect the computer 702 to the printer 10 (step S534). The computer 702 carries out boot processing (step S536), and at this time, a so-called plug-and-play function activates.

More specifically, since the device ID has been updated to the color-printer device ID at step S532, the computer 702 recognizes that a new device (i.e., a color printer) has been electrically connected by receiving the color-printer device ID from the printer 10 (step S538). The computer 702 then carries out settings relating to the color printer (e.g., allocation of hardware resources such as I/O ports) and also loads a color driver corresponding to the color printer (step S544).

It should be noted that at the time when the plug-and-play function is activated at step S536, the computer 702 does not have a color driver. Therefore, the computer 702 first makes a notification of a message prompting the user to install the color driver (step S540). In response to this notification, the user inserts a CD-ROM etc. into the computer 702 to install the color driver (step S542). When the color driver is installed, the computer 702 loads the color driver (step S544), and then the user can instruct execution of image formation using the color driver that has been loaded.

It should be noted that in the present embodiment, detachment of a developing unit from an attach/detach section other than the attach/detach section 50*a*, in order to change the state of the printer 10 from a state where developing units are attached to at least two attach/detach sections to a state where a developing unit is attached only to the attach/detach section 50*a*, is only possible when power is being supplied to the printer 10.

It should also be noted that as regards step S544, the computer 702 may, after the color driver is installed, make a notification to the user of a message prompting the user to restart the computer 702, and the color driver may be loaded when the user restarts the computer 702 in response to this notification.

Switching from Color Printer to Monochrome Printer

Figure 28:
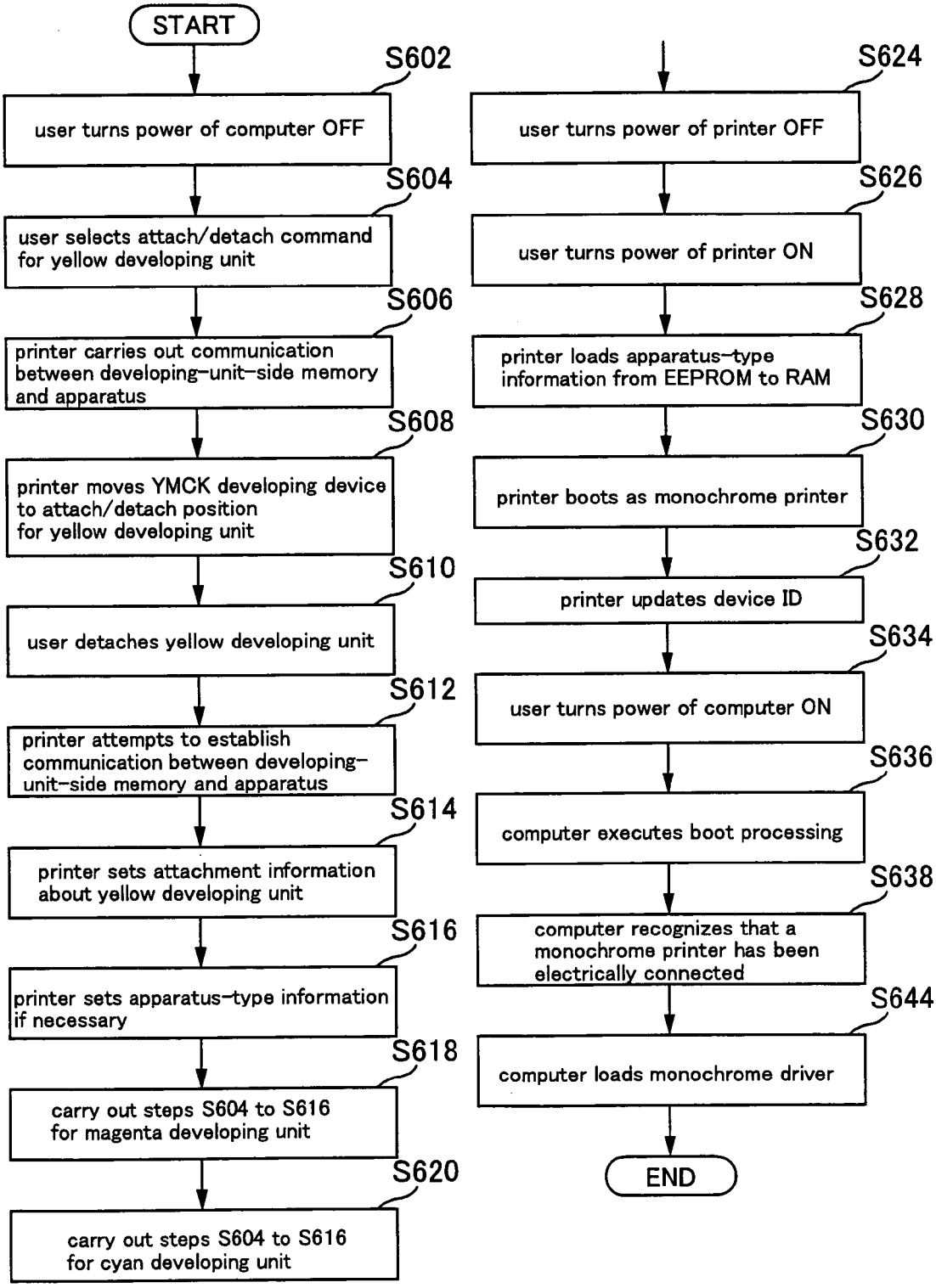
FIG. 28 is a flowchart for illustrating operations of the image forming system 700 for when the printer 10 is switched from a color printer to a monochrome printer.

Next, operations of the image forming system 700 for when the printer 10 is switched from a color printer to a monochrome printer will be described using FIG. 28. FIG. 28 is a flowchart for illustrating operations of the image forming system 700 for when the printer 10 is switched from a color printer to a monochrome printer.

This flowchart starts from the state at step S544 described above, that is, a state in which the power of the printer 10 and the computer 702, which structure the image forming system 700, has already been turned ON and the printer 10 is on standby for image formation to be carried out. The standby position of the YMCK developing device 50 at this time is the HP position shown in FIG. 6A.

It should be noted that the printer 10, before switching is performed, is used as a color printer, and therefore, the developing units are attached to all four attach/detach sections, as shown in FIG. 1. That is, the black developing unit 51 is attached to the attach/detach section 50*a*, the magenta developing unit 52 is attached to the attach/detach section 50*b*, the cyan developing unit 53 is attached to the attach/detach section 50*c*, and the yellow developing unit 54 is attached to the attach/detach section 50*d*. Further, the monochrome driver and the color driver described above are installed to the computer 702 as the printer driver 796.

First, the user turns the power of the computer 702 OFF to disconnect the electrical connection between the computer 702 and the printer 10 (step S602.)

Then, the user operates a menu button provided, for example, on the displaying unit 95, and by selecting the attach/detach command for a certain developing unit, the user gives an instruction to the printer 10 that he/she wishes to attach or detach a developing unit. At the time of giving this instruction, the user designates the developing unit that is targeted for attachment/detachment.

In the present embodiment, the user first selects the attach/detach command for the yellow developing unit 54 (step S604). The unit controller 102 comprehends this command with the displaying unit drive control circuit. More specifically, the unit controller 102 determines which, among the black developing unit 51, the magenta developing unit 52, the cyan developing unit 53, and the yellow developing unit 54, is the developing unit targeted for attachment/detachment. In the present embodiment, the developing unit targeted for attachment/detachment is the yellow developing unit 54. Therefore, the unit controller 102 rotates the pulse motor for a predetermined number of pulses to rotate the YMCK developing device 50 and to move the position of the YMCK developing device 50 from the HP position to the connector attach/detach position for the yellow developing unit 54.

Then, the unit controller 102 halts the YMCK developing device 50 at the connector attach/detach position. In this halted state, the unit controller 102 moves the apparatus-side connector 34 and makes the apparatus-side connector 34 and the developing-unit-side connector 54*b* of the yellow developing unit 54 abut against each other. In this state, the developing-unit-side memory 54*a* of the yellow developing unit 54 is electrically connected to the unit controller 102 of the control unit 100, and communication is established between the developing-unit-side memory 54*a* and the apparatus body (step S606).

After finishing the communication and separating the apparatus-side connector 34 from the developing-unit-side connector 54*b*, the unit controller 102 rotates the pulse motor for a predetermined number of pulses to rotate the YMCK developing device 50 and to move the position of the YMCK developing device 50 from the connector attach/detach position for the yellow developing unit 54 to the attach/detach position for the yellow developing unit 54 (step S608).

In this state, the unit controller 102 notifies the user that the yellow developing unit 54 can be detached from (or attached to) the attach/detach section by displaying a message on the displaying section etc. provided in the displaying unit 95.

Confirming the display, the user opens the outer cover of the printer 10 and detaches the yellow developing unit 54, which is arranged inside the attach/detach dedicated opening 37, from the YMCK developing device 50 through the attach/detach dedicated opening 37 (step S610). After the user detaches the yellow developing unit 54 and closes the outer cover of the printer 10, the unit controller 102 detects this and moves the position of the YMCK developing device 50 from the attach/detach position for the yellow developing unit 54 to the connector attach/detach position for the yellow developing unit 54.

Then, the unit controller 102 halts the YMCK developing device 50 at the connector attach/detach position. In this halted state, the unit controller 102 moves the apparatus-side connector 34 and attempts to establish communication with the developing-unit-side memory of the developing unit (step S612). If communication succeeds, then the unit controller 102 assumes that the yellow developing unit 54 is attached, and sets the attachment information for the yellow developing unit 54 in the EEPROM 116*a* to "1". On the other hand, if communication fails, then the unit controller 102 assumes that the yellow developing unit 54 is not attached, and sets the attachment information for the yellow developing unit 54 in the EEPROM 116*a* to "0" (step S614). In the present embodiment, since the yellow developing unit 54 has been detached at step S610, it is assumed that the communication has failed, and the attachment information for the yellow developing unit 54 in the EEPROM 116*a* is changed from "1" to "0".

After finishing the above-described processes relating to the attachment information, the unit controller 102 sends the attachment information for all four developing units to the main controller 101. The main controller 101 receives the attachment information and sets the above-described apparatus-type information based on the attachment information (step S616).

In the present embodiment, the value of the attachment information only for the yellow developing unit 54 is "0" (and this situation matches case "P" of FIG. 27). Therefore, the main controller 101 sets the value of the apparatus-type information to "0", which indicates "color printer", in accordance with the algorithm described above. In this example, however, the value of the apparatus-type information is not changed because before detachment of the yellow developing unit 54, all four developing units were attached and the value of the apparatus-type information was "0" (the situation for case "Q" of FIG. 27).

Next, the processes from step S604 through step S616 described above are carried out for the cyan developing unit 53 and the magenta developing unit 52 (step S618 and step S620). As a result of carrying out these processes, the values of the attachment information for the cyan developing unit 53 and the magenta developing unit 52 are rewritten from "1" to "0". The values of the attachment information of the developing units received by the main controller 101 become "1" for the black developing unit, "0" for the magenta developing unit, "0" for the cyan developing unit, and "0" for the yellow developing unit (i.e., the values match case "I" of FIG. 27). Therefore, the main controller 101 changes the value of the apparatus-type information from "0", which indicates "color printer", to "1", which indicates "monochrome printer", in accordance with the algorithm described above.

Next, the user temporarily halts power supply to the printer by turning the power of the printer 10 OFF, for example (step S624). The user then supplies power to the printer again by turning the power of the printer 10 ON, for example (step S626).

When power is supplied to the printer 10, the main controller 101 detects this and loads the apparatus-type information from the EEPROM 114*a* to the RAM 114*b* (step S628). Here, the value "1", which indicates "monochrome printer", is loaded to the RAM 114*b*. The CPU 120 of the unit controller 102 then controls the drive control circuits based on the apparatus-type information that has been loaded to the RAM 114*b*. More specifically, as a result of referencing the apparatus-type information in the RAM 114*b*, the printer 10 boots as a monochrome printer, and the units and the YMCK developing device 50 of the printer 10 are controlled to function as a monochrome printer (step S630).

Further, the printer 10 refers to the apparatus-type information in the RAM 114*b* and updates the device ID stored in the EEPROM 114*a* (step S632). In the present example, since the apparatus-type information in the RAM 114*b* has the value "1", which indicates "monochrome printer", the device ID is updated from the color-printer device ID to a device ID that indicates a monochrome printer (which is also referred to as a "monochrome-printer device ID" below). In other words, the device ID is updated at the time when the printer is switched from a color printer to a monochrome printer.

Next, the user turns the power of the computer 702 ON in order to electrically connect the computer 702 to the printer 10 (step S634). The computer 702 carries out boot processing (step S636), and at this time, a so-called plug-and-play function activates.

More specifically, since the device ID has been updated to the monochrome-printer device ID at step S632, the computer 702 recognizes that a new device (i.e., a monochrome printer) has been electrically connected by receiving the monochrome-printer device ID from the printer 10 (step S638). The computer 702 then carries out settings relating to the monochrome printer (e.g., allocation of hardware resources such as I/O ports) and also loads a monochrome driver corresponding to the monochrome printer (step S644).

It should be noted that the computer 702 did not have a color driver at the time the plug-and-play function was activated when the printer was switched from a monochrome printer to a color printer as described above. On the other hand, in the present example, the computer 702 already has the monochrome driver at the time when the plug-and-play function is activated at step S636. Therefore, the computer 702 loads the monochrome driver that has already been installed thereto (step S644), without making a notification of a message prompting the user to install a monochrome driver. The user can then instruct execution of image formation using the monochrome driver that has been loaded.

It should be noted that in the present embodiment, it is possible to detach developing units from attach/detach sections other than the attach/detach section 50*a*, in order to change the state of the printer 10 from a state where developing units are attached to at least two attach/detach sections to a state where a developing unit is attached only to the attach/detach section 50*a*, only when power is being supplied to the printer 10.

As described above, the device ID of the printer 10 for when the printer 10 is being used as a color printer is different from the device ID of the printer 10 for when the printer 10 is being used as a single-color printer. In this way, it is possible to achieve an image forming apparatus etc. that is convenient for users.

That is, as described in the section of the "Description of the Related Art", it is preferable for the printer driver 796 to be provided with functions that suit a single-color printer for when the printer 10 is being used as the single-color printer, as well as functions that suit a color printer for when the printer 10 is being used as the color printer. This would be convenient for users.

Therefore, there is a demand for the computer 702 to run a driver having the appropriate functions that suit either the single-color printer or the color printer when it receives a device ID from the printer 10.

In view of the above, the device ID of the printer 10 for when the printer 10 is being used as a color printer is different from the device ID of the printer 10 for when the printer 10 is being used as a single-color printer. In this way, it becomes possible to easily cause a printer driver 796 having functions that suit the single-color printer to activate when the computer 702 receives, from the printer, a device ID indicative of the single-color printer, as well as easily cause a printer driver 796 having functions that suit the color printer to activate when the computer 702 receives, from the printer, a device ID indicative of the color printer. Consequently, it becomes possible to achieve printers etc. that are convenient for users.

Other Considerations

In the foregoing, an image forming apparatus etc. according to the present invention was described according to the above-described embodiment thereof. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

It should be noted that in the foregoing embodiment, a configuration of a system in which the printer is connected directly to the computer, as shown in FIG. 24, was described. The printer, however, may be connected to the computer via a network.

Further, in the foregoing embodiment, the computer was described to include a display device such as a CRT (Cathode Ray Tube), a liquid crystal display device, or a plasma display, an input device such as a keyboard and a mouse, a reading device such as an FD (Flexible Disk) device, a CD-ROM drive device, an MO (Magneto Optical) disk drive device, a DVD (Digital Versatile Disk) device, an internal memory such as a RAM, and an external memory such as a hard disk drive unit. This, however, is not a limitation, and some of the devices described above do not have to be provided. Further, for example, the printer may have some of the functions and/or mechanisms of the computer.

Further, in the foregoing embodiment, an intermediate transferring type laser beam printer was described as an example of the image forming apparatus, but the present invention is also applicable to laser beam printers that are not of the intermediate transferring type. Further, in the foregoing embodiment, a printer was described as an example of the image forming apparatus, but the present invention is also applicable to various other types of image forming apparatuses, such as copying machines and facsimiles.

Further, in the foregoing embodiment, an image forming apparatus provided with a rotary-type developing device was described as an example. This, however, is not a limitation, and the present invention is applicable to, for example, image forming apparatuses provided with tandem-type developing devices.

Further, in the foregoing embodiment, communication between the developing-unit-side memories and the main body of the apparatus was carried out by making the apparatus-side connector abut against the developing-unit-side connectors. This, however, is not a limitation. Communication may be achieved without making the members of the developing units and a member of the main body of the apparatus coming into contact with each other.

Further, the photoconductor is not limited to a so-called photoconductive roller having a structure in which a photoconductive layer is provided on the outer peripheral surface of a cylindrical, conductive base. The photoconductor can be a so-called photoconductive belt structured by providing a photoconductive layer on a surface of a belt-like conductive base, for example.

Further, in the foregoing embodiment, the single-color printer was a monochrome printer that forms monochrome images, when a developing unit is attached to only one of the plurality of attach/detach sections, by developing the latent image bore on the photoconductor 20 with the toner T contained in the developing unit, but this is not a limitation. More specifically, in the foregoing embodiment, the developing unit attached to the one attach/detach section was a black developing unit 51, and monochrome images were formed by developing the latent image with the toner T contained in the black developing unit 51, but this is not a limitation. The developing unit attached to that one attach/detach section may be a developing unit having toner of another color, and images in that color may be formed by developing the latent image with the toner contained in that developing unit.

Further, in the foregoing embodiment, the device ID was updated at the time when the printer was switched from a single-color printer to a color printer or from a color printer to a single-color printer. This, however, is not a limitation. For example, the device ID may be updated after some period of time has lapsed from when the printer was switched from a single-color printer to a color printer or from a color printer to a single-color printer.

If, however, the device ID is to be updated after some period of time has lapsed from when the printer was switched from a single-color printer to a color printer or from a color printer to a single-color printer, then there is a possibility that a computer may receive a device ID indicative of a single-color printer even though the printer is being used as a color printer, or receive a device ID indicative of a color printer even though the printer is being used as a single-color printer.

On the other hand, the foregoing embodiment is more preferable in terms that it is possible for a computer to certainly receive a device ID indicative of a color printer when the printer is being used as a color printer and receive a device ID indicative of a single-color printer when the printer is being used as a single-color printer.

Further, in the foregoing embodiment, the computer 702 had a printer driver 796 for the printer 10. This, however, is not a limitation. For example, the computer does not have to have a printer driver.

In such a case, when the computer 702 receives from the printer a device ID indicative of a single-color printer, then, for example, the computer 702 makes a notification of a message prompting the user to install the single-color driver, and in response to this notification, the user inserts a CD-ROM etc. into the computer 702 to install the single-color driver. When the single-color driver is installed, the computer 702 loads the driver, and then the user can instruct execution of image formation using the single-color driver that has been loaded.

Similarly, when the computer 702 receives from the printer a device ID indicative of a color printer, then, for example, the computer 702 makes a notification of a message prompting the user to install the color driver, and in response to this notification, the user inserts a CD-ROM etc. into the computer 702 to install the color driver. When the color driver is installed, the computer 702 loads the driver, and then the user can instruct execution of image formation using the color driver that has been loaded.

In this way, even when the computer 702 does not have a printer driver 796 for the printer 10, a driver that has functions suiting a single-color printer can easily be activated when the computer 702 receives from the printer a device ID indicative of a single-color printer, and also, a driver that has functions suiting a color printer can easily be activated when the computer 702 receives from the printer a device ID indicative of a color printer. Consequently, it is possible to achieve a printer etc. that is convenient for users.

Further, in the foregoing embodiment, the computer 702 had at least either one of: a color driver that corresponds to the printer 10 when it is used as the color printer; or a single-color driver that corresponds to the printer 10 when it is used as the single-color printer. This, however, is not a limitation. For example, the computer may have a printer driver that can be commonly used for both the single-color and color printers.

In such a case, when the computer 702 receives from the printer 10 a device ID indicative of a single-color printer, then, for example, the computer 702 sets the single-color/color mode of the printer driver 796 to the single-color mode. By setting the printer driver 796 to the single-color mode, it becomes possible for the user to instruct execution of image formation using the printer driver 796 that has been set to the single-color mode.

Similarly, when the computer 702 receives from the printer 10 a device ID indicative of a color printer, then, for example, the computer 702 sets the single-color/color mode of the printer driver 796 to the color mode. By setting the printer driver 796 to the color mode, it becomes possible for the user to instruct execution of image formation using the printer driver 796 that has been set to the color mode.

In this way, even when the computer 702 has a printer driver 796 that is shared for both the single-color and color printers, a driver that has functions suiting a single-color printer can easily be activated when the computer 702 receives from the printer a device ID indicative of a single-color printer, and also, a driver that has functions suiting a color printer can easily be activated when the computer 702 receives from the printer a device ID indicative of a color printer. Consequently, it is possible to achieve a printer etc. that is convenient for users.

Further, in the foregoing embodiment, the power of the computer 702 was turned OFF in order to disconnect the electrical connection between the computer 702 and the printer 10 (step S502 and step S602). This, however, is not a limitation. For example, it is possible to disconnect the cable connecting the computer 702 and the printer 10. Furthermore, in the foregoing embodiment, the power of the computer 702 was turned ON in order to re-establish the electrical communication between the computer 702 and the printer 10 (step S534 and step S634). This, however, is not a limitation. For example, it is possible to connect the computer 702 and the printer 10 with a cable.

Further, in the foregoing embodiment, power supply to the printer was stopped and started again by turning the power of the printer ON and OFF. This, however, is not a limitation. For example, this can be achieved by resetting the printer.

What is claimed is:

1. An image forming apparatus comprising:

a plurality of attach/detach sections to and from each of which a developer container for containing developer can be attached and detached;

an image bearing body for bearing a latent image; and a displaying section for displavig information thereon, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container; and information that is displayed on said displaying section when said image forming apparatus is used as said color image forming apparatus is different from information that is displayed on said displaying section when said image forming apparatus is used as said single-color image forming apparatus wherein, said information that is displayed on said displaying section when said image forming apparatus is used as said color image forming apparatus is information in which information specific to said color image forming apparatus has been added to said information that is displayed on said displaying section when said image forming apparatus is used as said single-color image forming apparatus, and wherein said information specific to said color image forming apparatus includes information about a number of sheets of media on which the color images have been formed.

2. An image forming apparatus comprising:

a plurality of attach/detach sections to and from each of which a developer container for containing developer can be attached and detached;

an image bearing body for bearing a latent image; and a displaying section for displaying information thereon, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container; and information that is displayed on said displaying section when said image forming apparatus is used as said color image forming apparatus is different from information that is displayed on said displaying section when said image forming apparatus is used as said single-color image forming apparatus wherein, said information that is displayed on said displaying section when said image forming apparatus is used as said color image forming apparatus is information in which information specific to said color image forming apparatus has been added to said information that is displayed on said displaying section when said image forming apparatus is used as said single-color image forming apparatus, and wherein said information specific to said color image forming apparatus includes information about a remaining amount of developer in the developer container that contains color developer.

3. An image forming apparatus comprising:

a plurality of attach/detach sections to and from each of which a developer container for containing developer can be attached and detached;

an image bearing body for bearing a latent image;

a displaying section for displaying information thereon;

an operating section for selecting the information that is to be displayed on said displaying section, wherein when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

information that is displayed on said displaying section when said image forming apparatus is used as said color image forming apparatus is different from information that is displayed on said displaying section when said image forming apparatus is used as said single-color image forming apparatus; and information that can be displayed on said displaying section by operating said operating section when said image forming apparatus is used as said color image forming apparatus is different from information that can be displayed on said displaying section by operating said operating section when said image forming apparatus is used as said single-color image forming apparatus.

4. An image forming apparatus comprising:

a plurality of attach/detach sections to and from each of which a developer container for containing developer can be attached and detached;

an image bearing body for bearing a latent image; and a displaying section that is provided on a body of said image forming apparatus and that is for displaying information thereon, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a monochrome image forming apparatus for forming a monochrome image by developing the latent image bore on said image bearing body with the developer contained in said developer container;

said image forming apparatus has information indicative of whether said image forming apparatus is being used as said color image forming apparatus or whether said image forming apparatus is being used as said monochrome image forming apparatus;

said information that is displayed on said displaying section when said image forming apparatus is used as said color image forming apparatus is information in which information specific to said color image forming apparatus has been added to said information that is displayed on said displaying section when said image forming apparatus is used as said monochrome image forming apparatus;

said information specific to said color image forming apparatus includes information about a number of sheets of media on which the color images have been formed;

said information specific to said color image forming apparatus includes information about a remaining amount of developer in the developer container that contains color developer;

said image forming apparatus further comprises an operating section for selecting the information that is to be displayed on said displaying section; and information that can be displayed on said displaying section by operating said operating section when said image forming apparatus is used as said color image forming apparatus is different from information that can be displayed on said displaying section by operating said operating section when said image forming apparatus is used as said monochrome image forming apparatus.

5. An image forming apparatus comprising:

a plurality of attach/detach sections to and from each of which a developer container for containing developer can be attached and detached; and an image bearing body for bearing a latent image, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container; and apparatus information that is output on a medium when said color image is formed is different from apparatus information that is output on a medium when said single-color image is formed, wherein said apparatus information that is output on the medium when said color image is formed is information in which information specific to said color image forming apparatus has been added to said apparatus information that is output on the medium when said single-color image is formed, and said information specific to said color image forming apparatus includes information about a number of sheets of media on which the color images have been formed.

6. An image forming apparatus comprising:

a plurality of attach/detach sections to and from each of which a developer container for containing developer can be attached and detached; and an image bearing body for bearing a latent image, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container; and apparatus information that is output on a medium when said color image is formed is different from apparatus information that is output on a medium when said single-color image is formed, wherein said apparatus information that is output on the medium when said color image is formed is information in which information specific to said color image forming apparatus has been added to said apparatus information that is output on the medium when said single-color image is formed and said information specific to said color image forming apparatus includes information about a remaining amount of developer in the developer container that contains color developer.

7. An image forming apparatus comprising:

a plurality of attach/detach sections to and from each of which a developer container for containing developer can be attached and detached;

an image bearing body for bearing a latent image; and an operating section that is operated by a user, wherein when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

apparatus information that is output on a medium when said color image is formed is different from apparatus information that is output on a medium when said single-color image is formed; and when the user carries out a predetermined operation with respect to said operating section, said image forming apparatus outputs, on the medium, the apparatus information about said image forming apparatus corresponding to either said color image or said single-color image.

8. An image forming apparatus according to claim 7, wherein said operating section is provided on a body of said image forming apparatus.

9. An image forming apparatus comprising:

a plurality of attach/detach sections to and from each of which a developer container for containing developer can be attached and detached; and an image bearing body for bearing a latent image, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

apparatus information that is output on a medium when said color image is formed is different from apparatus information that is output on a medium when said single-color image is formed;

in a state where the developer container is attached to only one of said plurality of attach/detach sections, a monochrome image is formed by developing the latent image bore on said image bearing body with the developer contained in said developer container;

said apparatus information that is output on the medium when said color image is formed is information in which information specific to said color image forming apparatus has been added to said apparatus information that is output on the medium when said single-color image is formed;

said information specific to said color image forming apparatus includes information about a number of sheets of media on which the color images have been formed;

said information specific to said color image forming apparatus includes information about a remaining amount of developer in the developer container that contains color developer;

an apparatus-type name that is output on the medium when said color image is formed is different from an apparatus-type name that is output on the medium when said single-color image is formed;

said image forming apparatus further comprises an operating section that is operated by a user; and when the user carries out a predetermined operation with respect to said operating section, said image forming apparatus outputs, on the medium, the apparatus information about said image forming apparatus corresponding to either said color image or said single-color image.

10. An image forming apparatus comprising:

a plurality of attach/detach sections to and from each of which a developer container for containing developer can be attached and detached; and an image bearing body for bearing a latent image, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

said image forming apparatus has information that indicates whether said image forming apparatus is being used as said color image forming apparatus or as said single-color image forming apparatus, and wherein attachment and detachment of said developer container to and from each of said plurality of attach/detach sections is possible only when power is being supplied to said image forming apparatus.

11. An image forming apparatus comprising:

a plurality of attach/detach sections to and from each of which a developer container for containing developer can be attached and detached; and an image bearing body for bearing a latent image, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container; and said image forming apparatus has information that indicates whether said image forming apparatus is being used as said color image forming apparatus or as said single-color image forming apparatus; and wherein said information is set when power is supplied to said image forming apparatus and is not updated until power supply to said image forming apparatus is stopped.

12. An image forming apparatus according to claim 11, wherein said single-color image forming apparatus is a monochrome image forming apparatus that forms monochrome images, when a black developer container containing black developer is attached to only one of said plurality of attach/detach sections, by developing the latent image bore on said image bearing body with the black developer contained in said black developer container.

13. An image forming apparatus according to claim 12, wherein:

if said black developer container is attached only to said one of said plurality of attach/detach sections when power is supplied to said image forming apparatus, then said information is set as information that indicates that said image forming apparatus is being used as said monochrome image forming apparatus; and if said black developer container and at least one developer container other than said black developer container are attached to said plurality of attach/detach sections when power is supplied to said image forming apparatus, then said information is set as information that indicates that said image forming apparatus is being used as said color image forming apparatus.

14. An image forming apparatus according to claim 13, wherein:

said image forming apparatus further comprises a controller that controls said image forming apparatus;

said controller includes a volatile memory; and said information is set to said volatile memory.

15. An image forming apparatus according to claim 14, wherein:

said controller includes a non-volatile memory; and said information is temporarily set to said non-volatile memory, and said information that has been temporarily set to said non-volatile memory is read into said volatile memory when power is supplied to said image forming apparatus and is set to said volatile memory.

16. An image forming apparatus according to claim 15, wherein said information is temporarily set to said non-volatile memory when attachment or detachment of the developer container to or from one of said plurality of attach/detach sections is finished.

17. An image forming apparatus according to claim 15, wherein:

if said black developer container is attached only to said one of said plurality of attach/detach sections, then said information is temporarily set as information that indicates that said image forming apparatus is being used as said monochrome image forming apparatus;

if said black developer container and at least one developer container other than said black developer container are attached to said plurality of attach/detach sections, then said information is temporarily set as information that indicates that said image forming apparatus is being used as said color image forming apparatus; and if said black developer container is not attached, then temporary setting of said information is not carried out.

18. An image forming apparatus according to claim 15, wherein:

each said developer container is attachable to only one of said plurality of attach/detach sections that corresponds to that developer container;

said image forming apparatus has attachment/no-attachment information about each said developer container for each of said attach/detach sections; and temporary setting of said information is carried out based on said attachment/no-attachment information.

19. An image forming apparatus comprising:

a plurality of attach/detach sections to and from each of which a developer container for containing developer can be attached and detached; and an image bearing body for bearing a latent image, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

said image forming apparatus has information that indicates whether said image forming apparatus is being used as said color image forming apparatus or as said single-color image forming apparatus;

attachment and detachment of said developer container to and from each of said plurality of attach/detach sections is possible only when power is being supplied to said image forming apparatus;

said information is set when power is supplied to said image forming apparatus and is not updated until power supply to said image forming apparatus is stopped;

said single-color image forming apparatus is a monochrome image forming apparatus that forms monochrome images, when a black developer container containing black developer is attached to only one of said plurality of attach/detach sections, by developing the latent image bore on said image bearing body with the black developer contained in said black developer container;

if said black developer container is attached only to said one of said plurality of attach/detach sections when power is supplied to said image forming apparatus, then said information is set as information that indicates that said image forming apparatus is being used as said monochrome image forming apparatus;

if said black developer container and at least one developer container other than said black developer container are attached to said plurality of attach/detach sections when power is supplied to said image forming apparatus, then said information is set as information that indicates that said image forming apparatus is being used as said color image forming apparatus;

said image forming apparatus further comprises a controller that controls said image forming apparatus;

said controller includes a volatile memory;

said information is set to said volatile memory;

said controller includes a non-volatile memory;

said information is temporarily set to said non-volatile memory, and said information that has been temporarily set to said non-volatile memory is read into said volatile memory when power is supplied to said image forming apparatus and is set to said volatile memory;

said information is temporarily set to said non-volatile memory when attachment or detachment of the developer container to or from one of said plurality of attach/detach sections is finished;

if said black developer container is attached only to said one of said plurality of attach/detach sections, then said information is temporarily set as information that indicates that said image forming apparatus is being used as said monochrome image forming apparatus;

if said black developer container and at least one developer container other than said black developer container are attached to said plurality of attach/detach sections, then said information is temporarily set as information that indicates that said image forming apparatus is being used as said color image forming apparatus;

if said black developer container is not attached, then temporary setting of said information is not carried out;

each said developer container is attachable to only one of said plurality of attach/detach sections that corresponds to that developer container;

said image forming apparatus has attachment/no-attachment information about each said developer container for each of said attach/detach sections; and temporary setting of said information is carried out based on said attachment/no-attachment information.

20. An image forming apparatus comprising:

a plurality of attach/detach sections to and from each of which a developer container for containing developer can be attached and detached; and an image bearing body for bearing a latent image, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

said image forming apparatus has device IDs that are sent to a computer when said image forming apparatus communicates with said computer and that are used by said computer to recognize devices capable of communicating with said computer; and the device ID of said image forming apparatus for when said image forming apparatus is being used as said color image forming apparatus is different from the device ID of said image forming apparatus for when said image forming apparatus is being used as said single-color image forming apparatus.

21. An image forming apparatus according to claim 20, wherein said image forming apparatus has information indicative of whether said image forming apparatus is being used as said color image forming apparatus or whether said image forming apparatus is being used as said single-color image forming apparatus.

22. An image forming apparatus according to claim 20, wherein said single-color image forming apparatus is a monochrome image forming apparatus that forms monochrome images, when a developer container is attached to only one of said plurality of attach/detach sections, by developing the latent image bore on said image bearing body with the developer contained in said developer container.

23. An image forming apparatus according to claim 20, wherein said device ID is updated at the time when said image forming apparatus is switched from said single-color image forming apparatus to said color image forming apparatus or from said color image forming apparatus to said single-color image forming apparatus.

24. An image forming apparatus comprising:

a plurality of attach/detach sections to and from each of which a developer container for containing developer can be attached and detached; and an image bearing body for bearing a latent image, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

said image forming apparatus has device IDs that are sent to a computer when said image forming apparatus communicates with said computer and that are used by said computer to recognize devices capable of communicating with said computer;

the device ID of said image forming apparatus for when said image forming apparatus is being used as said color image forming apparatus is different from the device ID of said image forming apparatus for when said image forming apparatus is being used as said single-color image forming apparatus;

said image forming apparatus has information indicative of whether said image forming apparatus is being used as said color image forming apparatus or whether said image forming apparatus is being used as said single-color image forming apparatus;

said single-color image forming apparatus is a monochrome image forming apparatus that forms monochrome images, when a developer container is attached to only one of said plurality of attach/detach sections, by developing the latent image bore on said image bearing body with the developer contained in said developer container; and said device ID is updated at the time when said image forming apparatus is switched from said single-color image forming apparatus to said color image forming apparatus or from said color image forming apparatus to said single-color image forming apparatus.

25. An image forming system comprising:

an image forming apparatus that includes a plurality of attach/detach sections to and from each of which a developer container for containing developer can be attached and detached and an image bearing body for bearing a latent image; and a computer that is capable of communicating with said image forming apparatus, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

said image forming apparatus has device IDs that are sent to said computer when said image forming apparatus communicates with said computer and that are used by said computer to recognize devices capable of communicating with said computer; and the device ID of said image forming apparatus for when said image forming apparatus is being used as said color image forming apparatus is different from the device ID of said image forming apparatus for when said image forming apparatus is being used as said single-color image forming apparatus.

26. An image forming system according to claim 25, wherein said image forming apparatus has information indicative of whether said image forming apparatus is being used as said color image forming apparatus or whether said image forming apparatus is being used as said single-color image forming apparatus.

27. An image forming system according to claim 25, wherein said single-color image forming apparatus is a monochrome image forming apparatus that forms monochrome images, when a developer container is attached to only one of said plurality of attach/detach sections, by developing the latent image bore on said image bearing body with the developer contained in said developer container.

28. An image forming system according to claim 25, wherein said device ID is updated at the time when said image forming apparatus is switched from said single-color image forming apparatus to said color image forming apparatus or from said color image forming apparatus to said single-color image forming apparatus.

29. An image forming system according to claim 25, wherein said computer has a driver for said image forming apparatus.

30. An image forming system according to claim 29, wherein said computer has at least either one of:

a color driver that corresponds to the image forming apparatus when said apparatus is used as said color image forming apparatus; or a single-color driver that corresponds to the image forming apparatus when said apparatus is used as said single-color image forming apparatus.

31. An image forming system comprising:

an image forming apparatus that includes a plurality of attach/detach sections to and from each of which a developer container for containing developer can be attached and detached and an image bearing body for bearing a latent image; and a computer that is capable of communicating with said image forming apparatus, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

said image forming apparatus has device IDs that are sent to said computer when said image forming apparatus communicates with said computer and that are used by said computer to recognize devices capable of communicating with said computer;

the device ID of said image forming apparatus for when said image forming apparatus is being used as said color image forming apparatus is different from the device ID of said image forming apparatus for when said image forming apparatus is being used as said single-color image forming apparatus;

said image forming apparatus has information indicative of whether said image forming apparatus is being used as said color image forming apparatus or whether said image forming apparatus is being used as said single-color image forming apparatus;

said single-color image forming apparatus is a monochrome image forming apparatus that forms monochrome images, when a developer container is attached to only one of said plurality of attach/detach sections, by developing the latent image bore on said image bearing body with the developer contained in said developer container;

said device ID is updated at the time when said image forming apparatus is switched from said single-color image forming apparatus to said color image forming apparatus or from said color image forming apparatus to said single-color image forming apparatus;

said computer has a driver for said image forming apparatus; and said computer has at least either one of:

a color driver that corresponds to the image forming apparatus when said apparatus is used as said color image forming apparatus; or a single-color driver that corresponds to the image forming apparatus when said apparatus is used as said single-color image forming apparatus.

* * * * *